United States Patent [19]

Uecker et al.

[11] 4,359,062

[45] Nov. 16, 1982

[54] ELECTRONIC COIN DISPENSER

[75] Inventors: Richard P. Uecker, Juneau, Wis.; Stephen J. Horvath, Bensalem, Pa.; Francis C. Larkin, Trenton, N.J.

[73] Assignee: Brandt, Inc., Watertown, Wis.

[21] Appl. No.: 139,635

[22] Filed: Apr. 11, 1980

[51] Int. Cl.[3] ..... G07D 1/00

[52] U.S. Cl. ..... 133/2; 133/4 R; 235/92 CN

[58] Field of Search ..... 133/1 R, 2, 4 R, 4 A, 133/5 R; 235/7 R, 7 A, 92 CN, 92 CP

[56] References Cited

U.S. PATENT DOCUMENTS

| | | | |
|---|---|---|---|
| 2,988,093 | 6/1961 | Buchholz . | |
| 3,023,755 | 3/1962 | Buchholz et al. . | |
| 3,126,023 | 3/1964 | Nagy | 133/2 |
| 3,156,412 | 11/1964 | Julius et al. | 235/7 R |
| 3,330,947 | 7/1967 | Alpert et al. | 235/92 CP |
| 3,631,403 | 12/1971 | Asbo et al. . | |

OTHER PUBLICATIONS

"The New Generation Coin Dispenser Does It With Precision", Triad Design Group, Inc.

"Brandt Model 570 Electronic Cashier", Brandt, Inc.

"Cummins Model 138 Cashtronic Introduction Installation Operation", Cummins-Allison Corp., 1978.

*Primary Examiner*—Joseph J. Rolla

*Attorney, Agent, or Firm*—Quarles & Brady

[57] ABSTRACT

An electronic coin dispenser provides a calculator and a printer besides dispensing coins and displaying the amount of change on an 8-digit LED display. The electromechanical coin dispensing elements and the thermal print head are controlled by a microcomputer, which is responsive to mode select signals to direct such operations as: dispensing amounts between $0.01–$4.99; dispensing the cents portion of a dollar and cents amount on the LED display; and automatically advancing the tape a plurality of lines so that the expended portion can be conveniently torn off. Split change for a quarter and a dollar is provided by operating dual-function keys labeled "0/25" and "00/$" respectively. Remote data is received by the microcomputer through a remote interface and amounts dispensed by remote command are displayed in a distinctive manner. The microcomputer also performs timing functions which are essential to the operation of the print head and coin dispensing elements.

26 Claims, 18 Drawing Figures

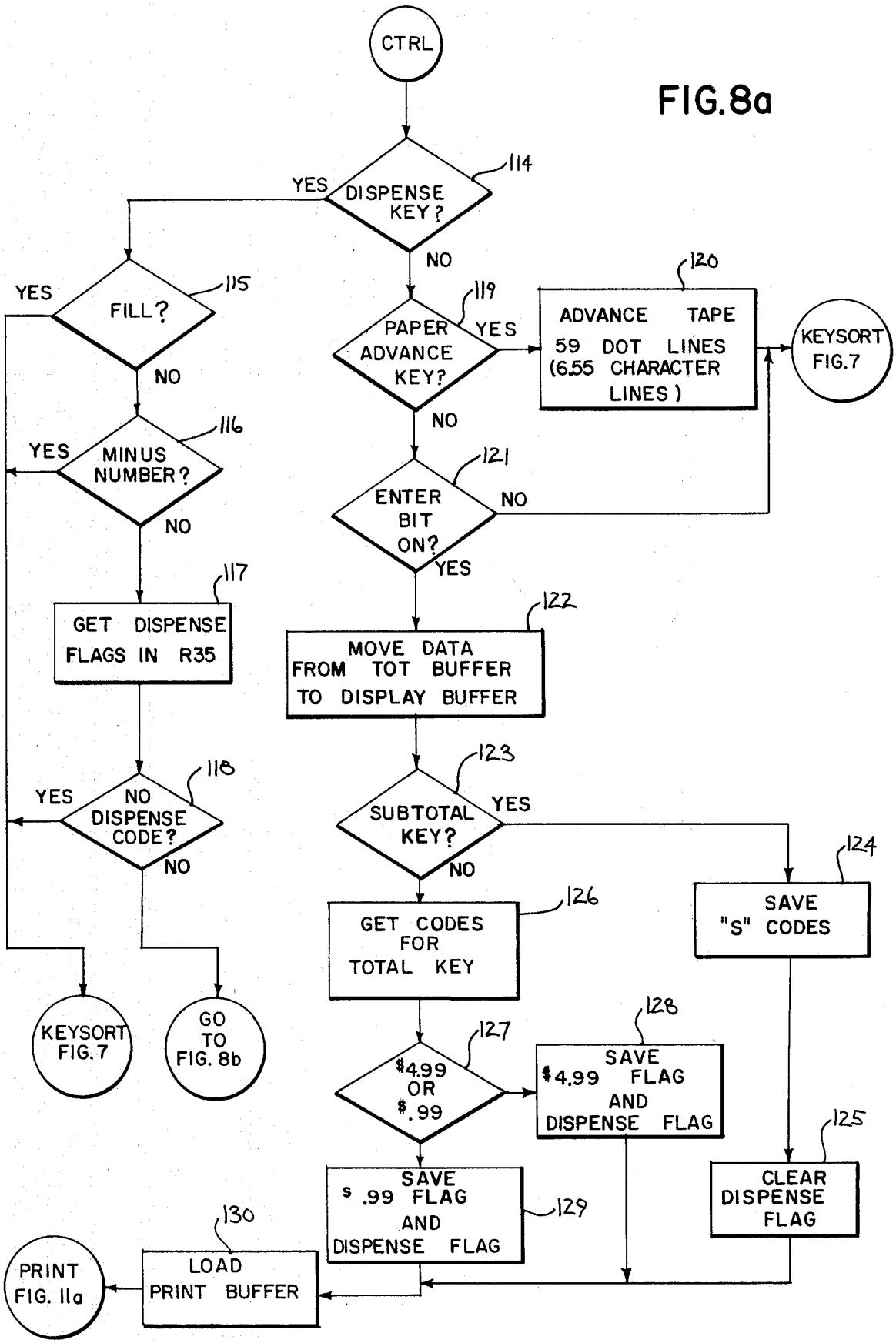
FIG.8a
CTRL
DISPENSE KEY?
114
YES
NO
FILL?
115
YES
NO
MINUS NUMBER?
116
YES
NO
GET DISPENSE FLAGS IN R35
117
NO DISPENSE CODE?
118
YES
NO
KEYSORT FIG.7
GO TO FIG. 8b
PAPER ADVANCE KEY?
119
YES
NO
ADVANCE TAPE 59 DOT LINES (6.55 CHARACTER LINES)
120
KEYSORT FIG.7
ENTER BIT ON?
121
NO
YES
MOVE DATA FROM TOT BUFFER TO DISPLAY BUFFER
122
SUBTOTAL KEY?
123
YES
NO
SAVE "S" CODES
124
GET CODES FOR TOTAL KEY
126
$4.99 OR $.99
127
SAVE $4.99 FLAG AND DISPENSE FLAG
128
SAVE $.99 FLAG AND DISPENSE FLAG
129
CLEAR DISPENSE FLAG
125
LOAD PRINT BUFFER
130
PRINT FIG. 11a

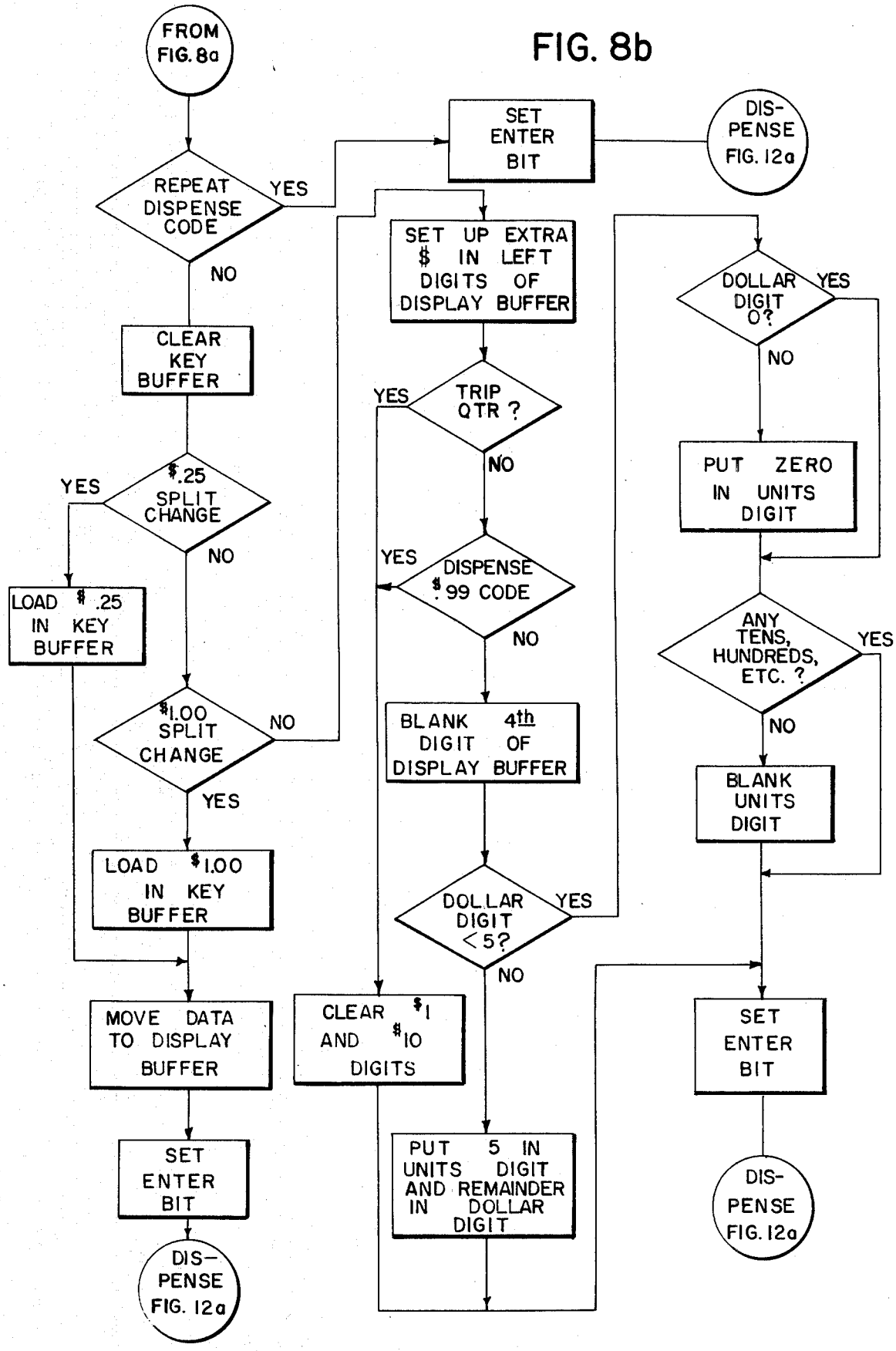
FIG. 8b
FROM FIG. 8a
REPEAT DISPENSE CODE
YES
NO
CLEAR KEY BUFFER
$.25 SPLIT CHANGE
YES
NO
LOAD $.25 IN KEY BUFFER
$1.00 SPLIT CHANGE
NO
YES
LOAD $1.00 IN KEY BUFFER
MOVE DATA TO DISPLAY BUFFER
SET ENTER BIT
DIS-PENSE FIG. 12a
SET ENTER BIT
DIS-PENSE FIG. 12a
SET UP EXTRA $ IN LEFT DIGITS OF DISPLAY BUFFER
TRIP QTR ?
YES
NO
DISPENSE $.99 CODE
YES
NO
BLANK 4th DIGIT OF DISPLAY BUFFER
DOLLAR DIGIT < 5?
YES
NO
CLEAR $1 AND $10 DIGITS
PUT 5 IN UNITS DIGIT AND REMAINDER IN DOLLAR DIGIT
DOLLAR DIGIT 0?
YES
NO
PUT ZERO IN UNITS DIGIT
ANY TENS, HUNDREDS, ETC. ?
YES
NO
BLANK UNITS DIGIT
SET ENTER BIT
DIS-PENSE FIG. 12a FROM FIG. 10A
SAVE KEY AND COLUMN DATA
182
DISPENSE KEY?
183
NO
YES
LOCKOUT GONE ?
184
NO KEY
R72 EMPTY?
185
YES
NO
R73 EMPTY?
186
YES
NO
R74 EMPTY?
187
YES
NO
R75 EMPTY ?
188
YES
NO
SAVE COLUMN DATA IN KEY STACK
189
DE-BOUNCE
LAST KEY IN THIS COLUMN?
190
NO
NO KEY
YES
AN-OTHER KEY FOUND ?
191
NO
YES
DECREMENT PASS COUNTER
192
3 PASSES ?
193
NO
YES
LOAD PASS COUNTER
195
CLEAR COLUMN DATA
194
NO KEY
RESTORE REGISTERS
196
RETURN
197

ELECTRONIC COIN DISPENSER

BACKGROUND OF THE INVENTION

1. Field of the Invention

The field of the invention is automatic coin dispensing machines.

2. Description of the Prior Art

Until recent years coin dispensing machines have been constructed as electromechanical devices. Such machines included a keyboard, a number of electromechanical switches actuated through the keyboard, a coin magazine with a plurality of coin ejector solenoids having a finger that could be aligned to kick a coin out of a respective channel, and a motor for driving these coin dispensing fingers to kick out the required amount of change to a coin chute. The operator of these coin dispensers was required to "key in" either the amount of change to be dispensed, or in devices with simple calculating ability, was required to key the cents to be tendered which the coin dispenser subtracted from $1.00 to arrive at the change figure that was dispensed. These earlier devices are distinguishable from cash registers which had much greater calculating capability, but did not dispense change automatically.

Electromechanical cash registers have for the most part been replaced by smaller, lighter electronic machines incorporating digital circuitry. In some instances, the calculating and record-keeping functions of such cash registers have been expanded by substituting point of sale computer terminals such as disclosed in Asbo, et al., U.S. Pat. No. 3,631,403, issued Dec. 28, 1971. Where such expanded capability is not necessary, it is more economical to replace such cash registers with automatic coin dispensers with some calculating capability. These coin dispensers can also serve as peripheral units, which can be connected through cables to an electronic cash register.

Electronic coin dispensers still utilize some electromechanical elements such as coin ejector solenoids and a payment solenoid to dispense coins. It is also desirable to provide a printer, which is another electromechanical device to be interfaced with the digital electronics of a modern coin dispenser. Various technical problems are presented in interfacting digital control circuitry with such electromechanical devices. For example, the voltage to the print head must be carefully controlled to prevent the head from overheating, and the roll carrying the record-keeping tape must be operable to prevent slack from developing and to provide sufficient space between groups of numbers representing different transactions. As another example of an interface problem, a minimum time arrival must be maintained between payment operations to allow the electromechanical elements to recover after each operation.

SUMMARY OF THE INVENTION

The invention is embodied in a coin dispenser with calculating capabilities and with a printer for recording calculations made prior to coin dispensing transactions.

The apparatus of the present invention more particularly includes a coin-holding means for holding coins in stacks of different denominations, a plurality of coin ejectors for selecting coins in individual stacks for ejection, and a payment driver for driving the coin ejectors to dispense the selected coins. The coin dispenser also includes a print head for forming alphanumeric characters in respective columns across the width of a record-keeping tape. Means are provided to enable portions of the print head to print characters in selected columns on the tape. A keyboard is provided for entering calculating and coin dispensing commands and operands associated with these commands. The printing and coin dispensing elements are controlled by a microcomputer which generates signals to actuate the printing and coin dispensing elements.

The coin dispenser employs a microcomputer and a minimal amount of hardware interfacing it with the printer, the coin ejectors, the payment driver, and a tape advance mechanism. With data being coupled between the microcomputer and a serial-to-parallel converter through a serial data line, the major portion of the I/O capacity of the microcomputer is reserved for othe functions. The serial-to-parallel converter can be loaded with both print and coin dispense data. Although the printing and coin dispensing elements are alternately operated the speed of the coin dispenser is such that it is not apparent to an operator.

The processing capabilities of the microcomputer are employed to great advantage by providing resident firmware in an on-board memory. As characterized by this firmware portion, the microcomputer provides the coin dispenser with an automatic "dispense on total" operation, where a calculated total is dispensed in response to the operation of the dispense key. The automatic operation is enhanced by the use of switches or jumper connections, which can be sensed at inputs of the microcomputer. One switch is set according to whether a dollar coin magazine or a triple quarter coin magazine is installed in the coin dispenser. Another switch is set to determine a limit of either $.99 or $4.99 to be dispensed. Selection of the $.99 limit allows the automatic dispensing of the cents portion of a grand total of dollars and cents shown on the display. The microcomputer then couples the dollars portion of the sum to the display, so that when necessary, dollars can be dispensed by the operator from another source. The microcomputer allows either limit to be used with the dollar coin magazine, but only the $.99 limit is permitted for the triple quarter magazine. The switches or jumper connections allow the manufacturer to provide machines with different options by presetting the switches or wiring the jumpers at the manufacturing facility.

In prior devices, additional special function keys were provided for split change operations. In this coin dispenser the "0/25" and "00/$" keys are dual function keys, which are used for split change dispensing of $.25 and $1.00, respectively. The microcomputer, with its on-board firmware, is able to examine different key operation sequences to distinguish split change operations from other operations where the "0" and "00" keys represent ordinary digits.

Besides controlling the printer, the coin dispensing elements and the LED display, the microcomputer is furtherutilized to receive data through a remote interface. Amounts that are dispensed as a result of a remote command are displayed in a manner distinguishable from amounts dispensed as a result of keyboard inputs.

The invention overcomes several problems in interfacing mechanical devices such as the printer, the tape advance mechanism and the coin dispensing mechanisms. In the specific embodiment described herein, the printer is of the thermal type in which the voltage applied to the print head must be carefully controlled to prevent overheating. A pulse-width converter in a print head enable circuit senses variations in supply voltage and adjusts the duration of the voltage to the print head to prevent overheating. When an automatic advance option is selected by the setting of a switch, the microcomputer controls the advance of the paper tape and insures that it is advanced sufficiently after each total operation, when a portion of tape is likely to be torn off. The tape is also advanced at an operator's discretion each time the paper advance key is depressed.

In the specific embodiment described below, the coin ejectors are actuated by a rotary solenoid. The coin ejectors then require an interval for spring recovery before the next dispense operation. The microcomputer times this interval and assures that voltage is not applied to the coin ejectors and the payment driver until they have recovered from a previous operation. A dashpot is connected to an arm on the rotary solenoid payment driver for smoother operation, because the payment solenoid is otherwise a snap-action device.

Another advantage of the invention is provided in the operation of the clear/clear entry (C/CE) key. When the C/CE key is operated in a clear entry mode before a function key has been struck, the printer will not mark on the tape, thereby conserving both tape and wear on the print head.

It is an object of the invention to provide a small, low-cost, calculating coin dispenser with a versatile printer.

It is another object of the invention to provide a number of operator-selected printing and dispensing options such as the automatic dispensing of the cents portion of a calculated sum, and the dispensing of amounts up to $4.99 including the dispensing of dollar coins. It is another object of the invention to provide dual function keys for directing split change operations.

Other objects and advantages, such as those discussed above, will be apparent to those skilled in the art from the description of the preferred embodiment of the invention which follows. In the description reference is made to the accompanying drawings, which form a part hereof, and which illustrate the preferred embodiment of the invention. Such embodiment does not, however, represent the full scope of the invention, which is defined by the claims following the description.

BRIEF DESCRIPTION OF THE DRAWINGS

FIGS. 8*a*, 8*b* and 9 are flow charts showing two branches of the routine of FIG. 7 for processing certain key entries;

DESCRIPTION OF THE PREFERRED EMBODIMENT

Figure 1:
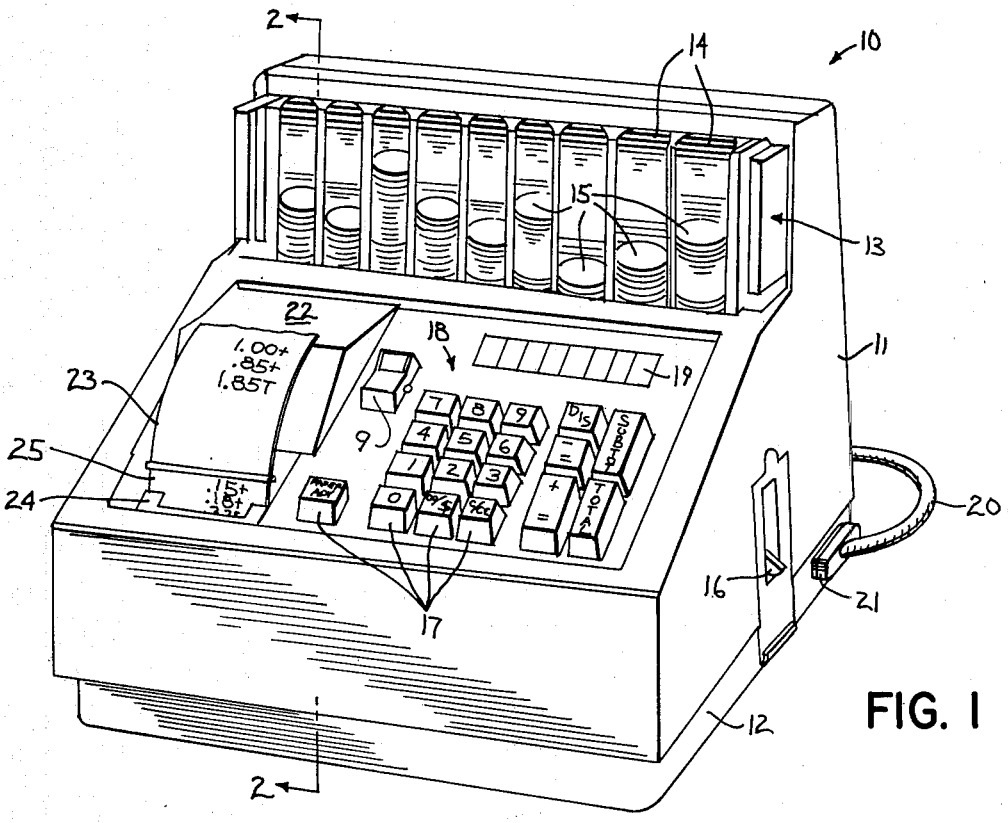
FIG. 1 is a perspective view of a calculating coin dispenser that embodies the present invention.

Referring to FIG. 1, a calculating coin dispenser 10 of the present invention has a top cover 11, which is received over a chassis 12. A coin magazine 13 is inserted from the top and to the rear of the chassis 12 and stands against an upwardly extending rear portion of the cover 11. Upright channels 14 are formed in the coin magazine 13 to receive and hold stacks of coins 15 in denominations, from left to right, of one cent, one cent, one cent, five cents, ten cents, ten cents, 25 cents, 25 cents, and one dollar. Two cents are actually dispensed from two of the one-cent stacks. The coins are dispensed from the coin dispenser through a coin chute 16, the exit of the chute 16 being seen at the lower right side of the top cover 11.

The operator selects coins to be dispensed by operating keys 17 that form a keyboard 18 on an inclined top surface of the chassis 12. Digit keys 0–9 are arranged in standard calculator fashion except for the "0" key, which is positioned at the bottom of the 7-4-1 key column. A dollar key marked "00/$" is disposed at the bottom of the 8-5-2 key column, and a clear/clear entry key marked "C/CE" is disposed at the bottom of the 9-6-3 key column. The clear/clear entry key is one of three calculator keys. The other two are an addition key and a subtraction key, which are marked "=" and "=", respectively, and which are positioned to the right of the numerical section of the keyboard. Four control keys are provided, including the SUBTOTAL and TOTAL keys at the far right, a DISPENSE (DIS) key above the addition and subtraction keys, and a PAPER ADVANCE (PAPER ADV) key to the left of the numerical keys. A power on/off switch 9 is located to the upper left of the numerical keyboard.

Above the keyboard 18 is an eight-digit LED display 19 for displaying alphanumeric information to audit calculator and coin dispensing operations, the display 19 being visible through a rectangular aperture in the chassis 12. Data can also be received by the coin dispenser through a transmission cable 20, which connects another device such as an electronic cash register (not shown) through two mating remote interface connectors 21.

To the left of the keyboard 18 is a thermal printer including a platen (not shown) on which a roll of thermally-sensitive paper tape 23 is mounted. This recording tape 23 is fed part a thermal print head 24 along a transparent guide 25, and is then fed back on top of a printer access cover 22. The paper 23 can be pulled forward against a top edge of the guide 25 to tear a strip off the roll when desired. When an automatic tape advance option is selected and the TOTAL key is operated, the tape 23 will be advanced six and a fraction character lines to that the last printed line of characters will be positioned above the guide 25 for convenient tearing of the strip of printed matter.

Figure 3:
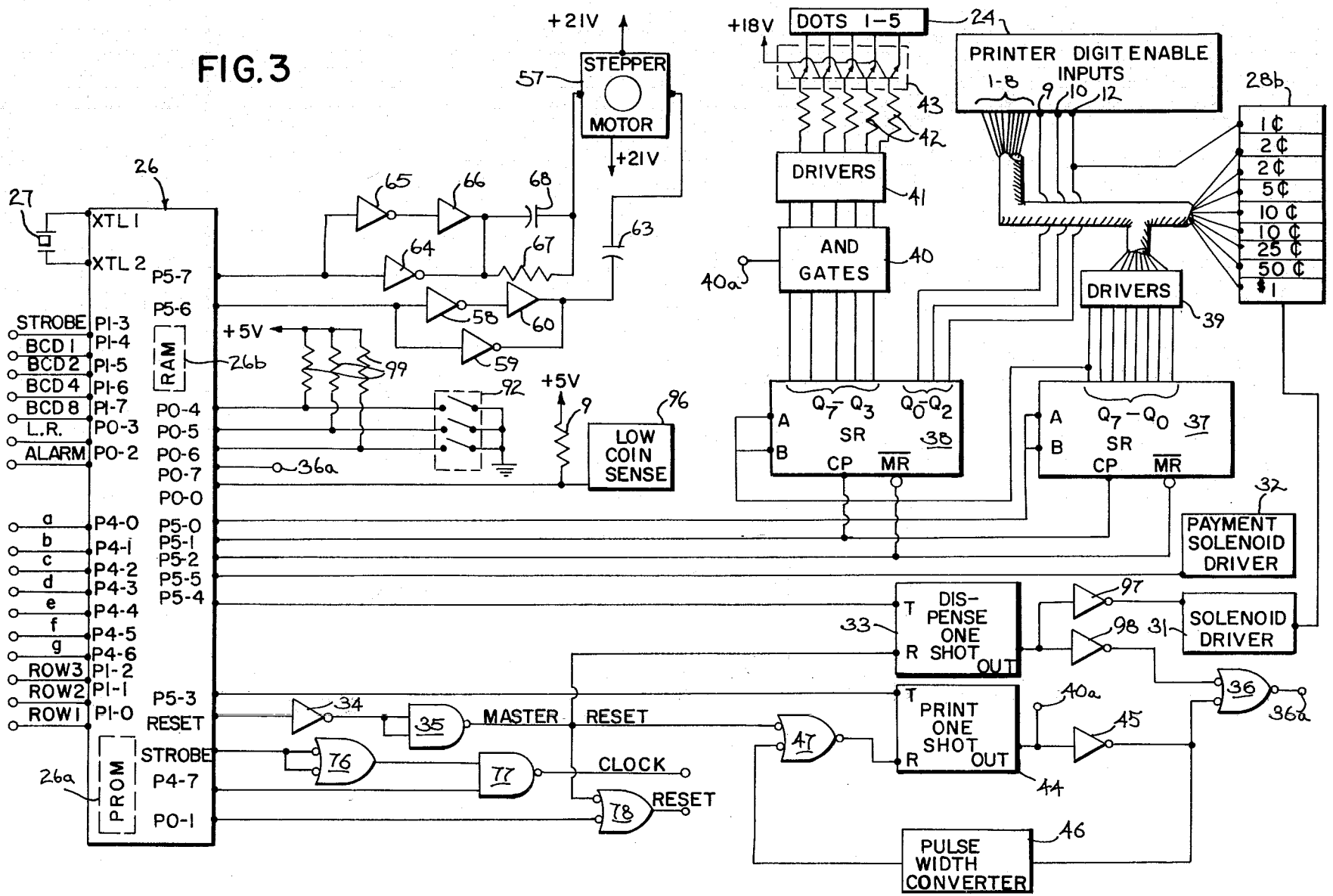
FIGS.3–6 are schematic diagrams of the electronic portion of the coin dispenser of FIG. 1.

Referring to FIG. 3, the calculating, coin dispensing and printing functions of the coin dispenser 10 are controlled by a microcomputer 26, which in this embodiment is the F3870 Micro-Machine TM 2, manufactured by Fairchild Camera and Instrument Corporation. This single chip microcomputer 26 includes an on-board, 2048-byte, mask-programmable read-only memory (PROM) 26*a* and an on-board, 64-byte, scratchpad, random-access memory (RAM) 26*b*. This chip also includes four bidirectional I/O ports, P0, P1, P4 and P5. Each of these I/O ports, P0, P1, P4 and P5 has eight single-bit lines which can be used as either TTL compatible inputs or as latched outputs. The lines in the first I/O port, P0, are designated serially from P0-0, the least significant bit, to P0-7, the most significant bit. The other I/O ports are numbered accordingly. Port 6 (not shown) serves as an interrupt control port and port 7 (not shown) is a port for addressing a binary timer. Besides I/O ports, the microcomputer also includes a pair of time base inputs $XTL_1$ and $XTL_2$, a RESET output and a STROBE output. A 4.0 megahertz external clock crystal 27 is connected across the time base inputs $XTL_1$ and $XTL_2$. The connections to the I/O ports and other terminals on the microcomputer 26 will be described below.

The on-board PROM 26*a* stores a plurality of firmware instructions for directing the operation of the microcomputer 26 and the other circuitry in the coin dispenser 10. These instructions are listed in Appendix A and will be described in relation to FIGS. 7–13 which show the operation of the coin dispenser. The scratchpad RAM 26*b* provides 64 8-bit registers which are addressed through an indirect scratchpad address register (ISAR) included in the microcomputer chip 26. Appendix B shows a character look-up table and Appendix C shows the usage of the registers in the scratchpad RAM 26*b*, and these tables are of assistance in following the program listing provided in Appendix A. For further information concerning the architecture, the operation and the instruction set of the F3870 microcomputer 26, reference is made to a Preliminary Data Sheet on the subject, which was published in 1977 by Fairchild Camera and Instrument Corporation.

The microcomputer 26 controls a plurality of electromechanical output devices that actually perform the coin dispensing operation. The microcomputer also actuates the thermal print head 24 and the mechanism for advancing the thermally-sensitive tape 23 past the print head 24. It controls this apparatus while still providing I/O capacity for sensing keyboard inputs and remotely entered inputs that are received through the remote interface connector 21.

Figure 2:
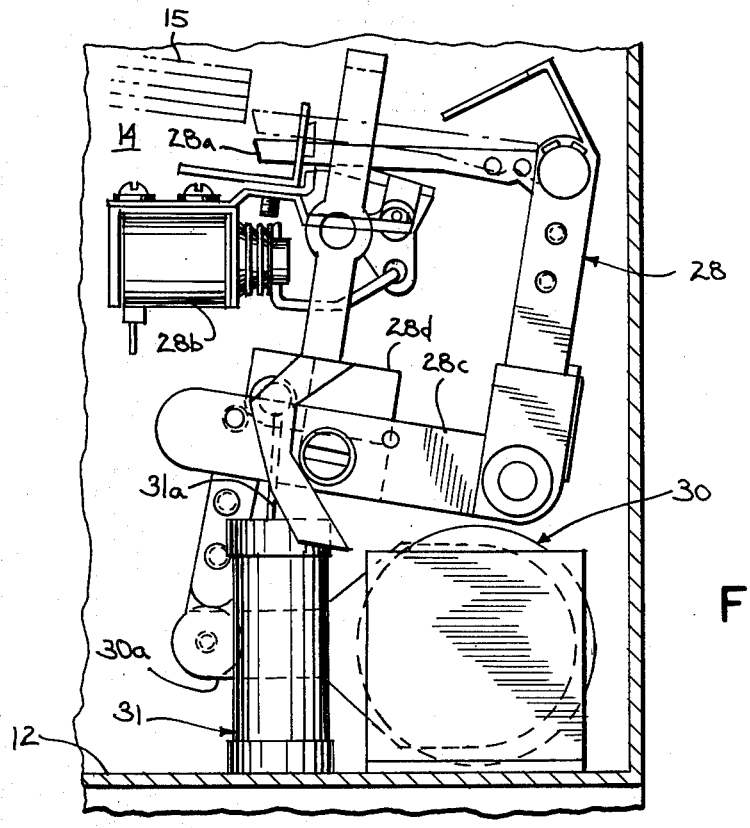
FIG. 2 is an enlarged fragmentary sectional view taken in the plane indicated by line 2—2 in FIG. 1.

Referring to FIGS. 2 and 3, the coin dispensing mechanism includes a plurality of coin ejector mechanisms 28, each with a finger 28*a* that is positioned behind a respective channel 14 in the coin magazine 13. The finger 28*a* is lifted to become aligned with one or more coins 15 in the stack when a lifter solenoid 28*b* is energized. Such coin ejector mechanisms are more fully described in Buchholz, U.S. Pat. No. 2,988,093, issued June 13, 1961. Coins 15 are not actually dispensed, however, until a payment mechanism is actuated to drive the coin ejector mechanism 28, and to move the finger 28 forward to eject coins 15 in the coin chute 16. The coin ejector mechanism then requires a period of time to recover before the next dispense operation. In U.S. Pat. No. 2,988,093 a motor is coupled through a solenoid-actuated clutch to drive the coin ejector mechanism 28. In the coin dispenser 10 of the present invention, a rotary solenoid 30 is coupled through a drive linkage to the coin ejecting fingers 28*a*.

Use of a rotary solenoid 30 instead of a motor reduces size and weight of the electromechanical portion of the coin dispenser 10, however, the rotary solenoid 30 is a snapaction device, which is not, ordinarily, an ideal driving mechanism. To provide smooth operation when the rotary solenoid 30 is used as the sole driving means, a dashpot 31, seen in FIG. 2, is mounted on the inside of the chassis 12 next to the solenoid 30 and connected to a generally horizontal arm 28*c* in the drive linkage. The rotary solenoid 30 has a radially extending arm 30*a* which is connected to a plate 28*d* mounted on the horizontally disposed linkage arm 28*c*. The dashpot 31 has a plunger 31*a* which is also coupled to horizontal arm 28*c* through the plate 28*d* to damp the driving motion of the rotary solenoid 30.

Referring to FIG. 3, the lifter solenoids 28*b* which are seen in FIG. 3, and the payment solenoid 30 which is not seen in FIG. 3, are electrically driven by respective drivers 31 and 32. The lifter solenoids driver 31 is a relay and the payment solenoid driver 32 includes a relay driver and a solid state relay that controls the energization of the payment solenoid 30 in FIG. 2. The payment solenoid driver 32 is controlled from output P5-5, while the lifter solenoids driver 31 is controlled through a dispense one-shot multivibrator 33. On "power-up" signals from the RESET terminal on the microcomputer 26 are coupled through an inverter 34, a NAND gate driver 35 and a MASTER RESET line to a reset input R on the dispense one-shot multivibrator 33. Output P5-4 on the microcomputer 26 is connected to a triggering input T and when a triggering pulse is received, the multivibrator 33 generates an output pulse, which is coupled through one inverter 97 to the lifter solenoids driver 31, and which is connected through another inverter 98 to one input of a low true AND gate 36. The output 36*a* of this AND gate 36 is coupled to the P0-7 input on the microcomputer 26, to "lock out" the microcomputer from starting another dispense operation until the electromechanical devices have recovered from a previous dispense operation.

Selection of the lifter solenoids 28*b* to be energized is controlled by a shift register 37, which is also used with a second shift register 38 to select characters to be printed on the tape 23 in FIG. 1. Line P5-0 on the microcomputer 26 is connected to the A and B serial inputs on the first shift register 37. Lines P5-1 and P5-2 are connected to the clock pulse (CP) input and the master reset (MR) input on both shift registers 37 and 38. The high order output Q7 on the first shift register 37 is connected to the A and B serial inputs on the second shift register 38, so that the second shift register 38 provides eight outputs of higher order than those of the first shift register 37. Outputs Q0-Q7 of the first shift register are coupled through current sink drivers 39 and diodes (not shown) to the lifter solenoids 28*b* for all but the one-cent coin channel. The lowest order output Q0 is coupled to the one dollar dispense solenoid 28*b* while the highest order output Q7 in the first shift register is coupled to a lifter solenoid 28*b* for one of the two-cent coin channels 14. The low order output Q0 on the second shift register is coupled to a dispense solenoid 28*b* for the one-cent coin channel 14. The shift registers receive serial data from the microcomputer 26 through lines P5-0 and present parallel data at their outputs Q7-Q0 to select the coins to be dispensed. The coins 15 are then dispensed when signals are generated to the driver circuitry described below.

The shift registers 37 and 38 are also coupled to print head 24 to control printing operations. High order outputs Q7-Q3 on the second shift register 38 are each coupled through one of five AND gates 40, one of five line drivers 41, one of five resistors 42 and one of five Darlington transistors 43 to dot-making elements "1-5" for each digit in the print head 24. The print head 24 is twelve digits wide, with one digit being skipped to provide an empty column on the tape 23. Each set of five dot-making elements is enabled through a respective printer digit enable input corresponding to digits "1-10" and "12" in which characters are to be printed. Outputs Q0-Q7 on the first shift register are coupled to printer digit enable inputs "1-8", respectively. Outputs Q0-Q2 on the second shift register are connected to printer digit enable inputs "9", "10" and "12", respectively. Each character is printed as a matrix of dots that is five dots wide and seven lines high with 35 dot positions in all. When a line of data is to be printed the first dot is printed for all digits at once. The first dot-making element (DOT 1) for those digits for which the dot is to be printed are enabled, while the first dot-making elements those digits for which the dot is to be skipped are not. DOT 2 is then selected, the second dot-making element for each appropriate digit is enabled, and the cycle continues until five dots have been selected for the digits "1-10" and "12". When the AND gates 40 are not enabled the print head 24 is not operated. By selectively enabling either the coin dispenser driver circuits 31 and 32 or the AND gates 40 the microcomputer 26 determines whether data in the shift registers 37 and 38 selects coins to be dispensed or characters to be printed on the record-keeping tape 23.

The Darlington transistors 43 are supplied by a +18 supply voltage which is stepped down from an a-c power supply line (not seen). The power line voltage can vary with the result of unacceptable heating in the print head 24. The enable signal to the AND gate 40 is controlled by a print one-shot multivibrator 44 which receives its triggering input signal from output P5-3 on the microcomputer 26, and which has an output coupled to an enable input 40*a* on the AND gates 40. This output is also coupled through an inverter 45 to an input on the low true AND gate 36 that is coupled to line P0-7 to sense the duration of the DISPENSE and PRINT cycles. The output of the inverter 45 is also coupled through a pulse width converter circuit 46 to one input of another low true AND gate 47. The MASTER RESET line is coupled to the other input on this AND gate 47, which has its output connected to the reset (R) input on the print one-shot multivibrator 44. The pulse width converter circuit 46 senses the logic state of the output on the print one-shot multivibrator 44 together with any variations in the supply voltage. When the supply voltage varies by a predetermined amount from the rated voltage a signal from the pulse width converter circuit 46 enables the low true AND gate 47 to couple a reset pulse to the print one-shot multivibrator 44 to disable the AND gates 40 and prevent overheating in the print head 24.

Figure 4:
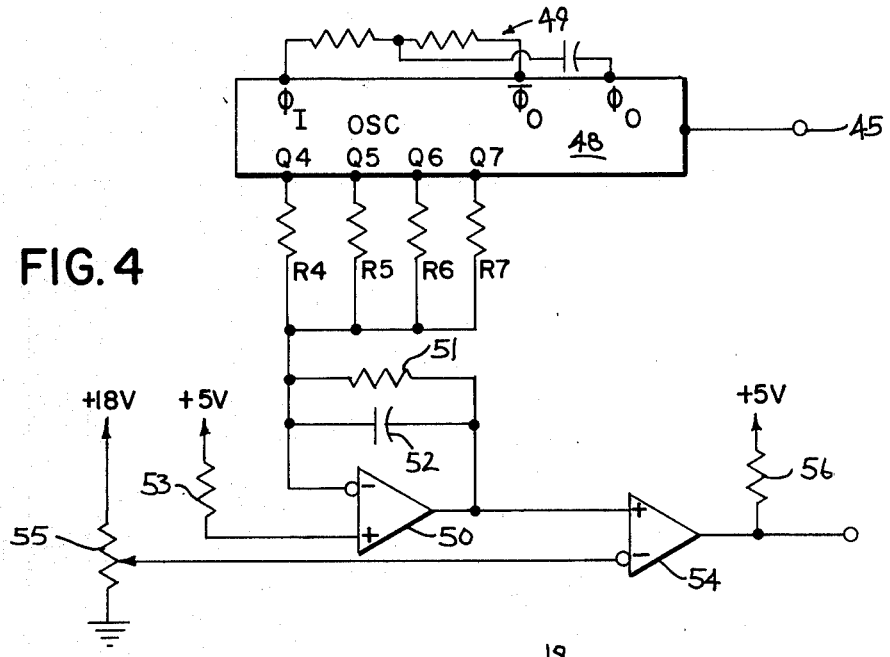

How the pulse width converter circuit 46 senses variations in supply voltage is best explained in view of FIG. 4, where the output from the inverter 45 is received at an input on an oscillator-counter 48. An R-C coupling circuit 49 is connected to inputs $\phi_0$, $\phi_0$ and $\phi_1$ of the counter 48 to select the frequency of the count. Outputs Q4-Q7 are connected to a summing integrator circuit, and specifically to resistors R4-R7, which are connected in parallel to an inverting input on an operational amplifier 50. A resistor 51 and a capacitor 52 are connected in parallel between the inverting input and the output of this operational amplifier 50 to provide an integrator, while the noninverting input is pulled high through a resistor 53 to a +5 volt voltage supply. As the oscillator 48 counts up from zero, the output signal from the integrating operational amplifier 50 is positive and is coupled to a noninverting input on a voltage cmparator 54. A +18 volt supply voltage that is stepped down from the a-c supply line is impressed across a voltage divider 55 to be sampled at an inverting input on the voltage comparator 54. Normally the voltage at the noninverting input is more positive than the voltage at the inverting input. The output of the comparator 54 is pulled high through a pull-up resistor 56 with a high signal being coupled through the AND gate 47 in FIG. 3 to the reset input on the print one-shot multivibrator 44. If the power supply voltage rises a predetermined amount above the rated supply voltage the signal at the noninverting input of the comparator 54 will exceed the signal at the inverting input to couple a logic low signal from the output of the comparator 54 to the AND gate 47. This couples a logic low pulse to the reset input on the print one-shot multivibrator 44, resetting the multivibrator 44 before it has timed out to control the width of the pulse applied to the dots in the print head 24.

Besides controlling the print head 24, the microcomputer 26 also controls the paper advance mechanism. The roll of record-keeping tape 23 is mounted on a platen (not shown) that is driven by a stepper motor 57 seen in FIG. 3. The stepper motor 57 is a two phase, bipolar device with positive and negative poles for each phase. Lines P5-6 and P5-7 on the microcomputer 26 are coupled to four inputs on the stepper motor to select one of the four possible poles. When the next pole in a rotational sequence is selected, a rotor in the stepper motor advances 90° which is equivalent to advancing one row of dots on the record-keeping tape 23. Since there are seven rows of dots in each character and two rows of dots that are skipped between rows of characters, the stepper motor 57 must be advanced nine 90° increments to skip a row or line of characters, and fifty-nine 90° increments to skip 6.55 character lines after printing a total amount. To select the poles on the stepper motor 57, output P5-6 on the microcomputer is coupled through two inverters 58 and 59 in parallel, one of the inverters 58 also having a line driver 60 in series with it, and then through a capacitor 63 to a third input on the stepper motor 57. The second and fourth inputs are connected to a +21 volt supply voltage. Output P5-7 on the microcomputer 26 is coupled through two parallel branches to the first on the stepper motor 57, one of these branches including an inverter 64 and the other branch including an inverter 65 and a line driver 66. These branches are connected through an a-c coupling circuit with a resistor 67 and a capacitor 68 to a fourth input on the stepper motor 57. With these connections the logic signals at outputs P5-6 and P5-7 can control the incremental movement of the stepper motor 57.

Figure 5:
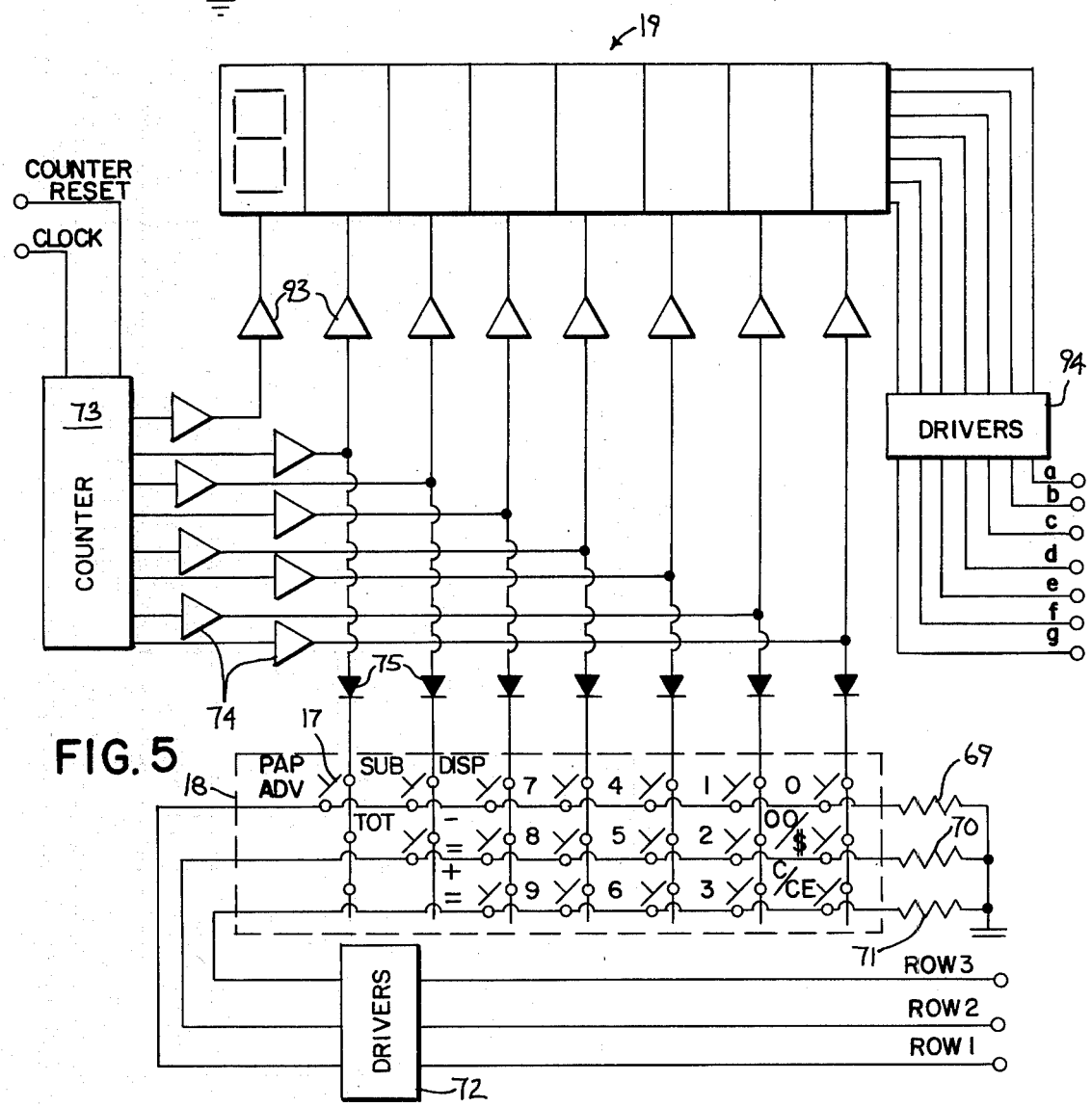

To control coin dispensing and printing operations, the microcomputer 26 reads input data from the keyboard 18 and through the cable 20 connected to the remote interface connectors 21. As seen in FIG. 5, the keys 17 of the key-board 18 are switches arranged in a matrix of rows and columns. When the keys in each row are operated, electrical connection is made between a line for the column and a line for the particular row in which the key 17 is located. The lines for rows 1-3 are connected through pull-down resistors 69-71 to a signal ground and are also connected through a set of drivers 72 to inputs P1-0, P1-1 and P1-2 on the microcomputer. When all the switches 17 in a particular row are open a logic low signal is coupled to the input for the respective row in FIG. 3. When one of the key switches 17 is closed, the voltage drop across the pull-down resistors 69–71 provides a logic high signal on the line for the respective row.

The columns of the keyboard 18 are sequentially scanned by a counter 73 with eight outputs connected through drivers 74 to the eight column lines in the keyboard matrix. Each column line is also connected through a second driver 93 to one of the digits in the alphanumeric display 19 so that the counter 73 is also used to sequentially enable the digits of the display 19 to receive updated information. The output of each driver 74 is connected through a diode 75 in its respective column line, so that drivers 74 and 93 are protected against a short circuit condition in the event that two keys 17 in the same row are depressed. Data is coupled to an enabled digit in the display 19 through segment lines a-g, which connect through a set of drivers 94 to outputs P4-0 through P4-6, respectively, on the microcomputer 26 in FIG. 3. Each line a-g carries a bit of data that determines one segment of each seven-segment display digit.

Referring to FIGS. 3 and 5 the counter 73 is driven and incremented through a CLOCK line originating in FIG. 3. The STROBE output on the microcomputer 26 is coupled through a low true NAND gate 76 to one input of another NAND gate 77, which couples the STROBE line and a line from the P4-7 output on the microcomputer 26 to the CLOCK line. As seen in FIG. 3, the MASTER RESET line and the output P0-1 on the microcomputer 26 are coupled through a low true NAND gate 78 to a COUNTER RESET line for resetting the counter 73 in FIG. 5.

Figure 6:
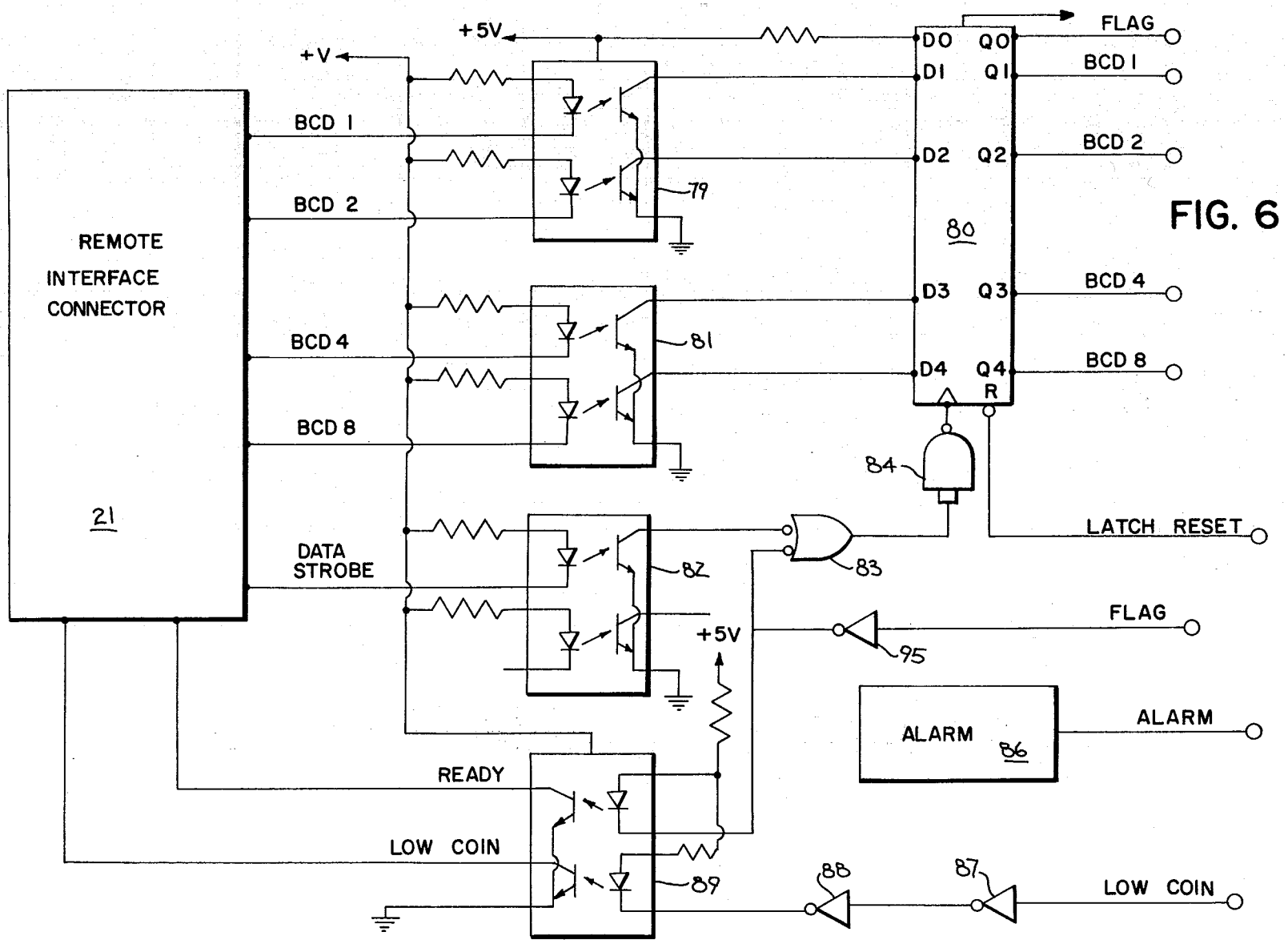

Remote interface data is received through a remote interface circuit seen in FIG. 6, and in particular through one of the remote interface connectors 21 mounted on the coin dispenser 10. Binary-coded decimal data is received over four lines from a transmitting device, such as an electronic register, and a strobe signal is received on a fifth line. A BCD1 and BCD2 line in the transmission cable 20 are connected through the remote interface connector 21 and a dual optical isolating circuit 79 to the D1 and D2 inputs on a 6-bit latch 80. Similarly, the BCD4 and BCD8 lines in the transmission cable 20 are coupled through a second dual optical isolating circuit 81 to the D3 and D4 inputs on the latch 80. A DATA STROBE line in the transmission cable 20 is connected through one side of a third dual optical isolating circuit 82 and through a series of two NAND gates 83 and 84 to a clock input on the latch. BCD digits 1, 2, 4 and 8 are coupled from the Q1-Q4 outputs of the latch to the P1-4 through P1-7 inputs on the microcomputer 26 in FIG. 3.

Referring again to FIG. 6, when the power is turned on, a ready condition is signalled to a remote transmitting device, such as an electronic cash register, and the NAND gate 83 is enabled so that data on the BCD1, BCD2, BCD4 and BCD8 lines can be clocked into inputs D1-D4 of the latch 84. The Q0 output of the latch is coupled through a FLAG line and inverter 95 to a second input on the NAND gate 83. The enabling of this NAND gate 83 is then dependent upon power being applied to the machine 10 which generates an output signal on the FLAG line. The power-up condition sensed on the FLAG line not only enables the receipt of data by the remote interface circuit but it also signals a ready condition to the remote transmitting device through a READY line, to which the FLAG line is coupled through the inverter 95 and through one side of the fourth optical isolating circuit 89. The latch 84 is reset by a signal from the P0-3 output on the microcomputer 26 in FIG. 3, which is connected through a LATCH RESET line to a reset (R) input on the 6-bit latch.

When the coins 15 in any of the channels 14 of the coin magazine 13 are low, a low coin sense circuit 96 of a type well known in the art generates a signal to the P0-0 input on the microcomputer 26, and it also generates a signal through a LOW COIN line, seen in FIG. 6, which is coupled through a pair of inverters 87 and 88 and one side of a dual optical isolating circuit 89 to the remote interface connector 21. Thus a low coin supply condition is signalled to both the microcomputer 26 and any remote transmitting device. The P0-2 output on the microcomputer 26 is connected through an ALARM line to activate an audible alarm which is an operator-observed signal of the low coin condition.

Referring again to FIG. 3, three remaining inputs on the microcomputer 26, P0-4, P0-5 and P0-6 are connected to pairs of contacts 92 to sense various optional operating modes. One contact 92 in each pair is connected to ground and the other contact, which is connected to an input on the microcomputer 26, is also connected to a voltage source through a pull-up resistor 99. Thus when the contacts 92 are open, the input remains at a logic high signal and the option is not selected, and when the contacts 92 are closed, the line is switched to a logic low signal to select the option.

One option available with the coin dispenser 10 is a coin magazine (not the one seen in FIG. 1) with three 25-cent coin channels. The contacts 92 connected to the P0-4 input are closed when such a coin magazine is used as part of the coin dispenser 20, and the contacts 92 are left open when the dollar coin magazine 13 seen in FIG. 1 is used. The setting of the contacts 92 that are connected to the P0-5 input determines the maximum amount to be dispensed—either $.99 or $4.99. The resident firmware in the microcomputer provides for the automatic dispensing of coins from the displayed total when the DISPENSE key is operated after the TOTAL key. Where the total that is calculated and displayed exceeds the selected limit, only the limit is dispensed, and any overage is displayed in the left-most digits of the display.

The effect of combining the $.99 limit with either the triple quarter or dollar coin magazine 13, is the dispensing of the cents portion of each total amount and the display of the dollars portion in the left-most digits of the display 19. The firmware restricts the use of the $4.99 limit to the dollar coin magazine 13. Another option provides for the automatic advance of the tape 23 on each total operation. When the contacts 92 connected to the P0-6 are open, the tape 23 will be advanced 6.55 character lines after each total is printed. These options to the automatic operation of the coin dispenser 10 are preset at the manufacturing facility according to customer order.

The description thus far has referred to a number of circuit elements which are embodied in commercially available circuit chips. A listing of these components will be found in Appendix D. The operation of the hardware described above is controlled by the firmware instructions stored in the PROM 26*a* on-board the microcomputer 26. A detailed listing of these instructions is provided in Appendix A. A general description of this operation will be given with reference to flow charts in FIGS. 7–13 of the drawings. The flow charts are intended to cover only the significant points concerning operation, while the details have been left in the program listing for examination by those skilled in the art.

Figure 7:
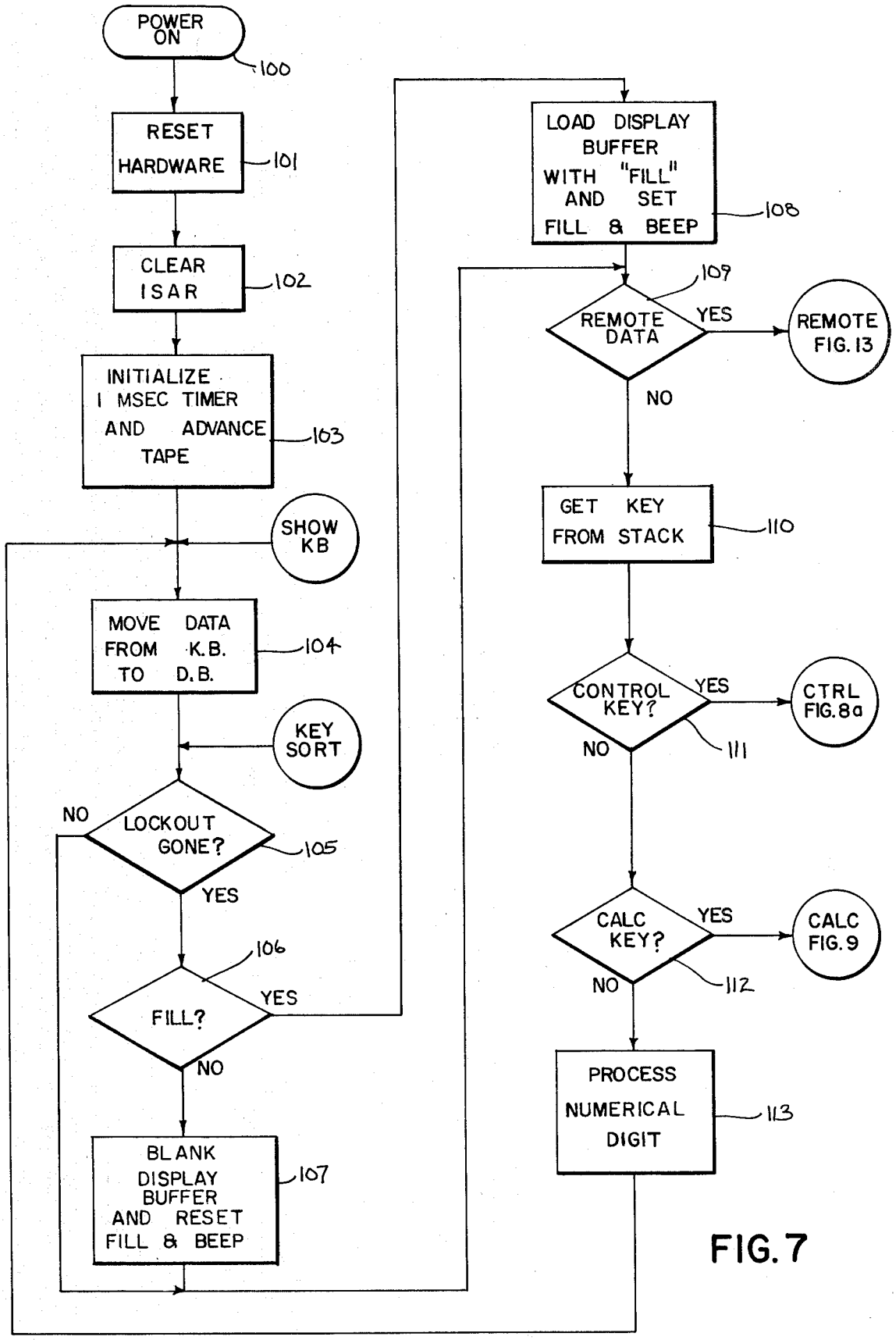
FIG. 7 is a flow chart of a start-up and key processing routine for the coin dispenser of FIG. 1.

Referring to FIGS. 1 and 7, the operation begins with the setting of the power switch 9 in FIG. 1 to the ON position, which is represented by the starting block 100 in FIG. 7. The microcomputer 26 then executes a set of instructions to reset hardware such as the shift registers 37 and 38 in FIG. 3, and the remote latch 80 in FIG. 6, as represented by process block 101. The Indirect Scratchpad Address Register (ISAR) is then cleared, as represented by process block 102. The 6-bit number stored in the ISAR determines which register in the scratchpad RAM **26*b* is being addressed. The main operating routine of the coin dispenser 10 is interrupted every millisecond so that a SERVICE routine seen in FIGS. 10*a* and 10*b* can be performed. As represented in FIG. 7 by process block 102, an internal timer is initialized to time the one millisecond cycle to the next interrupt, and as shown by process blocks 103, a subroutine is called to advance the tape 23 one character line. In the listing of Appendix A an unconditional jump is made to a "START" address, to begin a key processing portion of the main routine. The microcomputer 26** is then ready to begin processing data in the key buffer.

Assuming an interrupt is not being processed, the microcomputer 26 enters a "show key buffer38 (SHOW KB) portion of its main routine, where it executes instructions to transfer data from the key buffer (scratchpad registers R30–R34) to the display buffer (scratchpad registers R20–R27), as represented by process block 104. The microcomputer 26 then enters a KEYSORT portion of the main routine in which entries from the keyboard are sorted and processed. Keyboard entries are initially processed during execution of the SERVICE routine, where they are stored in a key stack formed by R72–R75 (octal) in the scratchpad RAM **26*b* as seen in Appendix C. Before a key code is obtained from the key stack, however, the microcomputer 26 checks several conditions. As represented by decision block 105, several instructions are executed to check for "lockout" of the microcomputer 26 during the recovery cycle following a dispense operation. If the microcomputer 26 is locked out, no remote data is processed, and the microcomputer 26 goes on to check its P0-0 input for a low coin condition in decision block 106. When no low coin condition is detected, the display buffer is cleared and the "fill" and "short keep" flags are reset, as represented in process block 107. When a low coin condition in one or more of the coin channels is signalled from the sensing circuit 96 in FIG. 3, flags are set to activate the beeper alarm 86 during a service routine and the display buffer (R20–R27) is loaded with codes that will cause the display 19 to flash the message "FILL" in its four left-most digits, as represented in process block 108. Where the lockout is gone, or where the fill condition has been checked, the microcomputer 26 then checks for the presence of remote data sent from another device, as seen in decision block 109. If remote data is present the microcomputer 26 jumps to a REMOTE routine to be described below. Assuming no remote data is present, the microcomputer 26 proceeds as represented in process block 110** to get the key code from the first register in the key stack.

Figure 9:
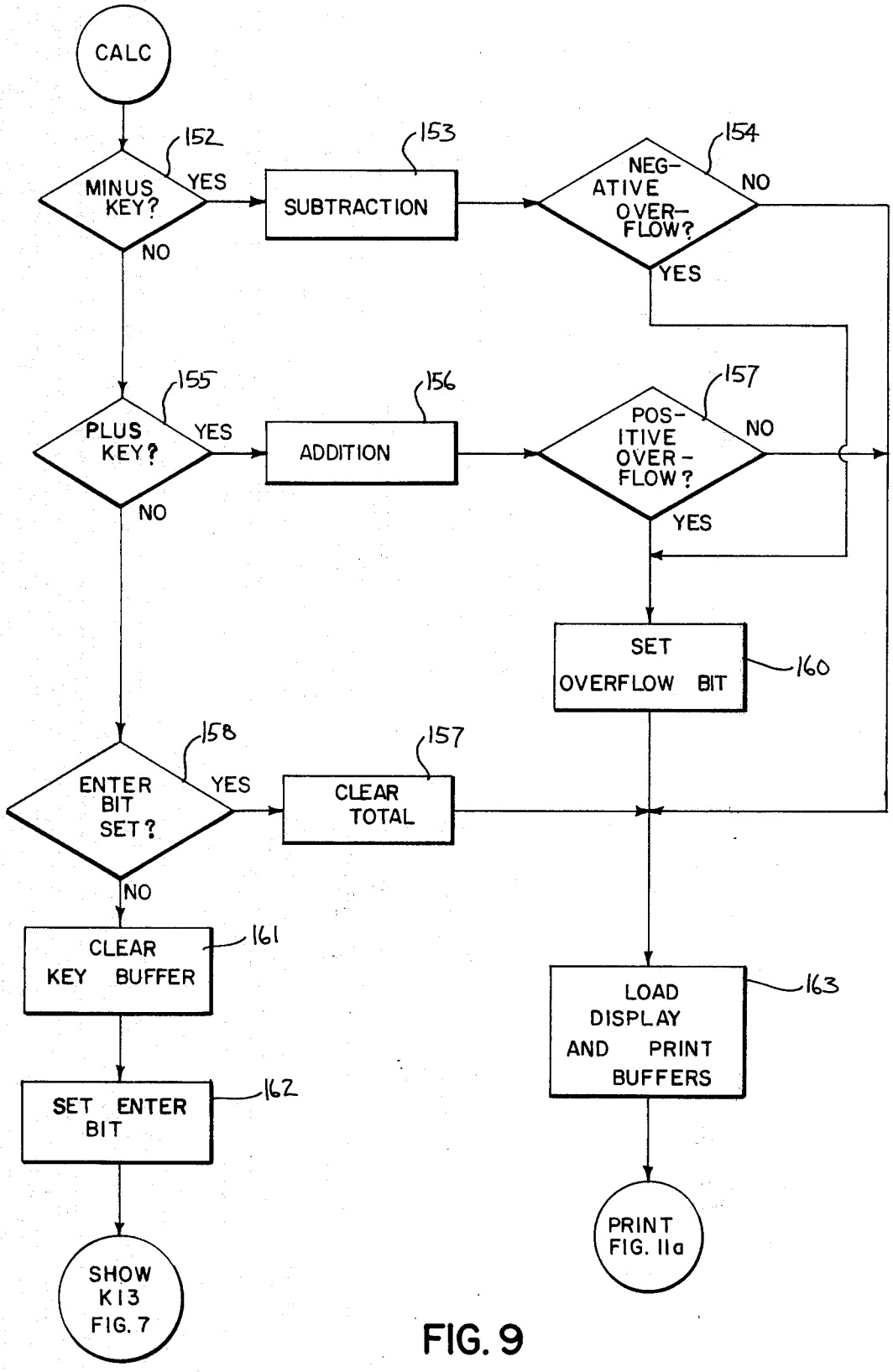

If a key is present in R72, it must first be determined whether the key is a control key, a calculator key or a digit key. The microcomputer 26 first determines whether a code for a control key has been entered as represented by decision block 111. If a control key code is detected the routine branches to a control (CTRL) branch represented in FIG. **8*a*. Otherwise, the microcomputer 26 proceeds to examine whether the code is for a calculator key as seen in decision block 112. If this check is affirmative the microcomputer 26 branches to execute a calculator key (CALC) branch of a KEYSORT routine that is represented in FIG. 9. If the code is for none of the above mentioned key types, then it must be a numerical digit key which is then processed as represented by process block 113. During this block 112 any "00" digit is checked to see if it is the first digit entered, signifying a dollar split operation, and any "0" digit is checked to see if it is the first digit entered, signifying a quarter split change operation. For either of these entries an appropriate flag is saved in R35. The microcomputer 26** then cycles back to the SHOW KB portion of the main routine.

Referring to FIG. **8*a*, the CTRL branch begins as represented by decision block 114 to determine whether the control key is a DISPENSE key. Where the control key is not a DISPENSE key in block 114, it is examined to determine whether it is the PAPER ADVANCE key, as represented by decision block 119. When the PAPER ADVANCE key is entered, the tape 23 is advanced 59 dot lines or 6.55 character lines through the execution of a subroutine, which is represented by process block 120 and listed in Appendix A. If the PAPER ADVANCE key has not been selected, the ENTER bit is checked, as represented by decision block 121, and assuming it is "on," an amount to be shown on the visual display 19 is loaded into the display buffer as represented by process block 122. The ENTER bit is significant because an error made during a numeric entry may be cleared without activating the printer, whereas operation of the C/CE key after the entry of a control key or a calculator key will result in the printing of ".00 T." If the ENTER bit is not "on," then the key cannot be either the SUBTOTAL key or the TOTAL key. In this event, the microcomputer 26 would return to the KEYSORT portion of the main routine in FIG. 7. If the ENTER bit is on, then the data in the total buffer is moved to the display buffer is represented by process block 122, and a check is made for the SUBTOTAL key, as represented by decision block 123. Where the SUBTOTAL key is found, a code for the letter "S" is saved for later entry in the print buffer, and any dispense flag is cleared, as represented by process block 125, since a dispense operation does not follow a subtotal operation as it does for a total operation. The "S" code is entered in the print buffer during the loading operation represented by process block 130 to be printed as a suffix to the subtotal amount. Where a SUBTOTAL key is not found as a result of the decision in block 123, then the key must be a TOTAL key and a code for the letter "T" is saved for later entry in the print buffer. The status of the P0-5 input is then checked, as represented by decision block 127, to determine whether the limit selected for the coin dispenser 10 is $4.99 or $.99. For either result an appropriate flag is saved with the other dispense flags in R35 as represented by process blocks 128 and 129. The sequence continues with the loading of the print buffer, as represented by process block 132, in preparation for execution of the PRINT routine in FIGS. 11***a* and 11*b*.

Where a DISPENSE key is detected in decision block 114 in FIG. 8*a*, the microcomputer 26 checks for a fill condition, for a minus sign in R27, and for a "no dispense" flag in R35, as represented by the blocks 115–118. If any of these conditions is present, the microcomputer 26 returns to the KEYSORT portion of the main routine. Otherwise, it proceeds as seen in FIG. 8*b*, where a REPEAT DISPENSE code in R35 is checked as shown by decision block 131. This flag will be set when dollar coins are repetitively dispensed. Where this code is found, the ENTER bit is set as represented by process block 132 and the microcomputer proceeds to the DISPENSE routine in FIGS. 12*a* and 12*b*. Where a NO REPEAT DISPENSE code is found, the key buffer is cleared as represented by process block 133 and the 25¢ split change flag is checked in R35 as represented by decision block 134. If this flag is not set, then the dollar split change flag is checked as represented by decision block 135. If either of these flags is set, the appropriate amount to be dispensed is loaded into the key buffer as represented in process blocks 136 and 137, respectively. Bit data is then transferred from the key buffer to the display buffer as represented by process block 138, the ENTER bit is set as represented by process block 139 and the microcomputer proceeds to the DISPENSE routine in FIG. 12*a*.

Where none of these special operations is selected, preparation is made to dispense an amount entered in the normal fashion. As represented by process block 140, the first of several limits is examined. Because no more than $4.99 may be dispensed with either coin magazine, any dollar figure over $4.00 is an overage, and this amount is set up in the display buffer to be shown in the left four digits of the visual display 19. Next, as represented by decision block 141, a check is made for the presence of the triple quarter magazine, which has a practical effect of limiting the amount dispensed to 99¢. If the dollar coin magazine is being used with the coin dispenser 10, then the dispense flag for the 99¢ limit is checked as represented in decision block 142. If this code is not present, the dispense limit is $4.99, and the fourth digit of the display buffer is blanked, as represented in process block 143. The right three digits of the display 19 will be used to show an amount dispensed, while the left four digits of the display will be used to show any overage that is keyed in but not dispensed. As represented in decision block 144, the dollar digit is tested to see whether it is a number less than five. Where the dollar digit is five or more, a "5" is placed in the unit digit of the overage number and a remainder will occupy the dollar digit of the amount to be dispensed as represented in process block 145. Where the triple quarter magazine is present or the dispense 99¢ flag is found, the one dollar and ten dollar digits for the amount to be dispensed are cleared from the display buffer as represented in process block 146. After the preparations made in blocks 143–145, or the alternate step provided in process block 146, the microcomputer sets the ENTER bit as represented in process block 151 and proceeds to the DISPENSE routine in FIG. 12*a*.

When the limit on the amount to be dispensed is $4.99 and a dollar digit is found to be less than five in decision block 134, a third sequence is executed before proceeding to the DISPENSE routine. The dollar digit is compared to zero. If the dollar digit is greater than zero but less than five the zero is entered in the units digit of the overage amount to be displayed as represented in process block 148. If the dollar digit is found to be zero, it must be determined whether it is part of a dollar figure in the tens, hundreds or thousands, as represented in decision block 149. If the zero dollar digit is the first digit in the amount to be dispensed, the units digit of the overage amount is blanked as represented in process block 150, the ENTER bit is set as represented in process block 151 and the microcomputer 26 proceeds to execute the dispense routine in FIG. 12*a*.

FIGS. 8*a* and 8*b* represent the processing of a control key found in the KEYSORT portion of the main routine in FIG. 7. When a calculator key is detected, the microcomputer 26 executes the sequence seen in FIG. 9. As seen in FIG. 9, a calculator key code is first checked to determine whether it is a minus key, as represented by decision block 152. If so, subtraction is performed as represented by process block 153 and, if no negative overflow is detected in the test represented in decision block 154, the result is loaded into the display and print buffers as represented by process block 163. Similarly, if a plus key is found in the check represented by decision block 155, addition is performed as represented by process block 156. If no positive overflow is detected in the test shown by decision block 157, the result is again loaded into the display and print buffers as represented by process block 163. On either subtraction underflow or addition overflow the ERROR bit is set, which will cause the display 19 to flash during the SERVICE interrupt routine.

Figure 11A:
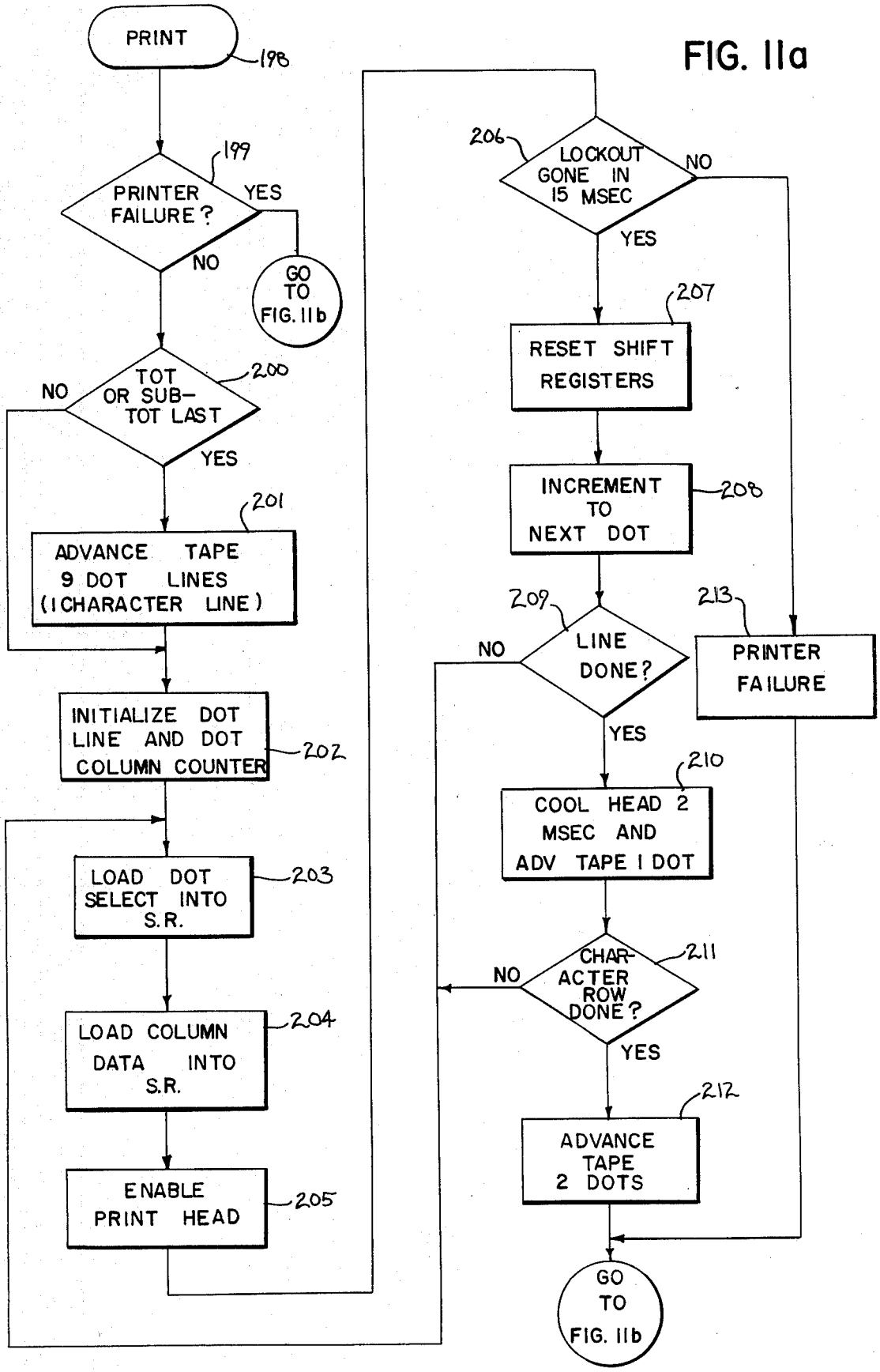
FIGS. 11*a* and 11*b* are flow charts showing a PRINT routine for operating the printer in the coin dispenser of FIG. 1.
Figure 11B:
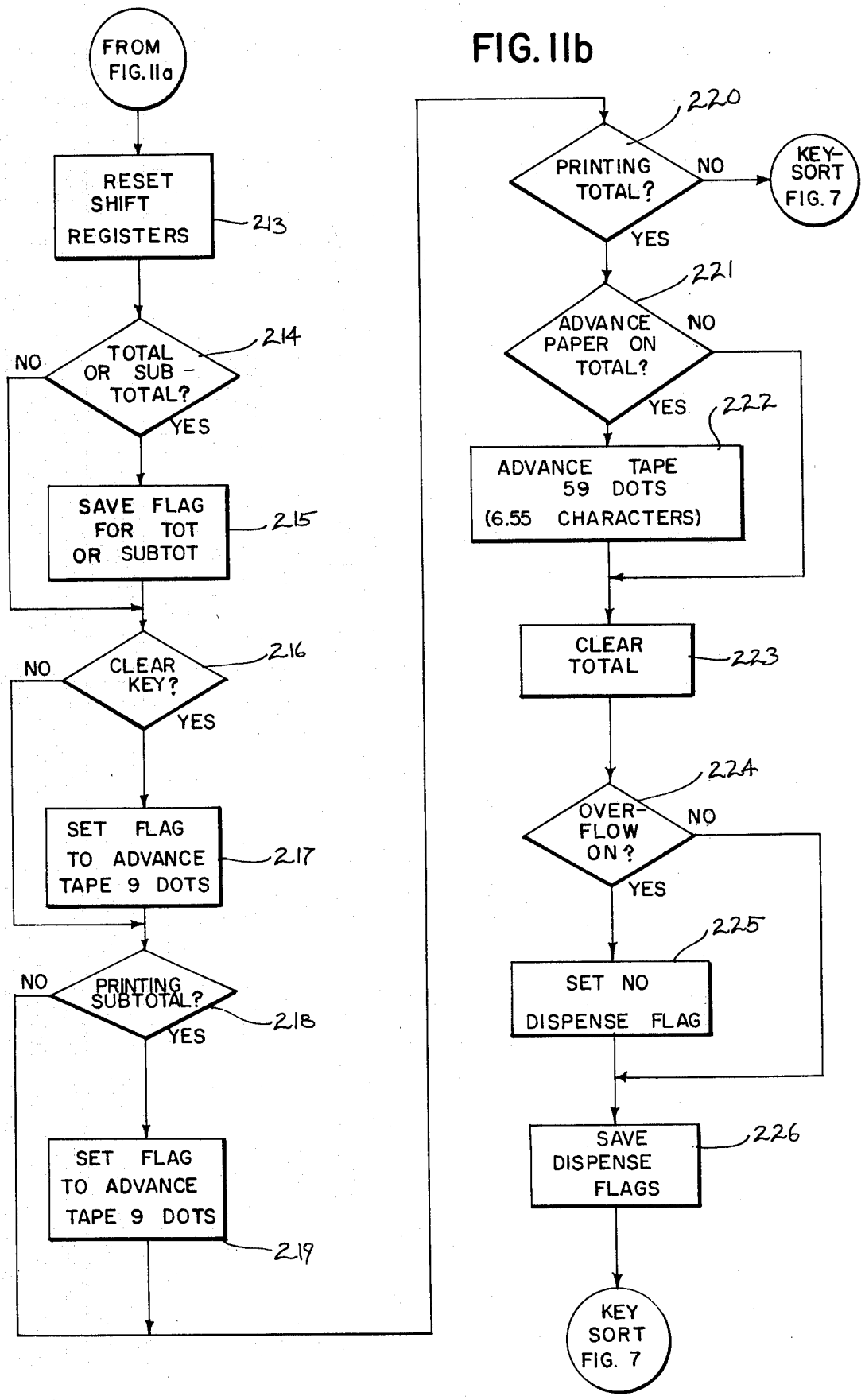

After the display and print buffers are loaded the microcomputer 26 jumps to the PRINT routine in FIGS. 11*a* and 11*b* and prints the amount with a "−" or "+" suffix. If neither a minus key nor a plus key is found, the calculator key must be a clear/clear entry key. Therefore, the ENTER bit is checked as represented in decision block 158. If it is set, a CLEAR TOTAL command has been entered as represented by process block 159 and the display and print buffers are loaded with ".00 T" to be printed during execution of the PRINT routine. If the ENTER bit is not set, the key buffer is cleared, as represented by process block 161, and then the ENTER bit is set as represented by process block 162. The microcomputer 26 then returns to the SHOW KB portion of the main routine in FIG. 7. Each time a numerical digit is processed in block 113 of FIG. 7 the ENTER bit is reset until the next command key is entered.

Figure 10A:
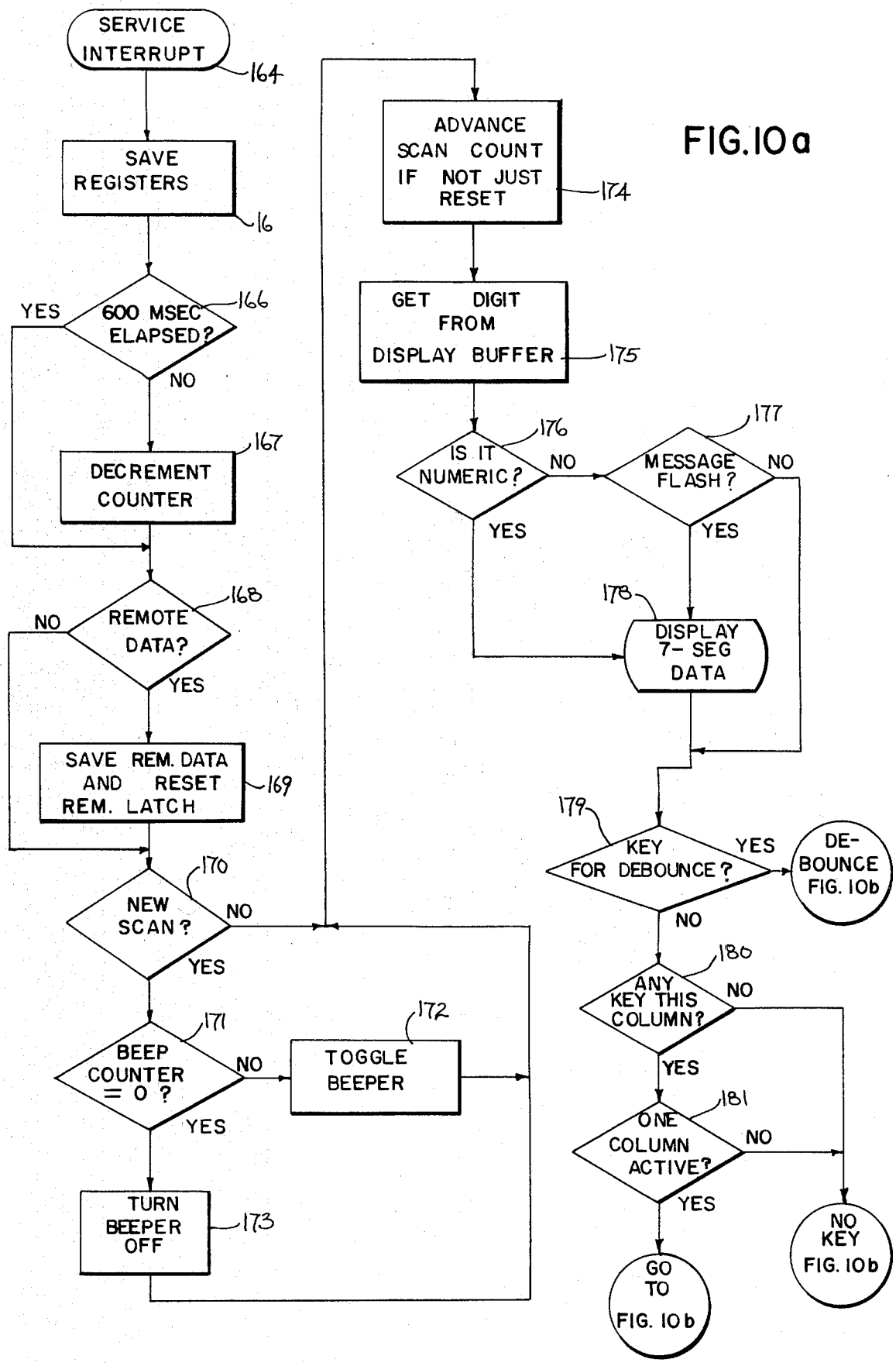
FIGS. 10*a* and 10*b* are flow charts of a SERVICE interrupt routine performed by the coin dispenser of FIG. 1.
Figure 10B:
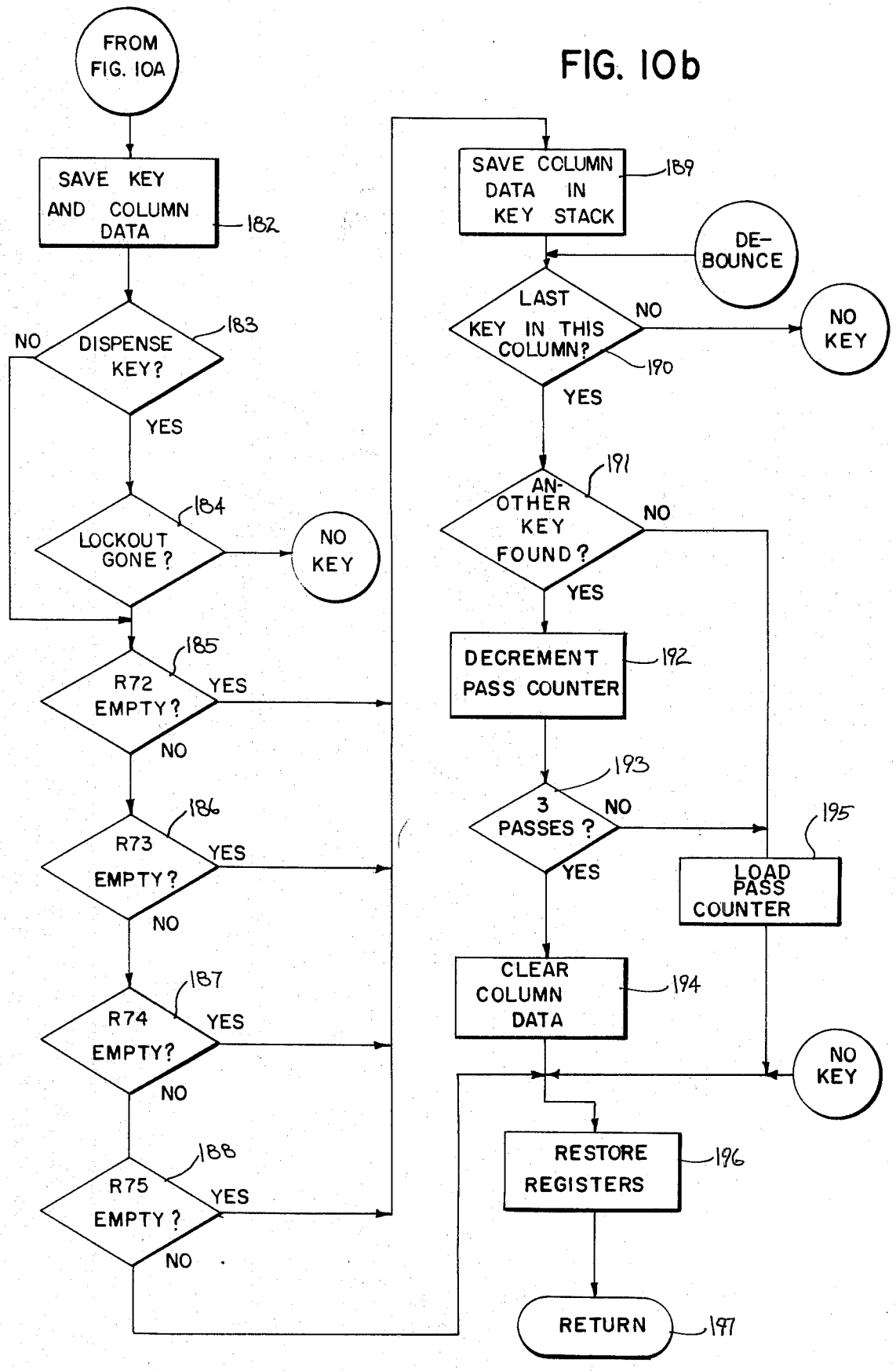

As mentioned above, the main key processing routine in FIGS. 7–9 is interrupted by the SERVICE routine of FIGS. 10*a* and 10*b* every millisecond. Referring to FIG. 10*a*, after the SERVICE interrupt represented by start block 164 the ISAR and the status register are saved, as represented by process block 165. A check is then made, as shown by decision block 166 to determine whether a 600 millisecond interval has elapsed, which allows the coin ejector mechanisms 28 to recover. If not a counter maintained in R36 and R37 of the on-board RAM 26*b* is decremented. After the counter has been decremented (process block 167) a check is made as shown by decision block 168 to see if remote data is available. If available, the remote data is saved and the remote latch 80 is reset as shown by process block 169.

In the next portion of the SERVICE routine the keyboard 18 and the display 19 seen in FIG. 5 are scanned. During each interrupt one key column can be examined and a key transferred to the key buffer formed by registers R72–R75, and one digit in the LED display can be updated. As represented by decision block 170, a scan counter is examined to see whether a new scan of the keyboard 18 and display 19 is to begin. After each full scan a beep counter is checked as shown by decision block 171, and the alarm 86 in the remote interface circuit (FIG. 6) is turned on or off, as shown by process blocks 172 and 173, according to result of the decision in block 143.

During each cycle of the SERVICE routine except one in which the scan counter is reset, the scan counter is advanced as represented by process block 174. The display 19 is turned off before this scan counter is advanced and is turned on after the scan counter is advanced, to prevent ghosting on the display 19. A digit is then obtained from the display buffer as represented by process block 175, and is checked to determine whether it is a numeric digit as shown by decision block 176. Numeric digits are then displayed as represented by display block 178. In displaying alphanumeric characters, the microcomputer 26 gets data from a look-up table to actuate the segments of each digit in the display 14. This look-up table is stored with the firmware in the n-board PROM 26*a*, the look-up table starting at address 0700 (hexidecimal). As seen in Appendix B, the look-up table contains look-up data for actuating the printer and coin dispensing mechanisms as well. Non-numeric digits are part of a message. Messages are flashed on the visual display 19 by displaying them in one scan and blanking the message display digits in the next scan. As represented in decision block 177, a determination is made whether a message digit is to be displayed or blanked in the current scan. When the digit is blanked, the look-up and display operation is skipped.

After any available data in the display buffer is displayed, the keyboard is scanned as shown by decision block 179. Any key signals are checked for three successive passes to ensure that they are not generated from contact bounce. Then the contents of register R77 are examined to see if any key 17 is present for "debouncing" as represented by decision block 179. If not, row data is coupled through inputs P1-0 to P1-2 on the microcomputer 26 to determine if any key 17 is present in the column of the keyboard being examined. This decision is represented by decision block 180. A check is then made, as shown by decision block 181, to make sure that only one column is active, so that no ambiguous inputs will be processed. If no key is found, or if two columns generate signals, the microcomputer 26 jumps to NO KEY set of instructions represented in FIG. 10*b* by process block 196, where the ISAR, the accumulator and the status registers are stored.

Still referring to FIG. 10*b*, if a key 17 is found in the column being examined and debouncing is not required, the key and column data is saved, as represented by process block 182, for entry into the key stack. No dispense keys are processed during lockout, so the key is examined and lockout is tested as represented in decision blocks 183 and 184. The registers R72–R75 in the key stack are examined in decision blocks 185–188 to find an empty register to save the key and column data. When an empty register is found the data is saved in that register as represented by process block 189. If the key stack is full the micrcomputer 26 branches to restore the registers in process block 196 and returns from the service routine in terminal block 197.

When a key has been saved in a key stack, it must be checked to see that it is not the result of contact bounce. The key data is examined to see if the key in the stack came from the column currently being scanned, and this decision is represented by decision block 190. If the last key came from another column, the routine is exited via process block 196. Otherwise, the key in the current column is checked again as represented in decision block 191. If the key is found again the pass counter is decremented as shown by process block 192 and when three passes have been made the key data is cleared from R77, as represented by block 194 and the status registers are again restored in process block 196. On the next scan through the SERVICE routine the key data will be entered into the key stack. If another key is not found in decision block 191, it is the first scan of the column and the pass counter is loaded as shown by process block 195. The routine is again exited through blocks 196 and 197. Each key must be found during three scans of the eight columns of the keyboard 18 which requires a 24 millisecond period. Contact bounces of shorter duration are not entered into the key stack.

Referring to FIG. 11*a*, when the PRINT routine is entered from FIGS. 8*a* or 9, as represented by start block 198, a check must be made for past printer failures as represented by decision block 199. Where the printer has failed, the portion of the routine shown in FIG. 11*b* is executed. Providing there have been no failures, a check is made as shown by decision block 200 to determine whether the last entry was a TOTAL or SUBTOTAL entry. On these entries the tape 23 is advanced nine dot lines or one character line as represented by process block 201.

Each character that is printed on the tape 23 is really a matrix of dots having seven dot lines and five dot columns. The printer prints or skips a dot in one of thirty-five dot positions for each of the eleven active digit positions across the tape. Therefore, it is necessary to set up a dot column counter and a dot line counter as represented in process block 202 to keep track of which dot position in the matrix is being printed. In addition, data is set up to represent the eleven respective digits in the print head. A dot is selected as shown by process block 203 and the data in the print buffer is used to get data from the look-up table in Appendix B. This look-up data is used in determining whether a dot is to be printed for the currently indexed dot position in a respective digit position. Character data is checked for each of the eleven active columns and data is set up in the shift registers to enable the digits in which a dot is to be printed, as represented in process block 204. The print head 24 is then enabled as represented by process block 205. The print head 24 should not be enabled for longer than 15 milliseconds and a check is made as shown by decision block 206 to confirm the absence of a printer lockout signal. The continued presence of the lockout signals a printer failure as represented by process block 213, and when this occurs the remaining blocks in FIG. 11*a* are skipped and the routine continues through the blocks in FIG. 11*b*. Assuming the lockout is gone in 15 milliseconds, the shift registers are reset as shown by process block 207 and the next dot is selected as shown by process block 208. A check is then made to determine whether all five dots in a dot line have been completed as shown by decision block 209. If another dot is to be selected, blocks 203–209 are executed again. After each line of dots has been printed, a delay of two milliseconds is introduced to allow the print head to cool and the tape 23 is advanced one dot line as represented by process block 210. A check of the dot line counter is then made as represented by decision block 211. When a character line has been completed, the tape 23 is advanced two dot lines as represented by process block 179. Otherwise, the dot line counter is advanced one colunn and the microcomputer 26 returns to execute blocks 203–209.

Referring to FIG. 11*b*, after a character line has been printed, or a printer failure has been detected, the shift registers are reset as represented by process block 213. A check is then made as represented by decision block 214 to determine whether the last entry was a TOTAL or SUBTOTAL, and a flag is saved for such entries as represented by process block 215. A check is made for the CLEAR key as shown by decision block 216, and the tape is advanced one character row on a CLEAR key entry as represented by process block 217. If a SUBTOTAL is being printed, as determined during the execution of decision block 218, the tape 23 is advanced one character row as represented by process block 219. The routine continues as shown by decision blocks 220 and 221. Where a TOTAL amount is being printed and the automatic ADVANCE ON TOTAL option has been preselected at the P0-6 input on the microcomputer 26, the tape 23 is advanced 6.55 character lines as represented by process block 222. At the end of this routine the total buffer is cleared as represented by process block 223, and the overflow bit is checked as shown by decision block 224. Where overflow has occurred, a NO DISPENSE flag is set in R35 as represented by process block 225. The other dispense flags are then saved as represented by process block 226 before the microcomputer 26 returns to the KEYSORT portion of the main routine in FIG. 7.

Figure 12A:
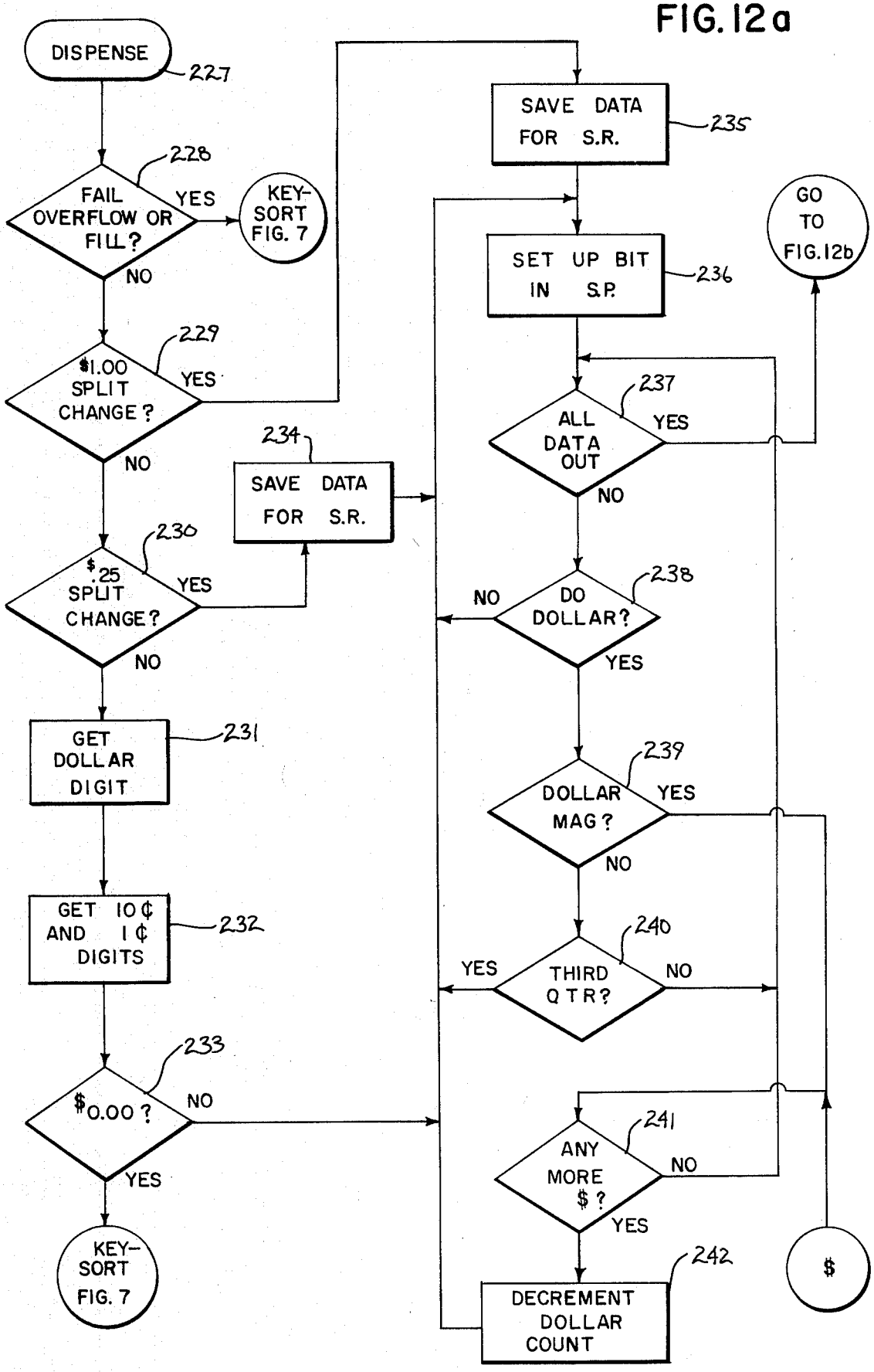
FIGS. 12*a* and 12*b* are flow charts showing a DISPENSE routine during which coins are dispensed from the coin dispenser of FIG. 1.

Referring to FIG. 12*a*, the start of the DISPENSE routine is represented by start block 227. If a failure, overflow or fill condition is detected, as represented by decision block 228, the routine is exited for return to the KEYSORT portion of the main routine. The one dollar split change flag and the 25¢ split change flag are then checked in decision blocks 229 and 230, and if either of these are present appropriate data is saved, as represented in process blocks 234 and 235, to be set up in the shift register as represented in process block 236. Where these split change operations are not to be performed, the one dollar, 10¢ and 1¢ digits in the display buffer are added together and checked to see whether an amount is present to be dispensed. This is represented by blocks 231–233. If there is no amount to be dispensed, the routine is exited to the KEYSORT portion of the main routine in FIG. 7. Where there is an amount present to be dispensed, the first bit is set up in the shift register as represented by process block 236. A check is then made, as shown by decision block 237, to determine whether all of the data for the dispense operation has been set up in the shift register 37. As shown by the next decision block 238, it is determined whether it is time for a dollar bit to be set up in the shift register 37. If not, the routine loops back through process block 236 to set up the next cents digit. When the dollar digit is to be set up, a check is made, as represented by decision block 239, to see whether the dollar magazine is present. In the preferred embodiment, the routine would then continue as shown in decision block 241 to determine whether any more dollars were to be set up in the shift register 37. If the result of this test were positive, the dollar count would be decremented as shown by process block 216 and a dollar digit would be set up in the shift register as represented by process block 236. If another dollar was not necessary, the routine would loop back to decision block 237 to determine whether all data had been set up in the shift register 37. In other embodiments with the third quarter magazine, the microcomputer would check for the third quarter magazine in decision block 240 and loop back to block 236 or 237, depending on whether the third quarter was necessary.

Figure 12B:
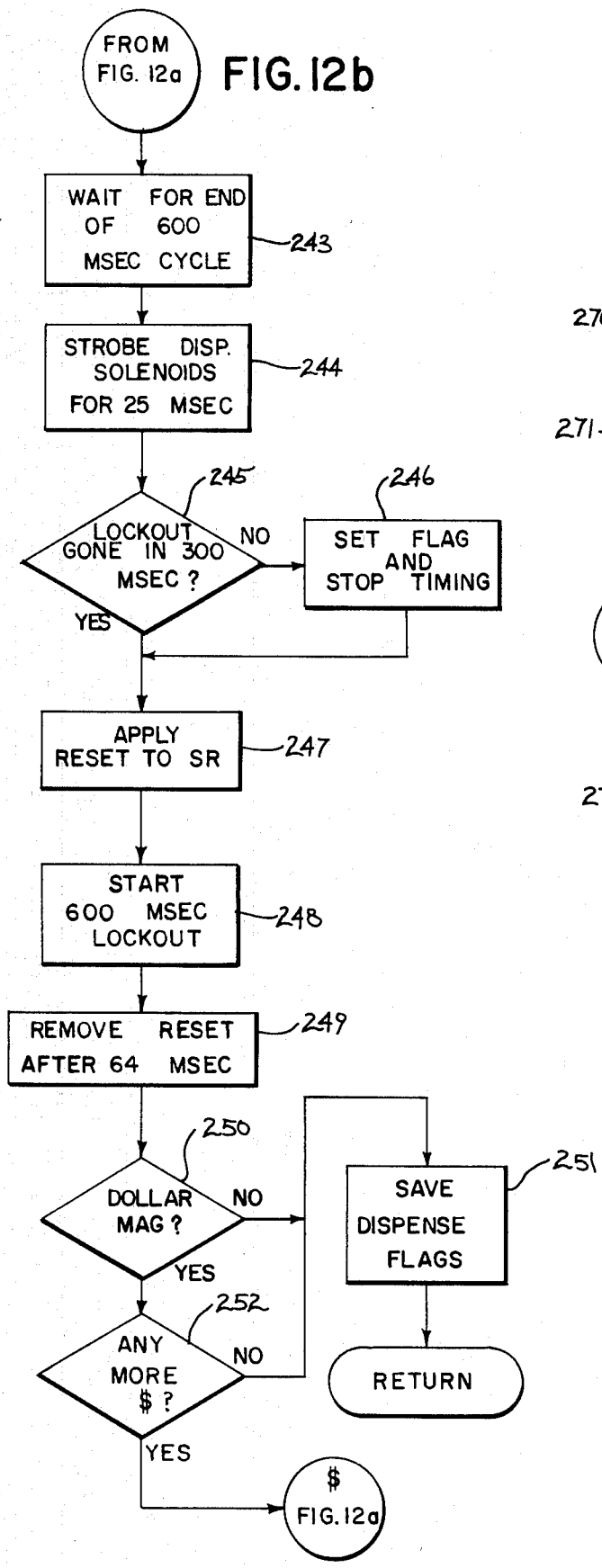

Referring to FIG. 12*b*, when all data has been set up in the shift register 37, the microcomputer 26 waits for the end of the 600 millisecond interval recovery cycle as represented by process block 243, before strobing the lifter solenoids 28*b* for 25 milliseconds as represented by process block 244. The lifter solenoids 28*b* are strobed to move the fingers 28*a* into position in the channels 14 in which coins 15 are to be selected. The payment solenoid 30 is then driven for a period not to exceed 300 milliseconds and this payment cycle is timed by the microcomputer 26 and checked as seen in decision block 245. If the lockout signal at input P0-7 is still present after 300 milliseconds, the payment solenoid has failed, an error flag will be set in the status register R0, and timing cycle will end. A check is also made for a previous printer failure by looking at the printer failure flag in the status register R0. Where a printer failure has preceded the dispense failure, the second failure flag is not set. The actions are represented by process block 246. After the payment cycle has been timed the shift registers are reset as represented by process block 247 and the 600 millisecond interval between payment cycles is initiated as represented by process block 248. The reset signal for the shift registers must be applied for 64 milliseconds and then removed as represented by process block 249. After the registers have been reset, the dollar magazine is sensed as represented by decision block 250 and a check is made to see whether more dollar coins are to be dispensed, as shown by decision block 252. Up to four dollar coin dispense cycles can be executed in this manner. Where no more dollars are to be dispensed, the routine is exited through process block 251 and terminal block 253.

As mentioned above, the coin dispenser 10 of the present invention performs coin dispensing operations and provides a printed record of such operations in response to either keyboard entries or entries received through a transmission cable 20 from a device that directs coin dispensing operations. Referring again to FIG. 7, where remote data is present at the time decision block 109 is executed, the microcomputer 26 branches to the REMOTE routine seen in FIGS. 13*a* and 13*b*. The start of this routine is represented by start block 254. A prompt signal must be detected in the remote buffer (R63–R67 in Appendix C) as represented in decision block 255, otherwise, the remote buffer is cleared as represented by process block 256. If a remote prompt is received, a check is made of register R67 in the remote buffer to determine if remote data has been accepted, and this is represented by decision block 257. A remote prompt must be received during a first scan of the REMOTE routine and remote data is accepted on a subsequent scan through the REMOTE routine. When remote data has been accepted, it is checked first for the dollar split change and quarter split change commands as represented in decision blocks 258 and 260. When these commands are present the appropriate data is entered into the remote buffer as shown by process blocks 259 and 261, respectively. A DISPENSE code found in decision block 262 is saved only after the fill, overflow and no remote data conditions are found to be absent as checked in decision block 263. Where a valid dispense code is present, a dispenser flag is saved with the other dispense flags as shown by process block 264. Where a remote prompt is found in decision block 265, or no "accept data" signal is detected in decision block 257, or an invalid dispense code is found in decision blocks 262 and 263, the microcomputer 26 jumps to a ROUT portion of the REMOTE routine seen in FIG. 13*b*.

Figure 13B:
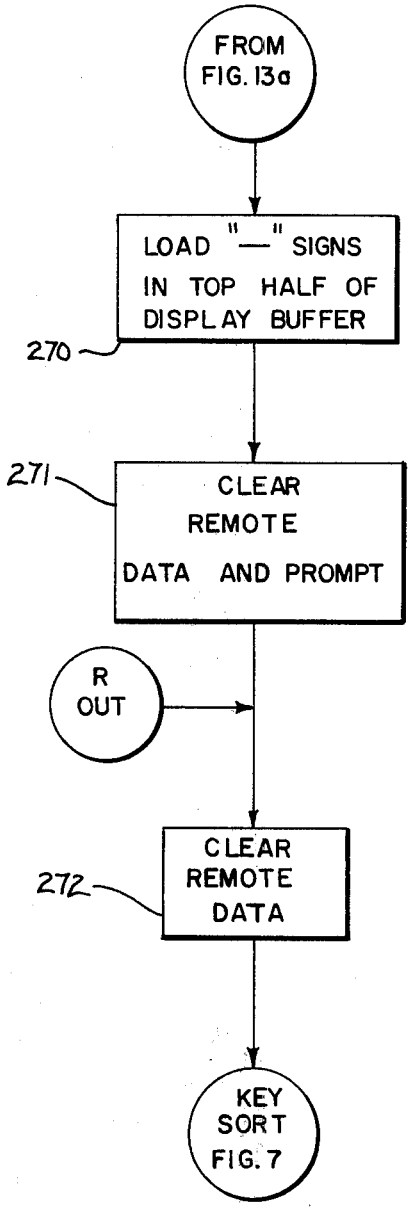
FIGS. 13*a* and 13*b* are flow charts showing a REMOTE routine for processing remote data received by the coin dispenser of FIG. 1.
Figure 13A:
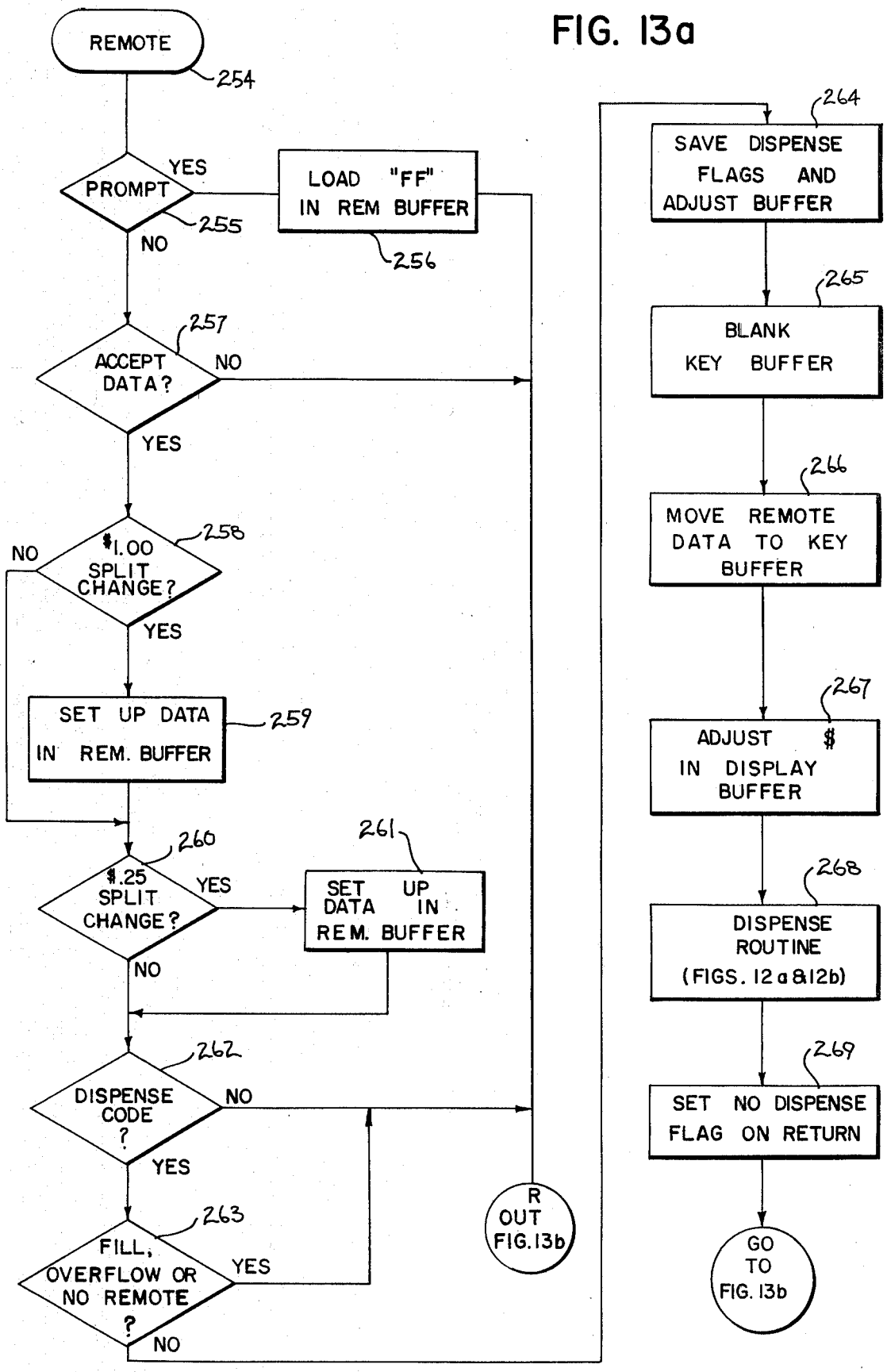

Assuming that a DISPENSE operation is to be carried out, the key buffer is blanked as shown by process block 265 and the remote data is moved to the key buffer as shown by process block 266. Any dollar digit over four is then adjusted as shown by process block 267, and then the DISPENSE routine in FIGS. 12*a* and 12*b* is executed to dispense the amount of currency commanded through the remote interface. Upon return from the DISPENSE routine represented in block 268 a "no dispense" flag is set as represented in process block 269. Referring to FIG. 13*b*, after the proper amount has been dispensed, minus signs ae loaded under the top half of the display buffer so that an amount such as $1.45 would be displayed as "—1.45." The remote data and the remote prompt are then cleared as represented by process block 271. The ROUT portion of the REMOTE routine is then executed to clear remote data, as represented by process block 272, if it has not been done earlier, before returning to the KEYSORT portion of the main routine in FIG. 7.

It should be apparent from the above description that the coin dispenser 10 performs a great many varied operations under the control of digital circuitry mounted on circuit boards which are compact, lightweight and provide an electronic portion of the coin dispenser which has a relatively low cost of manufacture.

APPENDIX A

Resident Firmware Listing

| Loc | Object | Label | Mnemonic | | Comment |
|---|---|---|---|---|---|
| 0000 | 20E7 | . | LI | H'E7' | |
| 0002 | B5 | . | OUTS | 5 | RESET S.R. |
| 0003 | 20E3 | . | LI | H'E3' | |
| 0005 | B5 | . | OUTS | 5 | |
| 0006 | 7A | . | LIS | H'A' | |
| 0007 | B0 | . | OUTS | 0 | RESET REMOTE LATCH |
| 0008 | 70 | . | CLR | | |
| 0009 | B0 | . | OUTS | 0 | AND RESET DISPL SCAN CTR |
| 000A | B1 | . | OUTS | 1 | |
| 000B | 18 | . | COM | | |
| 000C | B4 | . | OUTS | 4 | |
| 000D | 7F | . | LIS | H'F' | DON'T CLEAR R 11 |
| 000E | 0B | . | LR | IS,A | ISAR = 0 |
| 000F | 70 | CLRISAR | CLR | | |
| 0010 | 5C | . | LR | S,A | |
| 0011 | 0A | . | LR | A,IS | |
| 0012 | 1F | . | INC | | |
| 0013 | 0B | . | LR | IS,A | |
| 0014 | 2540 | . | CI | 0'100' | DONE CLEAR? |
| 0016 | 94F8 000F | . | BNZ | CLRISAR | |
| 0018 | 74 | . | LIS | 4 | |
| 0019 | 50 | . | LR | 0,A | INITIAL STATUS |
| 001A | 77 | . | LIS | 7 | |
| 001B | 06 | . | LR | QU,A | LOOK UP HI ADDR |
| 001C | 66 | . | LISU | 6 | |
| 001D | 2900F4 00F4 | . | JMP | START | |
| . | . | . | ORG | H'0020' | INTERRUPT VECTOR |
| 0020 | 57 | SERVICE | LR | 7,A | SAVE ACC |
| 0021 | 0A | . | LR | A,IS | |
| 0022 | 58 | . | LR | 8,A | SAVE ISAR |
| 0023 | 1E | . | LR | J,W | SAVE STATUS |
| 0024 | 20FF | . | LI | H'FF' | |
| 0026 | B4 | . | OUTS | 4 | CLR DISPLAY DATA |
| 0027 | 70 | . | CLR | | |
| 0028 | B1 | . | OUTS | 1 | CLEAR PORT 1 |
| 0029 | 63 | . | LISU | 3 | |
| 002A | 6E | . | LISL | 6 | CHECK 580 MSEC TIME OUT |
| 002B | CD | . | AS | I | GET R 36 |
| 002C | 9404 0031 | . | BNZ | DEC | R 36 NOT ZERO |
| 002E | CC | . | AS | S | GET R37 |
| 002F | 8409 0039 | . | BZ | DONDEC | BOTH ARE ZERO |
| 0031 | 3C | DEC | DS | S | DEC R 37 |
| 0032 | 9406 0039 | . | BNZ | DONDEC | |
| 0034 | 4E | . | LR | A,D | GET R 37 |
| 0035 | CC | . | AS | S | BOTH ZERO NOW? |
| 0036 | 8402 0039 | . | BZ | DONDEC | NO |
| 0038 | 3C | . | DS | S | DEC R36 |
| 0039 | 66 | DONDEC | LISU | 6 | |
| 003A | 6E | . | LISL | 6 | |
| 003B | 4C | | LR | A,S | GET R 66 |
| 003C | 1F | . | INC | | HAS LAST REMOTE |

APPENDIX A-continued

Resident Firmware Listing

| Loc | Object | Label | Mnemonic | | Comment |
|---|---|---|---|---|---|
| 003D | 9410 004E | . | BNZ | NORDATA | DATA BEEN PROCESSED |
| 003F | A1 | . | INS | 1 | YES |
| 0040 | 15 | . | SL | 4 | REMOTE DATA AVAIL? |
| 0041 | 910C 004E | . | BM | NORDATA | |
| 0043 | A1 | . | INS | 1 | GET REMOTE DATA |
| 0044 | 5C | . | LR | S,A | SAVE REMOTE DATA |
| 0045 | A0 | . | INS | 0 | |
| 0046 | 210E | . | NI | H'OE' | MASK INPUT LINES |
| 0048 | 2208 | . | OI | H'08' | RESET REMOTE LATCH |
| 004A | B0 | . | OUTS | 0 | |
| 004B | 2308 | . | XI | H'08' | |
| 004D | B0 | . | OUTS | 0 | |
| 004E | 3B | NORDATA | DS | 11 | SCAN VALUE |
| 004F | 9429 0079 | . | BNZ | NXTCNT | |
| 0051 | 78 | . | LIS | 8 | |
| 0052 | 5B | . | LR | 11,A | SAVE SCAN CNT |
| 0053 | A0 | . | INS | 0 | |
| 0054 | 210E | . | NI | H'0E' | MASK INPUT LINES |
| 0056 | 2202 | . | OI | H'02' | RESET SCAN CTR |
| 0058 | B0 | . | OUTS | 0 | |
| 0059 | 21FD | . | NI | H'FD' | |
| 005B | B0 | . | OUTS | 0 | |
| 005C | 3A | . | DS | 10 | BLINK CNTR |
| 005D | 70 | . | CLR | | |
| 005E | CA | . | AS | 10 | GET CTR |
| 005F | 9406 0066 | . | BNZ | NOT5SEC | NOT DONE WITH BEEP |
| 0061 | 40 | . | LR | A,0 | |
| 0062 | 21FE | . | NI | H'FE' | TURN OFF SHORT BEEP LINE |
| 0064 | 50 | . | LR | 0,A | |
| 0065 | 4A | . | LR | A,10 | |
| 0066 | 211F | NOT5SEC | NI | H'1F' | |
| 0068 | 9410 0079 | . | BNZ | NXTCNT | NOT TIME FOR TOGGLE |
| 006A | 71 | . | LIS | 1 | SHORT BEEP BIT ON? |
| 006B | FO | . | NS | 0 | |
| 006C | 8408 0075 | . | BZ | OFF | TURN BEEPER OFF |
| 006E | AO | ON | INS | 0 | |
| 006F | 210E | . | NI | H'OE' | MASK INPUT BITS |
| 0071 | 2304 | . | XI | H'04' | TOGGLE BEEPER |
| 0073 | 9004 0078 | . | BR | DOUT | |
| 0075 | AO | OFF | INS | 0 | |
| 0076 | 210A | . | NI | H'0A' | BEEPER OFF |
| 0078 | BO | DOUT | OUTS | 0 | |
| 0079 | 78 | NXTCNT | LIS | H'8' | GET SCAN VALUE |
| 007A | EB | . | XS | 11 | JUST RESET? |
| 007B | 8404 0080 | . | BZ | NOADV | YES = DON'T ADV CTR |
| 007D | 207F | . | LI | H'7F' | BLNK DATA & ADV CTR |
| 007F | B4 | . | OUTS | 4 | |
| 0080 | 4B | NOADV | LR | A,11 | GET SCAN COUNT |
| 0081 | 240F | . | AI | O'17' | ADJ TO DIGIT LOC |
| 0083 | 0B | . | LR | IS,A | |
| 0084 | 4C | . | LR | A,S | GET DIGIT |
| 0085 | 250B | . | CI | H'0B' | DIGIT? |
| 0087 | 8109 0091 | . | BP | DATA | YES |
| 0089 | 4A | . | LR | A,10 | MUST BE MESSAGE |
| 008A | 13 | . | SL | 1 | |
| 008B | 13 | . | SL | 1 | |
| 008C | 13 | . | SL | 1 | |
| 008D | 4C | . | LR | A,S | DATA |
| 008E | 8102 0091 | . | BP | DATA | HALF TIME DISP DATA |
| 0090 | 7A | . | LIS | H'A' | OTHER ½ = BLANK |
| 0091 | 15 | DATA | SL | 4 | |
| 0092 | 220F | | OI | H'OF' | ADJ TO DATA LOC |
| 0094 | 07 | . | LR | QL, A | |
| 0095 | 0F | . | LR | DC, Q | |
| 0096 | 16 | GETD | LM | | GET 7 SEG DATA |
| 0097 | B4 | . | OUTS | 4 | DATA & INC DISP CTR |
| 0098 | 67 | . | LISU | 7 | |
| 0099 | 6F | . | LISL | 7 | |
| 009A | 70 | . | CLR | | |

APPENDIX A-continued

Resident Firmware Listing

| Loc | Object | Label | Mnemonic | | Comment |
|---|---|---|---|---|---|
| 009B | CE | . | AS | D | ANY KEY TO DEBNCE? |
| 009C | 9440 00DD | . | BNZ | DEBOUNCE | YES |
| 009E | A1 | . | INS | 1 | |
| 009F | 18 | . | COM | | |
| 00A0 | 2107 | . | NI | H'07' | ANY KEY THIS COL |
| 00A2 | 56 | . | LR | 6,A | |
| 00A3 | 2501 | . | CI | H'01' | ONLY ONE LINE CAN BE ACTIVE |
| 00A5 | 8409 00AF | . | BZ | KEYFND | |
| 00A7 | 2502 | . | CI | H'02' | MORE THAN 1 LINE |
| 00A9 | 8405 00AF | . | BZ | KEYFND | IS NO KEY CONDITION |
| 00AB | 2504 | . | CI | H'04' | |
| 00AD | 9440 00EE | . | BNZ | NOKEY | |
| 00AF | 73 | KEYFND | LIS | H'3' | DEBOUNCE 3 TIMES |
| 00B0 | 5D | . | LR | I,A | SVE DEBNCE CTR(R76) |
| 00B1 | 77 | . | LIS | 7 | |
| 00B2 | FB | . | NS | 11 | |
| 00B3 | 5C | . | LR | S,A | SVE COL DATA OF KEY |
| 00B4 | 46 | . | LR | A,6 | |
| 00B5 | 15 | . | SL | 4 | |
| 00B6 | 12 | . | SR | 1 | |
| 00B7 | CB | . | AS | 11 | INSERT COL DATA |
| 00B8 | 56 | . | LR | 6,A | SAVE KEY DATA |
| 00B9 | 250D | . | CI | H'OD' | DISPENSE KEY? |
| 00BB | 940B 00C7 | . | BNZ | KEYOK | NO |
| 00BD | 63 | . | LISU | 3 | |
| 00BE | 6E | . | LISL | 6 | |
| 00BF | 70 | . | CLR | | |
| 00C0 | CD | . | AS | I | R 36 = 0? |
| 00C1 | 942C 00EE | . | BNZ | NOKEY | NO |
| 00C3 | CC | . | AS | S | R 37 = 0? |
| 00C4 | 9429 00EE | . | BNZ | NOKEY | NO |
| 00C6 | 67 | . | LISU | 7 | LOCK OUT GONE (DISP OK) |
| 00C7 | 6A | KEYOK | LISL | 2 | KEY STACK |
| 00C8 | 70 | . | CLR | | |
| 00C9 | CD | . | AS | I | ANY KEY IN 72? |
| 00CA | 840D 00D8 | . | BZ | SAVEKEY | NO |
| 00CC | 70 | . | CLR | | |
| 00CD | CD | . | AS | I | ANY KEY IN 73? |
| 00CE | 8409 00D8 | . | BZ | SAVEKEY | NO |
| 00D0 | 70 | . | CLR | | |
| 00D1 | CD | . | AS | I | ANY KEY IN 74? |
| 00D2 | 8405 00D8 | . | BZ | SAVEKEY | NO |
| 00D4 | 70 | . | CLR | | |
| 00D5 | CD | . | AS | I | ANY KEY IN 75? |
| 00D6 | 9417 00EE | . | BNZ | NOKEY | BUFFER FULL |
| 00D8 | 4E | SAVEKEY | LR | A,D | ADJ BACK TO REG |
| 00D9 | 46 | . | LR | A,6 | |
| 00DA | 5C | . | LR | S,A | SAVE NEW KEY |
| 00DB | 9012 00EE | . | BR | NOKEY | |
| 00DD | 4B | DEBOUNCE | LR | A,11 | GET COL DATA |
| 00DE | 6F | . | LISL | 7 | |
| 00DF | EE | . | XS | D | LAST KEY THIS COL? |
| 00E0 | 940D 00EE | . | BNZ | NOKEY | NO |
| 00E2 | A1 | . | INS | 1 | |
| 00E3 | 18 | . | COM | | |
| 00E4 | 2107 | . | NI | H'07' | ANY KEY? |
| 00E6 | 9405 00EC | . | BNZ | INITCNT | YES |
| 00E8 | 3D | . | DS | I | 3 PASSES NO KEY? |
| 00E9 | 9404 00EE | . | BNZ | NOKEY | |
| 00EB | 5E | . | LR | D,A | CLR COL DATA |
| 00EC | 73 | INITCNT | LIS | H'3' | 3 PASSES |
| 00ED | 5C | . | LR | S,A | 3 PASSES |
| 00EE | 48 | NOKEY | LR | A,8 | |
| 00EF | 0B | . | LR | IS,A | RESTORE ISAR |
| 00F0 | 47 | . | LR | A,7 | RESOTRE ACC |
| 00F1 | 1D | . | LR | W,J | RESTORE STATUS |
| 00F2 | 1B | . | EI | | |
| 00F3 | 1C | . | POP | | |
| 00F4 | 2032 | START | LI | H'32' | SET FOR 1 MSEC COUNT |

APPENDIX A-continued

Resident Firmware Listing

| Loc | Object | Label | Mnemonic | | Comment |
|---|---|---|---|---|---|
| 00F6 | B7 | . | OUTS | 7 | |
| 00F7 | 20AA | . | LI | H'AA' | START COUNT |
| 00F9 | B6 | . | OUTS | 6 | |
| 00FA | 1B | . | EI | | |
| 00FB | 6E | . | LISL | 6 | R66 = REMOTE DATA LOC |
| 00FC | 20FF | . | LI | H'FF' | |
| 00FE | 5C | . | LR | S,A | NO REMOTE DATA |
| 00FF | 280000 0000 | . | PI | ADV9 | |
| 0102 | 290356 0356 | . | JMP | SHOWKB | |
| 0103 | 290000 | . | JMP | REMOTE | |
| 0105 | 63 | KEYSORT | LISU | 3 | |
| 0106 | 6E | . | LISL | 6 | |
| 0107 | 70 | . | CLR | | |
| 0108 | CD | . | AS | I | R 36 = 0? |
| 0109 | 944D 0157 | . | BNZ | CHKREM | NO |
| 010B | CD | . | AS | I | R 37 = 0? |
| 010C | 944A 0157 | . | BNZ | CHKREM | LOCK OUT NOT GONE |
| 010E | 62 | . | LISU | 2 | |
| 010F | 6A | . | LISL | 2 | |
| 0110 | AO | . | INS | 0 | |
| 0111 | 2101 | . | NI | H'01' | LOW COIN SIGNAL? |
| 0113 | 941C 0130 | . | BNZ | FILLON | YES |
| 0115 | 6C | . | LISL | 4 | 'L' LOC IN BUFFER |
| 0116 | 7F | NXTL | LIS | H'F | |
| 0117 | FC | . | NS | S | GET CHARACTER |
| 0118 | 250B | . | CI | H'B' | NUMERIC? |
| 011A | 4C | .LR | A,S | | |
| 011B | 8102 011E | . | BP | REPL | NO |
| 011D | 7A | . | LIS | H'A | BLANK |
| 011E | 5D | REPL | LR | I,A | INSERT CORRECT CHARACTER |
| 011F | 8FF6 0116 | . | BR7 | NXTL | NEXT CHARACTER |
| 0121 | 7F | . | LIS | H'F | |
| 0122 | FC | . | NS | S | |
| 0123 | 250B | . | CI | H'OB' | LAST = ALPHA? |
| 0125 | 4C | . | LR | A,S | |
| 0126 | 8102 0129 | . | BP | REPL1 | NO |
| 0128 | 7A | . | LIS | H'A' | BLANK |
| 0129 | 5C | REPL1 | LR | S,A | |
| 012A | 40 | . | LR | A,0 | |
| 012B | 21DE | . | NI | H'DE' | RESET FILL & BEEP BIT |
| 012D | 50 | . | LR | 0,A | |
| 012E | 9028 0157 | . | BR | CHKREM | |
| 0130 | 6F | FILLON | LISL | 7 | |
| 0131 | 7A | . | LIS | H'A' | BLANK CODE |
| 0132 | 51 | . | LR | 1,A | FOR COMPARE |
| 0133 | 4C | . | LR | A,S | |
| 0134 | E1 | . | XS | 1 | LAST DIGIT = BLANK? |
| 0135 | 9415 014B | . | BNZ | CHKBIT | NO |
| 0137 | 7F | . | LIS | H'F' | CODE FOR 'F' |
| 0138 | 5E | . | LR | D,A | SAVE F |
| 0139 | 4C | . | LR | A,S | |
| 013A | E1 | . | XS | 1 | NEXT = BLANK? |
| 013B | 940F 014B | . | BNZ | CHKBIT | NO |
| 013D | 7E | . | LIS | H'E' | CODE FOR 'I' |
| 013E | 5E | . | LR | D,A | |
| 013F | 4C | . | LR | A,S | |
| 0140 | E1 | . | XS | 1 | NEXT = BLANK? |
| 0141 | 9409 014B | . | BNZ | CHKBIT | NO |
| 0143 | 7C | . | LIS | H'C' | CODE FOR L |
| 0144 | 5E | . | LR | D,A | |
| 0145 | 4C | . | LR | A,S | |
| 0146 | E1 | . | XS | 1 | NEXT = BLANK? |
| 0147 | 9403 014B | . | BNZ | CHKBIT | NO |
| 0149 | 7C | . | LIS | H'C' | LAST 'L' |
| 014A | 5E | . | LR | D,A | |
| 014B | 40 | CHKBIT | LR | A,O | |
| 014C | 2120 | . | NI | H'20' | FILL BIT ON? |
| 014E | 9408 0157 | . | BNZ | CHKREM | YES |
| 0150 | 40 | . | LR | A,O | |
| 0151 | 2221 | . | OI | H'21' | FILL AND SHORT BEEP BITS |
| 0153 | 50 | . | LR | O,A | |
| 0154 | 20FF | . | LI | H'FF' | |
| 0156 | 5A | . | LR | 10,A | INITIALIZE CTR |

APPENDIX A-continued

Resident Firmware Listing

| Loc | Object | Label | Mnemonic | | Comment |
|---|---|---|---|---|---|
| 0157 | 66 | CHKREM | LISU | 6 | |
| 0158 | 6E | . | LISL | 6 | R66 = REMOTE DATA |
| 0159 | 4C | . | LR | A,S | |
| 015A | 1F | . | INC | . | DATA = FF? |
| 015B | 8204 0160 | . | BC | NOREM | YES = NO DATA |
| 015D | 290000 0000 | . | JMP | REMOTE | |
| 0160 | 67 | NOREM | LISU | 7 | |
| 0161 | 6A | . | LISL | 2 | KEY STACK |
| 0162 | 70 | . | CLR | | |
| 0163 | CD | . | AS | I | GET R72 |
| 0164 | 84A0 0105 | . | BZ | KEYSORT | NO KEY FOUND |
| 0166 | 55 | . | LR | 5,A | SAVE KEY DATA |
| 0167 | 6B | . | LISL | 3 | |
| 0168 | 4E | . | LR | A,D | GET NEXT DATA |
| 0169 | 5C | . | LR | S,A | SAVE IN R72 |
| 016A | 6C | . | LISL | 4 | |
| 016B | 4E | ADJKB | LR | A,D | GET DATA |
| 016C | 5C | . | LR | S,A | SAVE IN R73 |
| 016D | 6D | . | LISL | 5 | |
| 016E | 4E | . | LR | A,D | GET DATA |
| 016F | 5D | . | LR | I,A | SAVE IN R74 |
| 0170 | 70 | . | CLR | | |
| 0171 | 5C | . | LR | S,A | CLR R75 |
| 0172 | 1A | . | DI | | |
| 0173 | 45 | . | LR | A,5 | GET KEY DATA |
| 0174 | 24D0 | . | AI | H'DO' | ADJ TO LO ADDR |
| 0176 | 97 | . | LR | QL,A | |
| 0177 | 0F | . | LR | DC,Q | KEY LOOKUP TABLE |
| 0178 | 70 | . | CLR | | |
| 0179 | 88 | . | AM | . | GET KEY CODE |
| 017A | 1B | . | EI | . | |
| 017B | 55 | . | LR | 5,A | SAVE CODE |
| 017C | 8104 0181 | . | BP | SRT1 | |
| 017E | 29035B 035B | . | JMP | KEYDONE | 8X = NO ACTION NECESSARY |
| 0181 | 13 | SRT1 | SL | 1 | |
| 0182 | 8104 0187 | | BP | SRT2 | |
| 0184 | 29027C 027C | . | JMP | CTRL | 4X = CONTROL KEY |
| 0187 | 13 | SRT2 | SL | 1 | |
| 0188 | 9149 01D2 | . | BM | CALC | 2X = CALCULATOR KEY |
| 018A | 63 | DIGIT | LISU | 3 | DIGIT KEY |
| 018B | 6D | . | LISL | 5 | DISP FLAG LOC |
| 018C | 70 | . | CLR | | |
| 018D | 5C | . | LR | S,A | CLEAR DISP FLAG |
| 018E | 74 | . | LIS | 4 | |
| 018F | F0 | . | NS | 0 | ENT BIT SET? |
| 0190 | 8410 01A1 | . | BZ | NOTFRST | NO - NOT FIRST DIG |
| 0192 | 70 | . | CLR | | |
| 0193 | 5E | KBCLR | LR | D,A | CLR K.B. & R35 |
| 0194 | 8FFE 0193 | . | BR7 | KBCLR | |
| 0196 | C5 | . | AS | 5 | GET KEY CODE |
| 0197 | 8406 019E | . | BZ | SV25 | SAVE SPLIT QUARTER FLAG |
| 0199 | 2510 | . | CI | H'10' | DBL ZERO = SPLIT $1 |
| 019B | 9405 01A1 | . | BNZ | NOTFRST | |
| 019D | 71 | . | LIS | 1 | CODE FOR 00 = 1 |
| 019E | 1F | SV25 | INC | . | CODE FOR 00 = 2 |
| 019F | 6D | . | LSL | 5 | |
| 01A1 | 5E | . | LR | D,A | |
| 01A1 | 6B | NOTFRST | LISL | 3 | |
| 01A2 | 40 | . | LR | A,O | |
| 01A3 | 21FB | . | NI | H'FB' | RESET ENT BIT |
| 01A5 | 50 | . | LR | O,A | |
| 01A6 | 45 | . | LR | A,5 | |
| 01A7 | 14 | . | SR | 4 | CODE = 10? |
| 01A8 | 8414 01BD | . | BZ | NOTDBL | NO = NOT DBLZ |
| 01AA | 70 | . | CLR | | |
| 01AB | CC | . | AS | S | ROOM FOR TWO ZEROES? |
| 01AC | 8405 01B2 | . | BZ | DODBL | YES |
| 01AE | 70 | . | CLR | | |
| 01AF | 55 | . | LR | 5,A | SINGLE ZERO CODE |
| 01B0 | 900C 01BD | . | BR | NOTDBL | DO SINGLE ZERO |
| 01B2 | 6A | DODBL | LISL | 2 | |

APPENDIX A-continued

Resident Firmware Listing

| Loc | Object | Label | Mnemonic | | Comment |
|---|---|---|---|---|---|
| 01B3 | 4D | NDM | LR | A,I | |
| 01B4 | 5E | . | LR | D,A | MOVE TWO DIGITS |
| 01B5 | 4E | . | LR | A,D | ADJ ISAR |
| 01B6 | 8FFC 01B3 | . | BR7 | NDM | |
| 01B8 | 68 | . | LISL | O | |
| 01B9 | 70 | . | CLR | . | DOUBL ZERO |
| 01BA | 5C | . | LR | S,A | STORE DBL ZERO |
| 01BB | 900D 01C9 | . | BR | FULL | OUT |
| 01BD | 4C | NOTDBL | LR | A,S | GET HI DIGIT BYTE |
| 01BE | 14 | . | SR | 4 | |
| 01BF | 9409 01C9 | . | BNZ | FULL | NO MORE DIGITS |
| 01C1 | 4E | ADJKB | LR | A,D | GET BYTE |
| 01C2 | 15 | . | SL | 4 | |
| 01C3 | 51 | . | LR | 1,A | |
| 01C4 | 8F07 01CC | . | BR7 | DOK | LAST DIGIT? |
| 01C6 | 68 | . | LISL | O | |
| 01C7 | C5 | . | AS | 5 | INSERT DATA |
| 01C8 | 5E | . | LR | D,A | |
| 01C9 | 290356 0356 | FULL | JMP | SHOWKB | |
| 01CC | 4D | DOK | LR | A,I | GET LAST HI |
| 01CD | 14 | . | SR | 4 | |
| 01CE | C1 | . | AS | 1 | |
| 01CF | 5E | . | LR | D,A | SAVE NEW DATA |
| 01D0 | 90F0 01C1 | . | BR | ADJKB | |
| 01D1 | 2066 | . | LI | H'66' | DEC ADJ |
| 01D2 | 63 | CALC | LISU | 3 | |
| 01D4 | 76 | . | LIS | 6 | NO DISP FLAG |
| 01D5 | 5C | . | LR | S,A | |
| 01D6 | 45 | . | LR | A,5 | KEY CODE |
| 01D7 | 24DE | . | AI | H'DE' | |
| 01D9 | 824A 0224 | . | BC | SUBTR | MINUS KEY |
| 01DB | 1F | . | INC | | |
| 01DC | 8223 0200 | . | BC | ADD | PLUS KEY |
| 01DE | 74 | CECLR | LIS | 4 | |
| 01DF | F0 | . | NS | 0 | ENTER BIT SET? |
| 01E0 | 940C 01ED | . | BNZ | CLEAR | YES |
| 01E2 | 6B | CE | LISL | 3 | |
| 01E3 | 70 | . | CLR | | |
| 01E4 | 5E | CLRKB | LR | D,A | |
| 01E5 | 8FFE 01E4 | . | BR7 | CLRKB | |
| 01E7 | 40 | . | LR | A,O | |
| 01E8 | 2204 | . | OI | H'04' | SET ENTER BIT |
| 01EA | 50 | . | LR | O,A | |
| 01EB | 90DD 01C9 | . | BR | FULL | GO TO SHOWKB |
| 01ED | 280000 0000 | CLEAR | PI | CLRTOT | |
| 01F0 | 6B | . | LISL | 3 | R 43 TOT BUFF HI |
| 01F1 | 280361 0361 | . | PI | TODISP | |
| 01F4 | 7C | . | LIS | H'C' | CODE FOR 'T' |
| 01F5 | 51 | . | LR | 1,A | |
| 01F6 | 2803BA 03BA | . | PI | SENDPB | |
| 01F9 | 63 | . | LISU | 3 | |
| 01FA | 6D | . | LISL | 5 | |
| 01FB | 70 | . | CLR | | |
| 01FC | 5C | . | LR | S,A | |
| 01FD | 290000 0000 | . | JMP | PRINT | |
| 0200 | 1A | ADD | DI | | |
| 0201 | 68 | . | LISL | 0 | KEY BUFF |
| 0202 | 201B | . | LI | H'1B' | CODE FOR '+' |
| 0204 | 51 | . | LR | 1,A | |
| 0205 | 18 | . | COM | | |
| 0206 | 1E | . | LR | J,W | CLR CARRY |
| 0207 | 4C | ADDLOOP | LR | A,S | K.B. DATA |
| 0208 | 1D | . | LR | W,J | GET LAST CARRY |
| 0209 | 19 | . | LNK | | |
| 020A | 52 | . | LR | 2,A | SAVE K.B. + CARRY |
| 020B | 64 | . | LISU | 4 | |
| 020C | 4C | . | LR | A,S | |
| 020D | 2466 | . | AI | H'66' | DEC ADJ |
| 020F | D2 | . | ASD | 2 | ADD K.B. DATA |
| 0210 | 1E | . | LR | J,W | SAVE CARRY |
| 0211 | 5D | . | LR | I,A | SAVE DATA IN TOT |
| 0212 | 63 | . | LISU | 3 | |
| 0213 | 0A | . | LR | A,IS | |
| 0214 | 251D | . | CI | 0'35' | DONE? |
| 0216 | 94F0 0207 | . | BNZ | ADDLOOP | |
| 0218 | 64 | . | LISU | 4 | |
| 0219 | 6C | . | LISL | 4 | |

APPENDIX A-continued

Resident Firmware Listing

| Loc | Object | Label | Mnemonic | | Comment |
|---|---|---|---|---|---|
| 021A | 70 | . | CLR | | |
| 021B | CC | . | AS | S | OVERFLOW? |
| 021C | 8449 0266 | . | BZ | TOTOK | |
| 021E | 2599 | . | CI | H'99' | NEGATIVE? |
| 0220 | 8445 0266 | . | BZ | TOTOK | YES |
| 0222 | 903F 0262 | . | BR | ERROR | DONE ADD |
| 0224 | 1A | SUBTR | DI | | |
| 0225 | 7B | . | LIS | H'B' | CODE FOR '–' |
| 0226 | 51 | . | LR | 1,A | |
| 0027 | 68 | . | LISL | 0 | K.B. |
| 0228 | 2066 | . | LI | H'66' | DEC ADJ |
| 022A | 52 | . | LR | 2,A | |
| 022B | 71 | . | LIS | 1 | |
| 022C | 54 | LOOP | LR | 4,A | SAVE CARRY |
| 022D | 4C | . | LR | A,S | DATA |
| 022E | 53 | . | LR | 3,A | SAVE |
| 022F | 64 | . | LISU | 4 | |
| 0230 | 43 | . | LR | A,3 | |
| 0231 | 18 | . | COM | | |
| 0232 | DC | . | ASD | S | |
| 0233 | 1E | . | LR | J,W | SAVE CARRY |
| 0234 | C4 | . | AS | 4 | ADD PRIOR CARRY |
| 0235 | D2 | . | ASD | 2 | DEC ADJ |
| 0236 | 9202 0239 | . | BNC | CRY2 | |
| 0238 | 1E | . | LR | J,W | GET CARRY |
| 0239 | 5D | CRY2 | LR | I,A | SAVE RESULT |
| 023A | 63 | . | LISU | 3 | |
| 023B | 0A | . | LR | A,IS | |
| 023C | 251D | . | CI | 0'35' | DONE? |
| 023E | 8406 025B | . | BZ | CHKOVFL | YES |
| 0240 | 72 | . | LIS | 2 | |
| 0241 | F9 | . | NS | 9 | GET CARRY BIT |
| 0242 | 12 | . | SR | 1 | ADJ |
| 0243 | 90E8 | . | BR | LOOP | |
| 0245 | 64 | CHKOVFL | LISU | 4 | |
| 0246 | 6C | . | LISL | 4 | |
| 0247 | 70 | . | CLR | | |
| 0248 | CC | . | AS | S | NEGATIVE NO.? |
| 0249 | 841C | . | BZ | TOTOK | NO |
| 024B | 68 | . | LISL | 0 | TOT BUFF LO |
| 024C | 70 | . | CLR | | |
| 024D | CD | . | AS | I | |
| 024E | 940C | . | BNZ | NOT1K | NOT –$100,000.00 |
| 0250 | CD | . | AS | I | |
| 0251 | 9409 025B | . | BNZ | NOT1K | |
| 0253 | CD | . | AS | I | |
| 0254 | 9406 025B | . | BNZ | NOT1K | |
| 0256 | CD | . | AS | I | |
| 0257 | 2590 | . | CI | H'90' | VALUE = –$100,000.00 |
| 0259 | 8408 0262 | . | BZ | ERROR | YES |
| 025B | 6B | NOT1K | LISL | 3 | |
| 025C | 4C | . | LR | A,S | |
| 025D | 14 | . | SR | 4 | |
| 025E | 2509 | . | CI | H'09' | VALUE –$100,000.00 |
| 0260 | 8405 0266 | . | BZ | TOTOK | NO |
| 0262 | 40 | ERROR | LR | A,0 | |
| 0263 | 2202 | . | OI | H'02' | SET OVFL BIT |
| 0265 | 50 | . | LR | O,A | |
| 0266 | 1B | TOTOK | EI | | |
| 0267 | 63 | . | LISU | 3 | |
| 0268 | 6B | . | LISL | 3 | K.B. HI BYTE |
| 0269 | 280361 0361 | . | PI | TODISP | MOVE ENTRY TO DISP BUFF |
| 026C | 7D | . | LIS | H'D' | PRINT CODE |
| 026D | 5B | . | LR | 11,A | |
| 026E | 2803BA 03BA | . | PI | SENDPB | |
| 0271 | 40 | . | LR | A,0 | |
| 0272 | 2204 | . | OI | H'04' | SET ENT BIT |
| 0274 | 50 | . | LR | O,A | |
| 0275 | 64 | . | LISU | 4 | |
| 0276 | 6B | . | LISL | 3 | TOT BUFF HI |
| 0277 | 280361 0361 | . | PI | TODISP | |
| 027A | 9035 02B0 | . | BR | GTPRINT | |
| 027C | 45 | CTRL | LR | A,5 | |
| 027D | 24BC | . | AI | H'BC' | |
| 027F | 823E 02BE | . | BC | DISP | DISPENSE |
| 0281 | 1F | . | INC | | |
| 0282 | 9208 028B | . | BNC | CTRL1 | |
| 0284 | 40 | . | LR | A,O | |
| 0285 | 2380 | . | XI | H'8:' | TOGGLE PRINT BIT |

APPENDIX A-continued

Resident Firmware Listing

| Loc | Object | Label | Mnemonic | | Comment |
|---|---|---|---|---|---|
| 0287 | 50 | . | LR | O,A | |
| 0288 | 2901ED 01ED | . | JMP | CLEAR | |
| 028B | 1F | CTRL1 | INC | | |
| 028C | 9206 0293 | . | BNC | CTRL2 | |
| 028E | 280000 0000 | . | PI | ADV59 | PAPER ADV-6.5 LINES |
| 0291 | 9005 0297 | . | BR | TKEYD | |
| 0293 | 74 | CTRL2 | LIS | 4 | MUST BE ST. OR TOT. |
| 0294 | F0 | . | NS | 0 | |
| 0295 | 9404 029A | . | BNZ | OKTOT | NO ENTRY PENDING |
| 0297 | 29035B 035B | TKEYD | JMP | KEYDONE | |
| 029A | 64 | OKTOT | LISU | 4 | |
| 029B | 6B | . | LISL | 3 | |
| 029C | 280361 0361 | . | PI | TODISP | DISPLAY TOTAL BUFFER |
| 029F | 45 | . | LR | A,5 | GET KEY CODE |
| 02A0 | 2540 | . | CI | H'40' | SUB TOT? |
| 02A2 | 9410 02B3 | . | BNZ | TOT | NO |
| 02A4 | 7D | DOST | LIS | H'D' | PRINT CODE |
| 02A5 | 5B | . | LR | 11,A | SAVE CODE |
| 02A6 | 201C | . | LI | H'1C' | CODE FOR 'S' |
| 02A8 | 51 | . | LR | 1,A | |
| 02A9 | 70 | . | CLR | . | NO DISP FLAG |
| 02AA | 63 | GOPRINT | LISU | 3 | |
| 02AB | 6D | . | LISL | 5 | |
| 02AC | 5C | . | LR | S,A | SAVE DISP FLAG |
| 02AD | 2803BA 03BA | . | PI | SENDPB | |
| 02B0 | 290000 0000 | GTPRINT | JMP | PRINT | |
| 02B3 | 7C | TOT | LIS | H'C' | CODE FOR 'T' |
| 02B4 | 51 | . | LR | 1,A | |
| 02B5 | A0 | . | INS | 0 | |
| 02B6 | 2120 | . | NI | H'20' | DISP 99 OR 499 BIT |
| 02B8 | 74 | . | LIS | 4 | |
| 02B9 | 8402 02BC | . | BZ | SFLG | 499 |
| 02BB | 73 | . | LIS | 3 | 99 |
| 02BC | 90ED 02AA | SFLG | BR | GOPRINT | |
| 02BE | A0 | DISP | INS | 0 | |
| 02BF | 2101 | . | NI | H'01' | LO COIN CONDITION? |
| 02C1 | 9408 02CA | . | BNZ | TNODISP | YES |
| 02C3 | 62 | . | LISU | 2 | |
| 02C4 | 6F | . | LISL | 7 | |
| 02C5 | 4C | . | LR | A,S | |
| 02C6 | 250B | . | CI | H'OB' | MINUS NUMBER? |
| 02C8 | 9404 02CD | . | BNZ | NOTNG | NO |
| 02CA | 290354 0354 | TNODISP | JMP | NODISP | |
| 02CD | 63 | NOTNG | LISU | 3 | |
| 02CE | 6D | . | LISL | 5 | |
| 02CF | 4C | . | LR | A,S | GET DISP CODE |
| 02D0 | 51 | . | LR | 1,A | |
| 02D1 | 2506 | . | CI | H'06' | |
| 02D3 | 84F6 02CA | . | BZ | TNODISP | NO DISP CODE |
| 02D5 | 2503 | . | CI | H'03' | REPEAT DISP? |
| 02D7 | 841F 02F7 | . | BZ | TDODISP | DISP SAME VALUE |
| 02D9 | 2502 | . | CI | H'02' | SPLIT CHG FLAG? |
| 02DB | 911E 02FA | . | BM | NOT100 | NO |
| 02DD | 6C | . | LISL | 4 | |
| 02DE | 70 | CLKB | CLR | | |
| 02DF | 5E | . | LR | D,A | ZERO KB |
| 02E0 | 8FFD 02DE | . | BR7 | CLKB | |
| 02E2 | 68 | . | LISL | 0 | |
| 02E3 | 41 | . | LR | A,I | |
| 02E4 | 2501 | . | CI | H'01' | 25C SLPIT CHG? |
| 02E6 | 9405 02EC | . | BNZ | NOT25 | |
| 02E8 | 2025 | . | LI | H'25' | 25 C TO KB |
| 02EA | 9007 02F2 | . | BR | TOKB | |
| 02EC | 2502 | NOT25 | CI | H'02' | 100 SPLIT CHG? |
| 02EE | 940B 02FA | . | BNZ | NOT100 | NO |
| 02F0 | 69 | . | LISL | 1 | |
| 02F1 | 71 | . | LIS | 1 | 100C TO KB |
| 02F2 | 5C | TOKB | LR | S,A | |
| 02F3 | 6B | . | LISL | 3 | |
| 02F4 | 280361 0361 | . | PI | TODISP | |
| 02F7 | 29034D 034D | TDODISP | JMP | DODISP | |
| 02FA | 54 | NOT100 | LR | 4,A | SAVE FLAG |
| 02FB | 62 | . | LISU | 2 | |
| 02FC | 6D | . | LISL | 5 | |
| 02FD | 4C | . | LR | A,S | |
| 02FE | 6F | . | LISL | 7 | |

APPENDIX A-continued

Resident Firmware Listing

| Loc | Object | Label | Mnemonic | | Comment |
|---|---|---|---|---|---|
| 02FF | 5C | . | LR | S,A | |
| 0300 | 6C | . | LISL | 4 | |
| 0301 | 4C | . | LR | A,S | |
| 0302 | 6E | . | LISL | 6 | |
| 0303 | 5C | . | LR | S,A | MOVE 4 HI DIGITS |
| 0304 | 6B | . | LISL | 3 | |
| 0305 | 4C | . | LR | A,S | |
| 0306 | 6D | . | LISL | 5 | |
| 0307 | 5C | . | LR | S,A | TO LEFT OF DISPLAY |
| 0308 | 6A | . | LSL | 2 | |
| 0309 | 4C | . | LR | A,S | |
| 030A | 6C | . | LISL | 4 | |
| 030B | 5C | . | LR | S,A | |
| 030C | A0 | . | INS | 0 | |
| 030D | 2110 | . | NI | H'10' | TRIP QUART MAG? |
| 030F | 9439 0349 | . | BNZ | NOT499 | YES |
| 0311 | 44 | . | LR | A,4 | GET DISP FLAG |
| 0312 | 2505 | . | CI | H'05' | DISP 99 CODE? |
| 0314 | 8434 0349 | . | BZ | NOT499 | YES GO TO NOT499 |
| 0316 | 6B | . | LISL | 3 | |
| 0317 | 7A | . | LIS | H'A' | BLANK TO 4TH LOC |
| 0318 | 5E | . | LR | D,A | |
| 0319 | 4C | . | LR | A,S | |
| 031A | 250A | . | CI | H'A' | $1 DIGIT BLANK? |
| 031C | 8410 032D | . | BZ | UNDER5 | YES |
| 031E | 2504 | . | CI | H'04' | DOLLAR DIG 5? |
| 0320 | 810C 032D | . | BP | UNDER5 | |
| 0322 | 24FB | . | AI | H'FB' | ADJ DIG |
| 0324 | 9402 0327 | . | BNZ | STRNEW | |
| 0326 | 7A | . | LIS | H'A' | BLANK THE DIGIT |
| 0327 | 5C | STRNEW | LR | S,A | |
| 0328 | 6C | . | LISL | 4 | |
| 0329 | 75 | . | LIS | 5 | |
| 032A | 5C | . | LR | S,A | 5 TO HI DIG |
| 032B | 9021 034D | . | BR | DODISP | |
| 032D | 2500 | UNDER5 | CI | H'00' | DOLLAR DIG = 0? |
| 032F | 9403 0333 | . | BNZ | DDNOTZ | NO |
| 0331 | 7A | . | LIS | H'A' | BLANK DOLLAR DIGIT |
| 0332 | . | LR | S,A | | |
| 0333 | 6C | DDNOTZ | LISL | 4 | |
| 0334 | 70 | . | . | CLR | |
| 0335 | 5D | . | LR | I,A | CLEAR $1 DIG IN HI HALF |
| 0336 | 7A | . | LIS | H'A' | |
| 0337 | 51 | . | LR | 1,A | CODE FOR BLANK |
| 0338 | 4D | . | LR | A,I | R25 = BLANK? |
| 0339 | E1 | . | XS | 1 | BLANK? |
| 033A | 9412 034D | . | BNZ | DODISP | NO |
| 033C | 4C | . | LR | A,I | R26 = BLANK? |
| 033D | E1 | . | XS | 1 | |
| 033E | 940E 034D | . | BNZ | DODISP | NO |
| 0340 | 4C | . | LR | A,S | |
| 0341 | E1 | . | XS | 1 | R27 = BLANK? |
| 0342 | 940A 034D | . | BNZ | DODISP | NO |
| 0344 | 6C | . | LISL | 4 | |
| 0345 | 7A | . | LIS | H'A' | BLANK TO UNITS DIG |
| 0346 | 5C | . | LR | S,A | |
| 0347 | 9005 034D | . | BR | DODISP | |
| 0349 | 6A | NOT499 | LISL | 2 | |
| 034A | 7A | . | LIS | H'A' | BLANK |
| 034B | 5D | . | LR | I,A | CLEAR DOLLAR DIG |
| 034C | 5E | . | KLR | D,A | AND $10 DIGIT |
| 034D | 40 | DODISP | LR | A,O | |
| 034E | 2204 | . | OI | H'04' | SET ENT BIT |
| 0350 | 50 | . | LR | O,A | |
| 0351 | 280000 0000 | . | PI | DISPENSE | |
| 0354 | 9006 035B | NODISP | BR | KEYDONE | |
| 0356 | 63 | SHOWKB | LISU | 3 | |
| 0357 | 6B | . | LISL | 3 | HI END K.B. |
| 0358 | 280361 036A | TOTDISP | PI | TODISP | |
| 035B | 20FF | KEYDONE | LI | H'FF' | |
| 035D | 55 | . | LR | 5,A | |
| 035E | 290105 0105 | . | JMP | KEYSORT | |
| 0361 | 08 | TODISP | LR | K,P | |
| 0362 | 2017 | . | LI | 0'27' | |
| 0364 | 54 | . | LR | 4,A | DESTINATION |
| 0365 | 4E | MOVD | LR | A,D | GET 2 DIGITS |

APPENDIX A-continued

Resident Firmware Listing

| Loc | Object | Label | Mnemonic | | Comment |
|---|---|---|---|---|---|
| 0366 | 53 | . | LR | 3,A | SAVE DATA |
| 0367 | 0A | . | LR | A,IS | |
| 0368 | 52 | . | LR | 2,A | SAVE SOURCE REG |
| 0369 | 44 | . | LR | A,4 | |
| 036A | 0B | . | LR | IS,A | DESTINATION |
| 036B | 43 | . | LR | A,3 | |
| 036C | 14 | . | SR | 4 | HI DIGIT |
| 036D | 5E | . | LR | D,A | |
| 036E | 43 | . | LR | A,3 | |
| 036F | 15 | . | SL | 4 | |
| 0370 | 14 | . | SR | 4 | |
| 0371 | 5E | . | LR | D,A | LO DIGIT |
| 0372 | 0A | . | LR | A,IS | |
| 0373 | 54 | . | LR | 4,A | SAVE DESTINATION |
| 0374 | 42 | . | LR | A,2 | |
| 0375 | 0B | . | LR | IS,A | SOURCE |
| 0376 | 8FEE 0365 | BR7 | MOVD | | |
| 0378 | 42 | UNPK | LR | A,2 | |
| 0379 | 24FD | . | AI | H'FD' | |
| 037B | 0B | . | LR | IS,A | |
| 037C | 4C | . | LR | A,S | GET HI BYTE |
| 037D | 2599 | . | CI | H'99' | |
| 037F | 8410 0390 | . | BZ | NEG | NEGATIVE NO. |
| 0381 | 62 | . | LISU | 2 | |
| 0382 | 6F | . | LISL | 7 | |
| 0383 | 70 | BLK | CLR | | |
| 0384 | CC | . | AS | S | |
| 0385 | 9427 03AD | . | BNZ | DONEFILL | |
| 0387 | 7A | . | LIS | H'A' | BLANK |
| 0388 | 5E | . | LR | D,A | SAVE BLANK |
| 0389 | 0A | . | LR | A,IS | |
| 038A | 2511 | . | CI | 0'21' | DONE FILLING? |
| 038C | 94F6 0383 | . | BNZ | BLK | |
| 038E | 901E 03AD | . | BR | DONEFILL | |
| 0390 | 1A | NEG | DI | | |
| 0391 | 74 | . | LIS | 4 | |
| 0392 | 59 | . | LR | 9,A | SET ZERO BIT |
| 0393 | 62 | . | LISU | 2 | |
| 0394 | 68 | . | LISL | 0 | |
| 0395 | 1D | ADJNXT | LR | W,J | GET OLD STATUS |
| 0396 | 7A | . | LIS | H'A' | |
| 0397 | 9402 039A | . | BNZ | NXTRA | |
| 0399 | 1F | . | INC | . | ADJ TO OB |
| 039A | 54 | NXTRA | LR | 4,A | |
| 039B | 4C | . | LR | A,S | |
| 039C | 18 | . | COM | | |
| 039D | C4 | . | AS | 4 | ADJ TO POS DIGIT |
| 039E | 250A | . | CI | H'0A' | NEED XTRA ON NEXT? |
| 03A0 | 1E | . | LR | J,W | |
| 03A1 | 9402 03A4 | . | BNZ | OK | |
| 03A3 | 70 | . | CLR | | |
| 03A4 | 5D | OK | LR | I,A | SAVE ADJUSTED DATA |
| 03A5 | 0A | . | LR | A,IS | |
| 03A6 | 2517 | . | CI | 0'27' | DONE? |
| 03A8 | 94EC 0395 | . | BNZ | ADJNXT | NO |
| 03AA | 7B | . | LIS | H'B' | MINUS SIGN |
| 03AB | 5C | . | LR | S,A | |
| 03AC | 1B | . | EI | | |
| 03AD | 72 | DONEFILL | LIS | 2 | |
| 03AE | F0 | . | NS | 0 | OVFLOWED? |
| 03AF | 8409 03B9 | . | BZ | FNDATA | NO |
| 03B1 | 62 | . | LISU | 2 | |
| 03B2 | 6F | . | LISL | 7 | |
| 03B3 | 4C | FLASH | LR | A,S | |
| 03B4 | 2210 | . | −I | H'10' | ADJ TO FLASH DIGIT |
| 03B6 | 5E | . | LR | D,A | |
| 03B7 | 8FFB 03B3 | . | BR7 | FLASH | |
| 03B9 | 0C | FNDATA | PK | | |
| 03BA | 08 | SENDPB | LR | K,P | |
| 03BB | 66 | . | LISU | 6 | |
| 03BC | 6A | . | LISL | 2 | |
| 03BD | 7A | . | LIS | H'A' | BLANK IN R 62 |
| 03BE | 5C | . | LR | S,A | |
| 03BF | 41 | . | LR | A,1 | GET CODE |
| 03C0 | 65 | . | LISU | 5 | |
| 03C1 | 68 | . | LISL | 0 | |

APPENDIX A-continued

Resident Firmware Listing

| Loc | Object | Label | Mnemonic | | Comment |
|---|---|---|---|---|---|
| 03C2 | 5C | . | LR | S,A | SAVE CODE |
| 03C3 | 62 | . | LSU | 2 | R20 |
| 03C4 | 7F | . | LIS | H'F' | |
| 03C5 | FD | . | NS | I | NO OVFL BIT |
| 03C6 | 65 | . | LISU | 5 | |
| 03C7 | 5C | . | LR | S,A | R 51 |
| 03C8 | 62 | . | LISU | 2 | R21 |
| 03C9 | 7F | . | LIS | H'F' | |
| 03CA | FD | . | NS | I | |
| 03CB | 65 | . | LUSI | 5 | R 52 |
| 03CC | 5D | . | LR | I,A | |
| 03CD | 7F | . | LIS | H'F' | D.P. CODE |
| 03CE | 5E | . | LR | D,A | |
| 03CF | 62 | . | LUSI | 2 | |
| 03D0 | 7F | . | LIS | H'F' | |
| 03D1 | FC | . | NS | S | |
| 03D2 | 65 | . | LUSI | 5 | |
| 03D3 | 6C | . | LISL | 4 | R54 |
| 03D4 | 5E | . | LR | D,A | |
| 03D5 | 62 | . | LISU | 2 | R23 |
| 03D6 | 7F | . | LIS | H'F' | |
| 03D7 | FC | . | NS | S | |
| 03D8 | 65 | . | LISU | 5 | |
| 03D9 | 6D | . | LISL | 5 | R55 |
| 03DA | 5E | . | LR | D,A | |
| 03DB | 62 | . | LISU | 2 | R24 |
| 03DC | 7F | . | LIS | H'F' | |
| 03DD | FC | . | NS | S | |
| 03DE | 250B | . | CI | H'B' | ALPHA CHARACTER? |
| 03E0 | 8102 03E3 | . | BP | NOTA1 | NO |
| 03E2 | 7A | . | LIS | H'A' | INSERT BLANK |
| 03E3 | 65 | NOTA1 | LISU | 5 | |
| 03E4 | 6E | . | LISL | 6 | R56 |
| 03E5 | 5E | . | LR | D,A | |
| 03E6 | 62 | . | LISU | 2 | R25 |
| 03E7 | 7F | . | LIS | H'F' | |
| 03E8 | FC | . | NS | S | |
| 03E9 | 250B | . | CI | H'B' | ALPHA CHARACTER? |
| 03EB | 8102 03EE | . | BP | NOTA2 | NO |
| 03ED | 7A | . | LIS | H'A' | INSERT BLANK |
| 03EE | 65 | NOTA2 | LISU | 5 | |
| 03EF | 6F | . | LISL | 7 | R57 |
| 03F0 | 5E | . | LR | D,A | |
| 03F1 | 62 | . | LISU | 2 | R26 |
| 03F2 | 7F | . | LIS | H'F' | |
| 03F3 | FC | . | NS | S | |
| 03F4 | 250B | . | CI | H'OB' | ALPHA CHARACTER? |
| 03F6 | 8102 03F9 | . | BP | NOTA3 | |
| 03F8 | 7A | . | LIS | H'A' | INSERT BLANK |
| 03F9 | 66 | NOTA3 | LISU | 6 | |
| 03FA | 68 | . | LISL | 0 | |
| 03FB | 5C | . | LR | S,A | |
| 03FC | 62 | . | LISU | 2 | |
| 03FD | 6F | . | LISL | 7 | R26 |
| 03FE | 7F | . | LIS | H'F' | |
| 03FF | FC | . | NS | S | |
| 0400 | 250B | . | CI | H'B' | ALPHA CHARACTER? |
| 0402 | 8102 0405 | . | BP | NOTA4 | NO |
| 0404 | 7A | . | LIS | H'A' | INSERT BLANK |
| 0405 | 66 | NOTA4 | LISU | 6 | |
| 0406 | 69 | . | LISL | 1 | R61 |
| 0407 | 5D | . | LR | I,A | |
| 0408 | 72 | . | LIS | 2 | |
| 0409 | F0 | . | NS | 0 | OVFL BIT ON? |
| 040A | 8405 0410 | . | BZ | NOOVFL | NO |
| 040C | 7E | . | LIS | H'E' | CODE FOR 'E' |
| 040D | 5C | . | LR | S,A | |
| 040E | 900B 041A | . | BR | DONESEND | |
| 0410 | 69 | NOOVFL | LISL | 1 | |
| 0411 | 4C | . | LR | A,S | |
| 0412 | 250B | . | CI | H'OB' | MINUS SIGN? |
| 0414 | 9405 041A | . | BNZ | DONESEND | NO |
| 0416 | 70 | . | CLR | | |
| 0417 | 5D | . | LR | I,A | |
| 0418 | 7B | . | LIS | H'B' | MOVE SIGN |
| 0419 | 5D | . | LR | I,A | TO LAST POSITION |
| 041A | 0C | DONESEND | PK | | |
| 041B | 40 | . | LR | A,0 | GET BOTH FAIL FLAGS |
| 041C | 21D0 | . | NI | H'D0' | AND PRINTER OFF |

APPENDIX A-continued

Resident Firmware Listing

| Loc | Object | Label | Mnemonic | | Comment |
|---|---|---|---|---|---|
| | | | | | BIT |
| 041E | 8404 0423 | . | BZ | NOFAIL | NO FAILURE FOUND |
| 0420 | 2904AE 04AE | NOPRINT | JMP | PRDONE | DON'PRINT |
| 0423 | 78 | NOFAIL | LIS | H'8' | |
| 0424 | F0 | . | NS | 0 | TOT OR ST LAST? |
| 0425 | 8404 042A | . | BZ | NOADV | NO |
| 0427 | 2805D6 05D6 | . | PI | ADV9 | TAKE UP PAPER SLACK |
| 042A | 71 | NOADV | LIS | 1 | |
| 042B | 54 | . | LR | 4,A | INIT LINE COUNTER |
| 042C | 70 | . | CLR | | |
| 042D | 53 | . | LR | 3,A | INIT DOT COL CNTR |
| 042E | 65 | PASS | LISU | 5 | |
| 042F | 68 | . | LISL | 0 | PRINT BUFFER |
| 0430 | 70 | . | CLR | | |
| 0431 | C3 | . | AS | 3 | GET DOT COL DATA |
| 0432 | 52 | . | LR | 2,A | |
| 0433 | 71 | . | LIS | 1 | 1ST DOT |
| 0434 | 8405 043A | . | BZ | COLDATA | MAKE DOT SELECT BIT |
| 0436 | 13 | ADJCOL | SL | 1 | |
| 0437 | 32 | . | DS | 2 | TO CORRECT BIT YES? |
| 0438 | 94FD 0436 | . | BNZ | ADJCOL | |
| 043A | 52 | COLDATA | LR | 2,A | SAVE DOT ENABL DATA |
| 043B | 75 | . | LIS | 5 | SEND DOT SELECT DATA |
| 043C | 51 | . | LR | 1,A | |
| 043D | 71 | DOTDATA | LIS | 1 | GET DATA FOR DOTS |
| 043E | F2 | . | NS | 2 | THIS DOT ACTIVE? |
| 043F | 2804E8 04E8 | . | PI | SENDOT | |
| 0442 | 42 | . | LR | A,2 | |
| 0443 | 12 | . | SR | 1 | |
| 0444 | 52 | . | LR | 2,A | SAVE REMAINING DOT DATA |
| 0445 | 31 | . | DS | 1 | ALL DOTS OUT? |
| 0446 | 94F6 043D | . | BNZ | DOTDATA | NO |
| 0448 | 4C | CHARS | LR | A,S | GET CHAR CODE |
| 0449 | 14 | . | SR | 4 | CHAR TO BE ADJUSTED? |
| 044A | 4C | . | LR | A,S | |
| 044B | 8406 0452 | . | BZ | NOADJ | |
| 044D | 15 | . | SL | 4 | |
| 044E | 2402 | . | AI | H'02' | CODE + 02 = LOC |
| 0450 | 9004 0455 | . | BR | LOOKUP | |
| 0452 | 15 | NOADJ | SL | 4 | |
| 0453 | 240A | . | AI | H'0A' | CODE + 0A = LOC |
| 0455 | 1A | LOOKUP | DI | | |
| 0456 | C3 | . | AS | 3 | ADD DOT CTR |
| 0457 | 07 | . | LR | QL,A | LOW ADDR DATA |
| 0458 | 0F | . | LR | DC,Q | DATA ADDRESS |
| 0459 | 44 | . | LR | A,4 | LINE CTR |
| 045A | 51 | . | LR | 1,A | TEMP CTR |
| 045B | 16 | . | LM | . | GET DATA |
| 045C | 1B | . | EI | | |
| 045D | 12 | SHFTR | SR | 1 | |
| 045E | 31 | . | DS | 1 | DONE ADJUSTMENT? |
| 045F | 94FD 045D | . | BNZ | SHFTR | |
| 0461 | 2101 | . | NI | H'01' | IS DOT TO BE ON? |
| 0463 | 2804E8 04E8 | . | PI | SENDOT | |
| 0466 | 0A | . | LR | A,IS | |
| 0467 | 1F | . | INC | | |
| 0468 | 0B | . | LR | IS,A | NEXT CHAR LOC |
| 0469 | 2533 | . | CI | 0'63' | ALL DATA OUTPUT? |
| 046B | 94DC 0448 | . | BNZ | CHARS | NO |
| 046D | A5 | . | INS | 5 | |
| 046E | 2208 | . | OI | H'08' | |
| 0470 | B5 | . | OUTS | 5 | STROBE PRINTER |
| 0471 | 21F7 | . | NI | H'F7' | |
| 0473 | B5 | . | OUTS | 5 | |
| 0474 | 20FF | . | LI | H'FF' | SET FOR 15 MSEC |
| 0476 | 51 | . | LR | 1,A | |
| 0477 | A0 | TIME15 | INS | 0 | TIME APPROX 15 MSEC |
| 0478 | 810F 0488 | . | BP | STRBOFF | LOCK OUT GONE |
| 047A | 20FA | . | LI | H'FA' | |
| 047C | 1F | SLO | INC | . | SLOW DOWN LOOP |

APPENDIX A-continued

Resident Firmware Listing

| Loc | Object | Label | Mnemonic | | Comment |
|---|---|---|---|---|---|
| 047D | 92FE 047C | . | BNC | SLO | |
| 047F | 31 | . | DS | 1 | |
| 0480 | 94F6 0477 | . | BNZ | TIME15 | |
| 0482 | 40 | . | LR | A,0 | PRINT FAILURE |
| 0483 | 2240 | . | OI | H'40' | |
| 0485 | 50 | . | LR | 0,A | SAVE PRNT FAIL FLAG |
| 0486 | 9027 04AE | . | BR | PRDONE | ABORT PRINT CYCLE |
| 0488 | A5 | STRBOFF | INS | 5 | |
| 0489 | 2204 | . | OI | H'04' | |
| 048B | B5 | . | OUTS | 5 | RESET SHIFT REG |
| 048C | 21FB | . | NI | H'FB' | |
| 048E | B5 | . | OUTS | 5 | |
| 048F | 43 | . | LR | A,3 | |
| 0490 | 1F | . | INC | . | NXT DOT DATA |
| 0491 | 2505 | . | CI | H'05' | DONE THIS LINE? |
| 0493 | 9411 04A5 | . | BNZ | NDOT | |
| 0495 | 2060 | . | LI | H'60' | |
| 0497 | 1F | COOL | INC | . | 2 MSEC TO COOL HEAD |
| 0498 | 92FE 0497 | . | BNC | COOL | |
| 049A | 2805DA 05DA | . | PI | ADV1 | |
| 049D | 44 | . | LR | A,4 | |
| 049E | 1F | . | INC | . | NEXT ROW |
| 049F | 2508 | . | CI | H'08' | DONE? |
| 04A1 | 8406 04A8 | . | BZ | DONE | |
| 04A3 | 54 | . | LR | 4,A | SAVE LINE CTR |
| 04A4 | 70 | . | CLR | . | INIT DOT DATA |
| 04A5 | 53 | NDOT | LR | 3,A | |
| 04A6 | 9087 042E | . | BR | PASS | |
| 04A8 | 2805DA 05DA | DONE | PI | ADV1 | |
| 04AB | 2805DA 05DA | . | PI | ADV1 | |
| 04AE | A5 | PRDONE | INS | 5 | |
| 04AF | 2204 | . | OI | H'04' | |
| 04B1 | B5 | | OUTS | 5 | RESET SHIFT REG |
| 04B2 | 21FD | . | NI | H'FD' | |
| 04B4 | B5 | . | OUTS | 5 | |
| 04B5 | 40 | . | LR | A,0 | FLAG FOR TOT OR ST |
| 04B6 | 21F7 | . | NI | H'F7' | |
| 04B8 | 50 | . | LR | 0,A | SAVE NO TOT OR ST |
| 04B9 | 45 | . | LR | A,5 | |
| 04BA | 2520 | . | CI | H'20' | CLEAR KEY? |
| 04BC | 8425 04E1 | . | BZ | ONEL | SET FLAG TO ADV 1 LINE |
| 04BE | 2540 | CHKST | CI | H'40' | PRINTING SUB TOT? |
| 04C0 | 76 | . | LIS | 6 | FLAG FOR NO DISP |
| 04C1 | 841D 04DF | . | BZ | DFLAG | YES - SKIP 1 LINE |
| 04C3 | 45 | . | LR | A,5 | GET KEY CODE |
| 04C4 | 2541 | . | CI | H'41' | PRINTING TOTAL? |
| 04C6 | 941F 04E6 | . | BNZ | NOL | NO |
| 04C8 | A0 | TWOL | INS | 0 | PRINTING TOTAL |
| 04C9 | 2140 | . | NI | H'40' | ADV PAPER ON TOTAL? |
| 04CB | 8404 04DO | . | BZ | N6LINES | NO |
| 04CD | 2805CD 05CD | . | PI | ADV59 | ADV PAPER 6.5 LINES |
| 04DO | 2806EE 06EE | N6LINES | PI | CLRTOT | |
| 04D3 | 72 | . | LIS | 2 | |
| 04D4 | F1 | . | NS | 1 | WAS OVFL BIT ON? |
| 04D5 | 76 | . | LIS | 6 | IF SO NO DISPENSE ON TOT |
| 04D6 | 9408 04DF | . | BNZ | DFLAG | |
| 04D8 | A0 | . | INS | 0 | |
| 04D9 | 2130 | . | NI | H'30' | PRINT TOT DISP 99? |
| 04DB | 74 | . | LIS | 4 | DISP 499 ON TOT FLAG |
| 04DC | 8402 04DF | . | BZ | DFLAG | DISP 499 AND $1 MAGAZINE |
| 04DE | 75 | . | LIS | 5 | DISP 99 ON TOT FLAG |
| 04DF | 63 | DFLAG | LISU | 3 | |
| 04E0 | 6D | . | LISL | 5 | DISP FLAG LOC |
| 04E1 | 5C | . | LR | S,A | SAVE FLAG |
| 04E2 | 40 | ONEL | LR | A,0 | SAVE TOT OR ST FLAG |
| 04E3 | 2208 | . | OI | H'08' | |

APPENDIX A-continued

Resident Firmware Listing

| Loc | Object | Label | Mnemonic | | Comment |
|---|---|---|---|---|---|
| 04E5 | 50 | . | LR | 0,A | |
| 04E6 | 901C 0503 | NOL | BR | NODISP | DONE PRINT |
| 04E8 | 08 | SENDOT | LR | K,P | SAVE RETURN ADDR |
| 04E9 | 8406 04F0 | . | BZ | NODOT | DOT NOT ACTIVE |
| 04EB | A5 | . | INS | 5 | |
| 04EC | 21FE | . | NI | H'FE' | INSERT DOT ACTIVE SIG |
| 04EE | 9004 04F3 | . | BR | SEND | |
| 04F0 | A5 | NODOT | INS | 5 | |
| 04F1 | 2201 | . | OI | H'01' | NO DOT THIS LOC |
| 04F3 | B5 | SEND | OUTS | 5 | SEND DOT DATA |
| 04F4 | 21FD | . | NI | H'FD' | SHIFT PULSE |
| 04F6 | B5 | . | OUTS | 5 | |
| 04F7 | 2203 | . | OI | H'03 | CLR DOT & SHIFT |
| 04F9 | B5 | . | OUTS | 5 | |
| 04FA | 0C | . | PK | | |
| 04FB | 08 | DISPENSE | LR | K,P | |
| 04FC | 70 | . | CLR | | |
| 04FD | 52 | . | LR | 2,A | CLEAR DOLLAR CTR |
| 04FE | 2032 | . | LI | H'32' | DISP FAIL OR OVFL |
| 0500 | F0 | . | NS | 0 | OR FILL BIT ON? |
| 0501 | 8405 0507 | . | BZ | DODISP | NOT IN FILL CONDITION |
| 0503 | 1B | NODISP | EI | | |
| 0504 | 290000 0000 | . | JMP | KEYDONE | |
| 0507 | 63 | DODISP | LISU | 3 | |
| 0508 | 6D | . | LISL | 5 | |
| 0509 | 4C | . | LR | A,S | |
| 050A | 62 | . | LISU | 2 | |
| 050B | 6A | . | LISL | 2 | |
| 050C | 2502 | . | CI | 2 | 100C SPLIT CHG? |
| 050E | 9405 0514 | . | BNZ | CHK25 | NO |
| 0510 | 20F8 | . | LI | H'F8' | 100C SPLIT CHG DATA |
| 0512 | 901A 052D | . | BR | SVBITS | |
| 0514 | 2501 | CHK25 | CI | 1 | 25C SPLIT CHG? |
| 0516 | 2308 | . | LI | H'38' | 25C SPLIT CHG DATA |
| 0518 | 8414 052D | . | BZ | SVBITS | |
| 051A | 4E | . | LR | A,D | GET DOLL DIG BACK |
| 051B | 250A | NZ | CI | H'0A' | BLANK CODE? |
| 051D | 9402 0520 | . | BNZ | NOBLK | NO |
| 051F | 70 | . | CLR | | |
| 0520 | 52 | NOBLK | LR | 2,A | SAVE DOLLAR COUNT |
| 0521 | 1A | . | DI | | |
| 0522 | 4E | . | LR | A,D | GET 10C DIGIT |
| 0523 | 15 | . | SL | 4 | |
| 0524 | CC | . | AS | S | ADD 1 CENT DIGIT |
| 0525 | 07 | . | LR | QL,A | LOOKUP LO |
| 0526 | 9404 052B | . | BNZ | NOTZRO | NOT '00' |
| 0528 | C2 | . | AS | 2 | DOLLAR COUNT ALSO 0? |
| 0529 | 84D9 0503 | . | BZ | NODISP | NOTHING TO DISP |
| 052B | 0F | NOTZRO | LR | DC,Q | |
| 052C | 16 | . | LM | . | GET LOOK UP DATA |
| 052D | 1B | SVBITS | EI | | |
| 052E | 51 | . | LR | 1,A | SOLENOID DATA BITS |
| 052F | 79 | . | LIS | H'9' | NINE BITS OF DATA |
| 0530 | 53 | . | LR | 3,A | |
| 0531 | 9004 0536 | . | BR | FRSTBIT | DO FIRST BIT |
| 0533 | 41 | NXTBIT | LR | A,1 | |
| 0534 | 12 | . | SR | 1 | ADJ BIT DATA |
| 0535 | 51 | . | LR | 1,A | |
| 0536 | 71 | FRSTBIT | LIS | 1 | |
| 0537 | F1 | . | NS | 1 | GET BIT INFO |
| 0538 | 8406 053F | . | BZ | NOTON | NO BIT IN THIS LOC |
| 053A | A5 | INSERT | INS | 5 | |
| 053B | 21FE | . | NI | H'FE' | INSERT BIT ACTIVE |
| 053D | 9004 0542 | . | BR | SENDIT | |
| 053F | A5 | NOTON | INS | 5 | |
| 0540 | 2201 | . | OI | H'01' | NO BIT THIS TIME |
| 0542 | B5 | SENDIT | OUTS | 5 | |
| 0543 | 21FD | . | NI | H'FD' | |
| 0545 | B5 | . | OUTS | 5 | SHIFT |
| 0546 | 2203 | . | OI | H'03' | RESET DATA AND SHIFT |
| 0548 | B5 | . | OUTS | 5 | |
| 0549 | 33 | . | DS | 3 | |

APPENDIX A-continued

Resident Firmware Listing

| Loc | Object | Label | Mnemonic | | Comment |
|---|---|---|---|---|---|
| 054A | 8418 0563 | . | BZ | DATAOUT | ALL DATA SENT |
| 054C | 43 | . | LR | A,3 | |
| 054D | 2501 | . | CI | H'01' | TIME TO DO DOLLAR? |
| 054F | 94E3 0533 | . | BNZ | NXTBIT | |
| 0551 | A0 | . | INS | 0 | |
| 0552 | 2110 | . | NI | H'10' | DOLLAR MAGAZINE? |
| 0554 | 8407 055C | . | BZ | DOLLAR | YES |
| 0556 | 70 | . | CLR | | |
| 0557 | C1 | . | AS | 1 | DOUBLE QUART BIT ON? |
| 0558 | 84E6 053F | . | BZ | NOTON | NO THIRD QUARTER |
| 055A | 90DF 053A | . | BR | INSERT | ACTIVATE THIRD QUARTER |
| 055C | 70 | DOLLAR | CLR | | |
| 055D | C2 | . | AS | 2 | ANY DOLLARS? |
| 055E | 84E0 053F | . | BZ | NOTON | NO |
| 0560 | 32 | . | DS | 2 | DEC DOLLAR CNT |
| 0561 | 90D8 053A | . | BR | INSERT | |
| 0563 | 63 | DATAOUT | LISU | 3 | |
| 0564 | 6E | CHKLOCK | LISL | 6 | |
| 0565 | 70 | . | CLR | | |
| 0566 | CD | . | AS | I | IS R 36 = 0? |
| 0567 | 94FC 0564 | . | BNZ | CHKLOCK | NO |
| 0569 | CE | . | AS | D | IS R37 ALSO = 0? |
| 056A | 94F9 0564 | . | BNZ | CHKLOCK | NO |
| 056C | A5 | . | INS | 5 | |
| 056D | 2210 | . | OI | H'10' | |
| 056F | B5 | . | OUTS | 5 | STROBE SOLENOIDS |
| 0570 | 21EF | . | NI | H'EF' | |
| 0572 | B5 | . | OUTS | 5 | RESET STROBE |
| 0573 | 78 | . | LIS | 8 | |
| 0574 | 51 | . | LR | 1,A | |
| 0575 | 1F | TIME25 | INC | . | DELAY FOR 25 MSEC |
| 0576 | 92FE 0575 | . | BNC | TIME25 | |
| 0578 | 31 | . | DS | 1 | |
| 0579 | 94FB 0575 | . | BNZ | TIME25 | |
| 057B | A5 | . | INS | 5 | |
| 057C | 21DF | . | NI | H'DF' | START PAYMENT CYCLE |
| 057E | B5 | . | OUTS | 5 | |
| 057F | 2066 | . | LI | H'66' | |
| 0581 | 51 | . | LR | 1,A | |
| 0582 | 70 | TIM | CLR | | |
| 0583 | 1F | TIME | INC | . | TIME PAYMENT CYCLE |
| 0584 | 92FE 0583 | . | BNC | TIME | 320 MSEC MAX |
| 0586 | A0 | . | INS | 0 | LOCK OUT GONE? |
| 0587 | 810D 0595 | . | BP | LODONE | YES |
| 0589 | 31 | . | DS | 1 | |
| 058A | 94F7 0582 | . | BN2 | TIM | OVER 300 MSEC |
| 058C | 40 | . | LR | A,0 | YES = FAILURE |
| 058D | 2140 | . | NI | H'40' | PRNTR ALREADY FAILED? |
| 058F | 9405 0595 | . | BNZ | LODONE | DON'T TIME LOCK OUT |
| 0591 | 40 | . | LR | A,0 | |
| 0592 | 2210 | . | OI | H'10' | DISP FAIL FLAG |
| 0594 | 50 | . | LR | 0,A | SAVE DISPENSE FAILURE |
| 0595 | A5 | LODONE | INS | 5 | |
| 0596 | 2224 | . | OI | H'24' | RESET PAYMENT CYCLE |
| 0598 | B5 | . | OUTS | 5 | AND SHIFT REG |
| 0599 | 63 | . | LISU | 3 | |
| 059A | 6E | . | LISL | 6 | |
| 059B | 73 | . | LIS | 3 | |
| 059C | 5D | . | LR | I,A | SET UP 600 MSEC |
| 059D | 2050 | . | LI | H'50' | DISPENSE LOCK OUT |
| 059F | 5E | . | LR | D,A | |
| 05A0 | 4C | DLY64 | LR | A,S | GET R 36 |
| 05A1 | 2503 | . | CI | H'03' | DELAY FOR 64 MSEC |
| 05A3 | 84FC 05A0 | . | BZ | DYL64 | FOR HARDWARE |
| 05A5 | A5 | . | INS | 5 | |
| 05A6 | 21FB | . | NI | H'FB' | REMOVE RESET |
| 05A8 | B5 | . | OUTS | 5 | FROM SHIFT REG |
| 05A9 | A0 | . | INS | 0 | |
| 05AA | 2110 | . | NI | H'10' | USING $1 MAGAZINE |
| 05AC | 9407 05B4 | . | BNZ | DDONE | |

APPENDIX A-continued

Resident Firmware Listing

| Loc | Object | Label | Mnemonic | | Comment |
|---|---|---|---|---|---|
| 05AE | 71 | CHKDOL | LIS | 1 | |
| 05AF | 53 | . | LR | 3,A | PASS CTR FOR SHIFT |
| 05B0 | 70 | . | CLR | | |
| 05B1 | C2 | . | AS | 2 | ANY MORE $1? |
| 05B2 | 94A9 055C | . | BNZ | DOLLAR | |
| 05B4 | 67 | DDONE | LISU | 7 | |
| 05B5 | 6D | . | LISL | 5 | |
| 05B6 | 4C | CHKD | LR | A,S | CHECK KEY STACK |
| 05B7 | 250D | . | CI | H'0D' | FOR DISP KEYS |
| 05B9 | 9402 05BC | . | BNZ | NOTD | |
| 05BB | 78 | . | LIS | 8 | NO ACTION CODE |
| 05BC | 5E | . | LR | D,A | |
| 05BD | 8FF8 05B6 | . | BY7 | CHKD | |
| 05BF | 63 | . | LISU | 3 | |
| 05C0 | 6D | . | LISL | 5 | |
| 05C1 | 4C | . | LR | A,S | |
| 05C2 | 2501 | . | CI | H'01' | SPLIT QUARTER FLAG? |
| 05C4 | 8406 05CB | . | BZ | SVEFLG | YES |
| 05C6 | 2502 | . | CI | H'02' | SPLT DOLLAR FLAG? |
| 05C8 | 8402 05CB | . | BZ | SVEFLG | KEEP SPLIT CHG FLAT |
| 05CA | 73 | . | LIS | 3 | SUCCESSIVE DISP CODE |
| 05CB | 5C | SVEFLG | LR | S,A | TO R 35 |
| 05CC | 0C | OUTD | PK | | |
| 05CD | 08 | ADV59 | LR | K,P | |
| 05CE | 40 | . | LR | A,0 | |
| 05CF | 2208 | . | OI | H'08' | SET ADV1 FLAG |
| 05D1 | 50 | . | LR | 0.A | |
| 05D2 | 203B | . | LI | D'59' | 59 LINES |
| 05D4 | 9007 05DC | . | BR | SVNO | |
| 05D6 | 08 | ADV9 | LR | K,P | |
| 05D7 | 79 | . | LIS | 9 | 9 LINES |
| 05D8 | 9003 05DC | . | BR | SVNO | |
| 05DA | 08 | ADV1 | LR | K,P | |
| 05DB | 71 | . | LIS | 1 | 1 DOT LINE |
| 05DC | 51 | SVNO | LR | 1,A | SAVE # LINES TO ADV |
| 05DD | 40 | . | LR | A,0 | |
| 05DE | 21C0 | . | NI | H'C0' | CHK PRINT FAIL FLAG |
| 05E0 | 942C 060D | . | BNZ | ADVOUT | AND PRINTER OFF BIT |
| 05E2 | A5 | ADV | INS | 5 | |
| 05E3 | 2240 | . | OI | H'40' | PHASE 1 HI |
| 05E5 | B5 | . | OUTS | 5 | |
| 05E6 | 7A | . | LIS | H'A' | |
| 05E7 | 1F | INC1 | INC | . | DLAY 4 MS |
| 05E8 | 9001 05EA | . | BR | SLO1 | |
| 05EA | 92FC 05E7 | SLO1 | BNC | INC1 | |
| 05EC | A5 | . | INS | 5 | |
| 05ED | 217F | . | NI | H'7F' | PHASE 2 LO |
| 05EF | B5 | . | OUTS | 5 | |
| 05F0 | 7A | . | LIS | H'A' | |
| 05F1 | 1F | INC2 | INC | . | DLAY 4 MS |
| 05F2 | 9001 05F4 | . | BR | SLO2 | |
| 05F4 | 92FC 05F1 | SLO2 | BNC | INC2 | |
| 05F6 | A5 | . | INS | 5 | |
| 05F7 | 21BF | . | NI | H'BF' | PHASE 1 LO |
| 05F9 | B5 | . | OUTS | 5 | |
| 05FA | 7A | . | LIS | H'A' | |
| 05FB | 1F | INC3 | INC | . | DLAY 4 MS |
| 05FC | 9001 05FE | . | BR | SLO3 | |
| 05FE | 92FC 05FB | SLO3 | BNC | INC3 | |
| 0600 | A5 | . | INS | 5 | |
| 0601 | 2280 | . | OI | H'80'PHASE 2 HI | |
| 0603 | B5 | . | OUTS | 5 | |
| 0604 | 7A | . | LIS | H'A' | |
| 0605 | 1F | INC4 | INC | | DLAY 4 MS |
| 0606 | 9001 0608 | . | BR | SLO4 | |
| 0608 | 92FC 0605 | SLO4 | BNC | INC4 | |
| 060A | 31 | . | DS | 1 | FINISHED ADVANCING? |
| 060B | 94D6 05E2 | . | BNZ | ADV | NO |
| 060D | OC | ADVOUT | PK | | |
| 060E | 66 | REMOTE | LISU | 6 | |
| 060F | 6E | . | LISL | 6 | REMOTE DATA LOC |

APPENDIX A-continued

Resident Firmware Listing

| Loc | Object | Label | Mnemonic | | Comment |
|---|---|---|---|---|---|
| 0610 | 4D | . | LR | A,I | GET REMOTE DATA |
| 0611 | 18 | . | COM | . | COMPLEMENT DATA |
| 0612 | 14 | . | SR | 4 | GET 4 BITS OF DATA |
| 0613 | 54 | . | LR | 4,A | SAVE |
| 0614 | 250F | . | CI | H'OF' | REMOTE PROMPT? |
| 0616 | 940B 0622 | . | BNZ | REM1 | NO |
| 0618 | 20FF | . | LI | H'FF' | |
| 061A | 5C | . | LR | S,A | R67 = FF (PROMPT FOUND) |
| 061B | 6D | . | LISL | 5 | |
| 061C | 5E | . | LR | D,A | R65 = FF |
| 061D | 5E | . | LR | D,A | R64 |
| 061E | 5C | . | LR | S,A | R63 |
| 061F | 2906C9 06C9 | JRT | JMP | ROUT | BUFFER CLEARED |
| 0622 | 4C | REM1 | LR | A,S | |
| 0623 | 1F | . | INC | . | IS R 67 = FF? |
| 0624 | 6B | . | LISL | 3 | |
| 0625 | 92F9 061F | . | BNC | JRT | NO (TO ROUT) |
| 0627 | 44 | . | LR | A,4 | |
| 0628 | 250B | . | CI | H'0B' | SPLIT CHG 1 DOLLAR? |
| 062A | 9408 0633 | . | BNZ | REM30 | NO |
| 062C | 70 | . | CLR | | |
| 062D | 5D | . | LR | I,A | R 63 = 0 |
| 062E | 5D | . | LR | I,A | R 64 = 0 |
| 062F | 7B | . | LIS | H'B' | |
| 0630 | 5D | . | LR | I,A | R65 = B |
| 0631 | 90ED 061F | . | BR | JRT | (TO ROUT) |
| 0633 | 250C | REM30 | CI | H'OC' | 25C SPLIT CHG? |
| 0635 | 9409 063F | . | BNZ | REM2 | NO |
| 0637 | 75 | . | LIS | 5 | |
| 0638 | 5D | . | LR | I,A | 5 TO R 63 |
| 0639 | 72 | . | LIS | 2 | |
| 063A | 5D | . | LR | I,A | 2 TO R 64 |
| 063B | 7C | . | LIS | H'C' | |
| 063C | 5C | . | LR | S,A | 25C SPLIT TO R 65 |
| 063D | 90E1 061F | . | BR | JRT | TO ROUT |
| 063F | 250A | REM2 | CI | H'0A' | DISPENSE CODE? |
| 0641 | 8404 0646 | . | BZ | REM5 | |
| 0643 | 2906D1 06D1 | . | JMP | REM3 | NO |
| 0646 | AO | REM5 | INS | O | |
| 0647 | 2101 | . | NI | H'01' | FILL CONDITION |
| 0649 | 947F 06C9 | . | BNZ | ROUT | YES |
| 064B | 63 | . | LISU | 3 | |
| 064C | 6E | . | LISL | 6 | CHECK FOR LOCK OUT |
| 064D | CD | . | AS | I | R 36 = 0? |
| 064E | . | BNZ | JRT | NO | |
| 94DO | | | | | |
| 061F | | | | | |
| 0650 | CC | . | AS | S | R 37 = 0? |
| 0651 | 94CD 061F | . | BNZ | JRT | |
| 0653 | 66 | . | LISU | 6 | |
| 0654 | 6B | . | LISL | 3 | |
| 0655 | 4C | . | LR | A,S | ANY DATA RECEIVED? |
| 0656 | 1F | . | INC | | R 63 = EMPTY? |
| 0657 | 82C7 061F | . | BC | JRT | YES (TO ROUT) |
| 0659 | 6D | REMD | LISL | 5 | |
| 065A | 4C | . | LR | A,S | |
| 065B | 250B | . | CI | H'OB' | $1 SPLIT CHANGE? |
| 065D | 9408 0666 | . | BNZ | CHK25C | NO |
| 065F | 71 | . | LIS | 1 | |
| 0660 | 5D | . | LR | I,A | 1 TO R 65 |
| 0661 | 70 | . | CLR | | |
| 0662 | 5C | . | LR | S,A | CLR R 66 |
| 0663 | 72 | . | LIS | 2 | DISP $1 SPLIT CODE |
| 0664 | 9018 067D | . | BR | SVCODE | SAVE $1 DISP CODE |
| 0666 | 250C | CHK25C | CI | H'OC' | 25C SPLIT CHG? |
| 0668 | 9407 0670 | . | BNZ | FIND | NO |
| 066A | 70 | . | CLR | | |
| 066B | 5D | . | LR | I,A | ZERO TO R65 |
| 066C | 5D | . | LR | I,A | AND R 66 |
| 066D | 71 | . | LIS | 1 | 25 C SPLIT CODE |
| 066E | 900E 067D | . | BR | SVCODE | |
| 0670 | 6C | FIND | LISL | 4 | |
| 0671 | 4D | FND | LR | A,I | |

APPENDIX A-continued

Resident Firmware Listing

| Loc | Object | Label | Mnemonic | | Comment |
|---|---|---|---|---|---|
| 0672 | 25FF | . | CI | H'FF' | FIND FIRST BLANK |
| 0674 | 8403 0678 | . | BZ | NOD | |
| 0676 | 8FFA 0671 | . | BR7 | FND | |
| 0678 | 4E | NOD | LR | A,D | ADJ ISAR |
| 0679 | 70 | . | CLR | | |
| 067A | 5D | ZFILL | LR | I,A | CLEAR OTHER BYTES |
| 067B | 8FFE 067A | . | BR7 | ZFILL | |
| 067D | 63 | SVCODE | LISU | 3 | |
| 067E | 6D | . | LISL | 5 | DISP CODE |
| 067F | 5C | . | LR | S,A | |
| 0680 | 62 | DODSP | LISU | 2 | |
| 0681 | 6F | . | LISL | 7 | DISP BUFF |
| 0682 | 7A | . | LIS | H'A' | BLANK |
| 0683 | 5D | BLKB | LR | I,A | BLANK K.B. |
| 0684 | 8FFE 0683 | . | BR7 | BLKB | |
| 0686 | 66 | . | LISU | 6 | |
| 0687 | 6B | . | LISL | 3 | |
| 0688 | 4C | MVRDATA | A,S | GET REMOTE DATA | |
| 0689 | 51 | . | LR | 1,A | SAVE |
| 068A | OA | . | LR | A,IS | |
| 068B | 241D | . | AI | 0'35' | ADJ TO K.B.LOC |
| 068D | OB | . | LR | IS,A | |
| 068E | 41 | . | LR | A,1 | |
| 068F | 5C | . | LR | S,A | SAVE K.B. DATA |
| 0690 | OA | . | LR | A,IS | |
| 0691 | 2424 | . | AI | 0'44' | ADJ BACK TO REM DATA |
| 0693 | OB | . | LR | IS,A | |
| 0694 | 8FF3 0688 | . | BR7 | MVRDATA | |
| 0696 | 62 | . | LISU | 2 | |
| 0697 | AO | . | INS | O | |
| 0698 | 2110 | . | NI | H'10' | DOLLAR MAGAZINE |
| 069A | 6A | . | LISL | 2 | |
| 069B | 4C | . | LR | A,S | GET DOLLAR DIGIT |
| 069C | 840C 06A9 | . | BZ | DLLR | DOLLAR MAGAZINE |
| 069E | 68 | . | LISL | O | |
| 069F | 4D | . | LR | A,I | |
| 06A0 | CD | . | AS | I | |
| 06A1 | 70 | . | CLR | | |
| 06A2 | 940C 06AF | . | BNZ | SVDIG | CENTS NOT = 0 |
| 06A4 | 4C | . | LR | A,S | |
| 06A5 | 2101 | . | NI | H'01' | |
| 06A7 | 9007 06AF | . | BR | SVDIG | |
| 06A9 | 2504 | DLLR | CI | H'04' | OVER 4? |
| 06AB | 8103 06AF | . | BP | SVDIG | NO |
| 06AD | 24FB | . | AI | H'FB' | ADJ TO ]4 |
| 06AF | 5C | SVDIG | LR | S,A | SAVE DOLLAR DIG |
| 06B0 | 2806EE 06EE | . | PI | CLRTOT | |
| 06B3 | 40 | . | LR | A,O | |
| 06B4 | 220C | . | OI | H'OC' | SENT ENT & ADV BITS |
| 06B6 | 50 | . | LR | O,A | |
| 06B7 | 2804FB 04FB | PI | DISPENSE | | |
| 06BA | 63 | . | LISU | 3 | |
| 06BB | 6D | . | LISL | 5 | |
| 06BC | 76 | . | LIS | 6 | NO SUCCESSIVE DISP |
| 06BD | 5C | . | LR | S,A | |
| 06BE | 62 | . | LISU | 2 | |
| 06BF | 6C | . | LISL | 4 | |
| 06C0 | 7B | . | LIS | H'B' | CODE FOR MINUS |
| 06C1 | 5D | MINFILL | LR | I,A | MINUS SIGNS TO TOP |
| 06C2 | 8FFE 06C1 | . | BR7 | MINFILL | HALF OF DISP BUFF |
| 06C4 | 66 | . | LISU | 6 | |
| 06C5 | 70 | . | CLR | | |
| 06C6 | 5E | . | LR | D,A | CLR REMOTE PROMPT |
| 06C7 | 18 | . | COM | | |
| 06C8 | 5C | . | LR | S,A | CLEAR REMOTE DATA |
| 06C9 | 66 | ROUT | LISU | 6 | |

APPENDIX A-continued

Resident Firmware Listing

| Loc | Object | Label | Mnemonic | | Comment |
|---|---|---|---|---|---|
| 06CA | 6E | . | LISL | 6 | |
| 06CB | 20FF | . | LI | H'FF' | |
| 06CD | 5C | . | LR | S,A | CLR REMOTE DATA |
| 06CE | 290000 0000 | . | JMP | KEYDONE | |
| 06D1 | 44 | REM3 | LR | A,4 | |
| 06D2 | 24F6 | . | AI | H'F6' | INVALID CODE? |
| 06D4 | 82F4 06C9 | . | BC | ROUT | YES |
| 06D6 | 6B | . | LISL | 3 | |
| 06D7 | 4D | . | LR | A,I | |
| 06D8 | 25FF | . | CI | H'FF' | R 63 EMPTY? |
| 06DA | 8409 06E4 | . | BZ | STORE | YES |
| 06DC | 4D | . | LR | A,I | R 64 EMPTY? |
| 06DD | 8406 06E4 | . | BZ | STORE | YES |
| 06DF | 4D | . | LR | A,I | |
| 06E0 | 25FF | . | CI | H'ff' | R65 EMPTY? |
| 06E2 | 94E6 06C9 | . | BNZ | ROUT | NO ROOM IN BUFF |
| 06E4 | 6C | STORE | LISL | 4 | |
| 06E5 | 4D | . | LR | A,I | MOVE R 64 TO R 65 |
| 06E6 | 5C | . | LR | S,A | |
| 06E7 | 6B | . | LISL | 3 | |
| 06E8 | 4D | . | LR | A,I | MOVE R63 TO R64 |
| 06E9 | 5E | . | LR | D,A | |
| 06EA | 44 | . | LR | A,4 | |
| 06EB | 5C | . | LR | S,A | SAVE NEW DATA |
| 06EC | 90DC 06C9 | . | BR | ROUT | |
| 06EE | 08 | CLRTOT | LR | K,P | |
| 06EF | 63 | . | LISU | 3 | |
| 06F0 | 6C | . | LISL | 4 | K.B. |
| 06F1 | 70 | . | CLR | | |
| 06F2 | 5E | CK | LR | D,A | CLR K.B. |
| 06F3 | 8FFE 06F2 | . | BR7 | CK | |
| 06F5 | 64 | . | LISU | 4 | |
| 06F6 | 6C | . | LISL | 4 | |
| 06F7 | 5E | CT | LR | D,A | CLR TOT |
| 06F8 | 8FFE 06F7 | . | BR7 | CT | |
| 06FA | 40 | 0533 | LR | A,O | |
| 06FB | 51 | . | LR | 1,A | SAVE STATUS FOR PRINT ROUTI |
| 06FC | 21FD | . | NI | H'FD' | RESET ERROR BIT |
| 06FE | 50 | . | LR | O,A | |
| 06FF | OC | . | PK | | |

APPENDIX B

Look-up Table

| Location | Contents | Character or Function |
|---|---|---|
| 0700 | 00 | Dispense 100¢ |
| 0701 | 01 | 1¢ |
| 0702 | 02 | 2¢ |
| 0703 | 03 | 3¢ |
| 0704 | 06 | 4¢ |
| 0705 | 08 | 5¢ |
| 0706 | 09 | 6¢ |
| 0707 | 0C | 7¢ |
| 0708 | 0D | 8¢ |
| 0709 | 0E | 9¢ |
| 070A | 7C | |
| 070B | A2 | |
| 070C | 92 | Print "0" |
| 070D | 8A | |
| 070E | 7C | |
| 070F | C0 | Display "0" |
| 0710 | 10 | Dispense 10¢ |
| 0711 | 11 | 11¢ |
| 0712 | 12 | 12¢ |
| 0713 | 13 | 13¢ |
| 0714 | 16 | 14¢ |
| 0715 | 18 | 15¢ |
| 0716 | 19 | 16¢ |
| 0717 | 1C | 17¢ |
| 0718 | 1D | 18¢ |
| 0719 | 1E | 19¢ |
| 071A | 00 | |
| 071B | 84 | |

APPENDIX B-continued

Look-up Table

| Location | Contents | Character or Function |
|---|---|---|
| 071C | FE | Print "1" |
| 071D | 80 | |
| 071E | 00 | |
| 071F | F9 | Display "1" |
| 0720 | 30 | Dispense 20¢ |
| 0721 | 31 | 21¢ |
| 0722 | 32 | 22¢ |
| 0723 | 33 | 23¢ |
| 0724 | 36 | 24¢ |
| 0725 | 40 | 25¢ |
| 0726 | 41 | 26¢ |
| 0727 | 44 | 27¢ |
| 0728 | 45 | 28¢ |
| 0729 | 46 | 29¢ |
| 072A | 84 | |
| 072B | C2 | |
| 072C | A2 | Print "2" |
| 072D | 92 | |
| 072E | 8C | |
| 072F | A4 | Display "2" |
| 0730 | 48 | Dispense 30¢ |
| 0731 | 49 | 31¢ |
| 0732 | 4A | 32¢ |
| 0733 | 4B | 33¢ |
| 0734 | 4E | 34¢ |
| 0735 | 60 | 35¢ |
| 0736 | 61 | 36¢ |
| 0737 | 64 | 37¢ |

APPENDIX B-continued

Look-up Table

| Location | Contents | Character or Function |
|---|---|---|
| 0738 | 65 | 38¢ |
| 0739 | 66 | 39¢ |
| 073A | 42 | |
| 073B | 82 | |
| 073C | 8A | Print "3" |
| 073D | 96 | |
| 073E | 62 | |
| 073F | B0 | Display "3" |
| 0740 | 68 | Dispense 40¢ |
| 0741 | 69 | 41¢ |
| 0742 | 6A | 42¢ |
| 0743 | 6B | 43¢ |
| 0744 | 6E | 44¢ |
| 0745 | 70 | 45¢ |
| 0746 | 71 | 46¢ |
| 0747 | 74 | 47¢ |
| 0748 | 75 | 48¢ |
| 0749 | 76 | 49¢ |
| 074A | 30 | |
| 074B | 28 | |
| 074C | 24 | Print "4" |
| 074D | FE | |
| 074E | 20 | |
| 074F | 99 | Display "4" |
| 0750 | 80 | Dispense 50¢ |
| 0751 | 81 | 51¢ |
| 0752 | 82 | 52¢ |
| 0753 | 83 | 53¢ |
| 0754 | 86 | 54¢ |
| 0755 | 88 | 55¢ |
| 0756 | 89 | 56¢ |
| 0757 | 8C | 57¢ |
| 0758 | 8D | 58¢ |
| 0759 | 8E | 59¢ |
| 075A | 4E | |
| 075B | 8A | |
| 075C | 8A | Print "5" |
| 075D | 8A | |
| 075E | 72 | |
| 075F | 92 | Display "5" |
| 0760 | 90 | Dispense 60¢ |
| 0761 | 91 | 61¢ |
| 0762 | 92 | 62¢ |
| 0763 | 93 | 63¢ |
| 0764 | 96 | 64¢ |
| 0765 | 98 | 65¢ |
| 0766 | 99 | 66¢ |
| 0767 | 9C | 67¢ |
| 0768 | 9D | 68¢ |
| 0769 | 9E | 69¢ |
| 076A | 78 | |
| 076B | 94 | |
| 076C | 92 | Print "6" |
| 076D | 92 | |
| 076E | 60 | |
| 076F | 82 | Display "6" |
| 0770 | B0 | Dispense 70¢ |
| 0771 | B1 | 71¢ |
| 0772 | B2 | 72¢ |
| 0773 | B3 | 73¢ |
| 0774 | B6 | 74¢ |
| 0775 | B8 | 75¢ |
| 0776 | C1 | 76¢ |
| 0777 | C4 | 77¢ |
| 0778 | C5 | 78¢ |
| 0779 | C6 | 79¢ |
| 077A | 02 | |
| 077B | E2 | |
| 077C | 12 | Print "7" |
| 077D | 0A | |
| 077E | 06 | |
| 077F | F8 | Display "7" |
| 0780 | C8 | Dispense 80¢ |
| 0781 | C9 | 81¢ |
| 0782 | CA | 82¢ |
| 0783 | CB | 83¢ |
| 0784 | CE | 84¢ |
| 0785 | E0 | 85¢ |

APPENDIX B-continued

Look-up Table

| Location | Contents | Character or Function |
|---|---|---|
| 0786 | E1 | 86¢ |
| 0787 | E4 | 87¢ |
| 0788 | E5 | 88¢ |
| 0789 | E6 | 89¢ |
| 078A | 60 | |
| 078B | 92 | |
| 078C | 92 | Print "8" |
| 078D | 92 | |
| 078E | 6C | |
| 078F | 80 | Display "8" |
| 0790 | E8 | Dispense 90¢ |
| 0791 | E9 | 91¢ |
| 0792 | EA | 92¢ |
| 0793 | EB | 93¢ |
| 0794 | EE | 94¢ |
| 0795 | F0 | 95¢ |
| 0796 | F1 | 96¢ |
| 0797 | F4 | 97¢ |
| 0798 | F5 | 98¢ |
| 0799 | F6 | 99¢ |
| 079A | 0C | |
| 079B | 92 | |
| 079C | 92 | Print "9" |
| 079D | 92 | |
| 079E | 7C | |
| 079F | 90 | Display "9" |
| 07A0 | | |
| . | | |
| . | | |
| 07A9 | | |
| 07AA | 00 | |
| 07AB | 00 | |
| 07AC | 00 | Print "Space" |
| 07AD | 00 | |
| 07AE | 00 | |
| 07AF | FF | Display Blank |
| 07B0 | | |
| 07B1 | | |
| 07B2 | 10 | |
| 07B3 | 10 | |
| 07B4 | 7C | Print "+" |
| 07B5 | 10 | |
| 07B6 | 10 | |
| 07B7 | | |
| 07B8 | | |
| 07B9 | | |
| 07BA | 10 | |
| 07BB | 10 | |
| 07BC | 10 | Print "−" |
| 07BD | 10 | |
| 07BE | 10 | |
| 07BF | BF | Display "−" |
| 07C0 | | |
| 07C1 | | |
| 07C2 | 8C | |
| 07C3 | 92 | |
| 07C4 | 92 | Print "S" |
| 07C5 | 92 | |
| 07C6 | 62 | |
| 07C7 | | |
| 07C8 | | |
| 07C9 | | |
| 07CA | 02 | |
| 07CB | 02 | |
| 07CC | FE | Print "T" |
| 07CD | 02 | |
| 07CE | 02 | |
| 07CF | C0 | |
| 07D0 | C7 | Display "L" |
| 07D1 | | |
| . | | |
| 07D7 | | No Action Necessary |
| 07D8 | 80 | |
| 07D9 | 0 | |
| 07DA | 1 | |
| 07DB | 4 | |
| 07DC | 7 | |
| 07DD | 44 | Dispense |

APPENDIX B-continued

Look-up Table

| Location | Contents | Character or Function |
|---|---|---|
| 07DE | 40 | SUBTOTAL |
| 07DF | 42 | PADV |
| 07E0 | | |
| 07E1 | 10 | "00" |
| 07E2 | 2 | |
| 07E3 | 5 | |
| 07E4 | 8 | |
| 07E5 | 22 | (−) |
| 07E6 | 41 | TOT |
| . | | |
| . | | |
| 07E9 | | |
| 07EA | FE | |
| 07EB | 92 | |
| 07EC | 92 | Print "E" |
| 07ED | 92 | |
| 07EE | 82 | |
| 07EF | CF | Display "I" |
| 07F0 | | |
| 07F1 | 20 | CE |
| 07F2 | 3 | |
| 07F3 | 6 | |
| 07F4 | 9 | |
| 07F5 | 21 | + |
| 07F6 | | |
| 07F7 | | |
| 07F8 | | |
| 07F9 | | |
| 07FA | 00 | |
| 07FB | C0 | |
| 07FC | C0 | Print Decimal |
| 07FD | 00 | Point |
| 07FE | 00 | |
| 07FF | 8E | Display "F" |

APPENDIX C

ISAR Register Usage

| Reg. No. (Hex) | Usage | Status Register Bits | Flag |
|---|---|---|---|
| 0 | Status | . 0 | "00" DOLLAR COIN |
| 1–4 | General Use | . 1 | OVERFLOW |
| 5 | Current Key Code | . 2 | ENTER |
| 6 | New Data | . 3 | ADV 1 LINE (to take up paper slack) |
| 7 | Save Acc | . 4 | DISPENSE FAIL |
| 8 | Save ISAR | . 5 | FILL |
| 9 | Save Status | . 6 | PRINTER FAIL |
| A | Counter to flash messages | . 7 | PRINT OFF |
| B | Display Scan Counter | | |
| C | Stack (KU) | | |
| D | Stack (KL) | | |
| E | Data Look Up (QU) | | |
| F | Data Look Up (QL) | | |

| Reg. No. (Octal) | Usage | |
|---|---|---|
| 20 | Display | LSD |
| 21 | . | . |
| 22 | . | . |
| 23 | . | . |
| 24 | Buffer | . |
| 25 | . | . |
| 26 | . | . |
| 27 | Buffer | MSD |
| 30 | Key | |
| 31 | . | |
| 32 | . | |
| 33 | . | |
| 34 | Buffer | |
| 35 | Dispense Flags | |
| 36 | Timer for | |
| 37 | 600 MSEC delay | |
| 40 | Total | |

APPENDIX C-continued

ISAR Register Usage

| | | |
|---|---|---|
| 41 | . | |
| 42 | . | |
| 43 | . | |
| 44 | Buffer | |
| 45 | Not Used | |
| 46 | Not Used | |
| 47 | Not Used | |
| 50 | Print | Symbol |
| 51 | . | 1¢ |
| 52 | . | 10¢ |
| 53 | . | D.P. |
| 54 | . | $1 |
| 55 | . | $10 |
| 56 | . | $100 |
| 57 | . | $1,000 |
| 60 | . | $10,000 |
| 61 | . | $100,000 |
| 62 | Buffer | ERROR & Minus |
| 63 | Remote | 1¢ |
| 64 | . | 10¢ |
| 65 | . | $1 |
| 66 | . | Remote Data |
| 67 | Buffer | FF=Accept Data |
| 70 | Print line ctr. | |
| 71 | Print char. ctr. | |
| 72 | Key Stack | 1st |
| 73 | . | 2nd |
| 74 | . | 3rd |
| 75 | . | 4th |
| 76 | Debounce ctr 3 passes (24 MSEC) | |
| 77 | Last col. for key accepted | |

APPENDIX D

Component Listing

| Component | Ref. No. | Description |
|---|---|---|
| Microcomputer | 26 | F3870 Micro Machine TM 2 manufactured by Fairchild Camera and Instrument Corp. |
| Shift Registers | 37, 38 | Two SN74164N 8-bit parallel output shift registers manufactured by Texas Instruments, Inc. |
| One-shot multivibrators | 33, 44 | LM556CN dual timer manufactured by National Semiconductor Corp. |
| Oscillator-counter | 48 | CD4060BE oscillator/counter manufactured by RCA. |
| Operational amplifier | 50 | UA741TC linear op amp manufactured by Motorola. |
| Voltage comparator | 54 | LM311N voltage comparator manufactured by National Semiconductor Corp. |
| AND gates | 36, 40, 47 | Two CD4081BE quad AND gates manufactured by RCA. |
| NAND gates | 35, 76, 77, 78, 83, 84 | Two CD4011BE quad NAND gates manufactured by RCA. |
| Drivers | 41, 60, 66, 93 | Two UDN2981A octal current source drivers manufactured by Sprague Electric Co. |
| Darlington transistors | 43 | One TPP3000 triple Darlington transistors and one TPP2000 dual Darlington transistors, both manufactured by Sprague Electric Co. |
| Counter | 73 | CD4022BE octal counter manufactured by RCA. |
| Drivers | 94 | ULN2003A octal current sink drivers manu- |

APPENDIX D-continued

| Component | Component Listing Ref. No. | Description |
|---|---|---|
| | | factured by Sprague Electric Co. |
| Drivers | 72, 74 | CD4050BE hex buffers manufactured by RCA. |
| Optical Isolating circuits | 79, 81, 82 89 | Four HP-2731 dual optical isolating circuits manufactured by Hewitt-Packard Co. |
| Latch | 84 | CD40174B hex flip-flops manufactured by RCA. |
| Inverters | 34, 45, 58, 59, 64, 65, 97, 98 | Two CD4049 BE hex inverters manufactured by RCA. |
| Drivers | 39 | Two UDN2013A octal current sink drivers manufactured by Sprague Electric Co. |

It is claimed:

1. A calculating coin dispenser which comprises:

means for holding coins in stacks of different denominations;

coin ejector means for selecting coins in individual stacks for ejection;

payment means for driving the coin ejector means to dispense selected coins;

head means with elements for forming alphanumeric characters across the width of a record-keeping tape;

head enable means electrically coupled to the head means for enabling selected elements in the head means;

keyboard input means for entering calculating and coin dispensing commands and operands associated therewith;

first means responsive to selected keyboard inputs for storing simple operands and performing calculations therewith to generate a total operand;

second means responsive to a selected keyboard command for generating output signals, which are coupled to the coin ejector means to select coins to be dispensed in the amount of a selected operand, and which are coupled to the payment means to effect payment;

third means responsive to selected keyboard commands for generating output signals which are coupled to the head means and to the head enable means to print alphanumeric characters on the tape, including simple operands and total operands generated in the first means; and fourth means for signalling a preselected one of two limits for the amount to be dispensed;

wherein the keyboard input means includes a total key and a dispense key;

wherein the first means is responsive to the operation of the total key to calculate a total amount; and wherein the second means is coupled to the first means and is responsive to the limit signal from the fourth means and to the sequential operation of the total key and the dispense key to generate output signals to dispense the total amount up to the signalled limit.

2. The coin dispenser of claim 1, further comprising:

fifth means for signalling the identity of a preselected one of two coin holding means that are used in the coin dispenser; and wherein the second means is responsive to the identity signal from the fifth means to further limit the total amount dispensed according to which coin holding means has been selected for use in the coin dispenser.

3. The coin dispenser of claim 1, further comprising:

a multi-digit display;

further comprising sixth means responsive to selected keyboard inputs to couple amounts to the display to show the coinage that is dispensed; and wherein the sixth means is also responsive to the limit signal from the fourth means, to calculate any overage and couple the most significant digits of such overage to the display together with the amount that is actually dispensed.

4. The coin dispenser of claim 1, further comprising:

remote interface means for receiving signals from another device; and wherein the second means is coupled to the remote interface means and gives priority to keyboard inputs before responding to signals coupled through the remote interface means.

5. A calculating coin dispenser which comprises:

means for holding coins in stacks of different denominations;

coin ejector responsive to data signals for selecting coins in individual stacks for ejection, the coin ejector means being actuated by an enable signal;

payment means responsive to an enable signal for driving the coin ejector means to dispense the selected coins;

head means with elements responsive to data signals for selecting alphanumeric characters to be formed across the width of a record-keeping tape;

head enable means electrically coupled to the head means for enabling the head means in response to an enable signal;

a keyboard that is operable for entering calculating and coin dispensing commands and operands associated therewith; and microcomputer means coupled to the keyboard and responsive to keyboard commands for performing calculations and for generating, through a common output, data signals which are coupled to the head means to select the alphanumeric characters to be formed and data signals which are coupled to the coin ejector means to select the coins to be dispensed, the microcomputer means also being coupled to the head enable means, to the coin ejector means and to the payment means for generating enable signals thereto to cause the selected alphanumeric characters to be printed on the tape and to effect payment.

6. The coin dispenser of claim 5, further comprising:

a multi-digit display; and wherein the microcomputer means is responsive to selected keyboard inputs to couple amounts to the display to show the coinage that is dispensed; and wherein the microcomputer means is also responsive to the limit signal to calculate any overage and couple the most significant digits of such overage to the display together with the amount that is actually dispensed.

7. The coin dispenser of claim 5, further comprising:

remote interface means for receiving signals from another device; and wherein the microcomputer means gives priority to keyboard inputs before responding to signals coupled through the remote interface means.

8. The coin dispenser of claim 5, wherein:

the keyboard includes a "1" key, a dollar key and a dispense key; and wherein the microcomputer means is responsive to the sequential operation of the dollar key and the dispense key to generate signals to dispense split change for a dollar, and is also responsive to the sequential operation of the "1" key, the dollar key and the dispense key to generate signals to dispense a dollar coin.

9. The coin dispenser of claim 5, wherein:

the keyboard includes a "0" key and a dispense key; and wherein the microcomputer means is responsive to the sequential operation of the "0" key and the dispense key to generate signals to dispense split change for a quarter, and is responsive to other input sequences including the "0" key to dispense amounts having a "0" digit.

10. The coin dispenser of claim 5, wherein:

the keyboard includes a clear entry key, a plurality of calculator function keys, and a plurality of operand keys; and wherein the microcomputer means is responsive to the operation of the clear entry key after the operation of one or more of the operand keys and before the operation of one of the calculator function keys to clear an entry before the head means is enabled to record the entry.

11. The coin dispenser of claim 5, wherein:

the coin ejector means includes a power driver and a one-shot enabling means responsive to a signal from the microcomputer means to enable the power driver during a payment cycle; and wherein the microcomputer means is operable to time the payment cycle and to inhibit the enabling of the power driver for a pre-selected time interval between payment cycles to provide a recovery cycle for the payment means.

12. The calculating coin dispenser of claim 5, wherein:

the payment means includes a rotary solenoid with an arm that is coupled to the coin ejector means; and further comprising a damping means fixed within the coin dispenser and having a plunger that is coupled to the arm of the payment solenoid to damp vibrations as the coin ejector means are being driven by the payment solenoid.

13. The coin dispenser of claim 5, wherein:

the head enabling means includes a one-shot enabling means responsive to a signal from the microcomputer means to enable the head means for a predetermined print cycle; and wherein the head enabling means also includes pulse, width adjustment means responsive to the enable signal provided by the one-shot enabling means and responsive to the supply voltage to the head means to generate a reset pulse to the one-shot enabling means before it has timed out when the supply voltage to the print head exceeds a predetermined value.

14. The coin dispenser of claim 5, further comprising:

means for signalling a preselected one of two limits for the amount to be dispensed;

wherein the keyboard includes a total key and a dispense key;

wherein the microcomputer means is responsive to the operation of the total key to calculate a total amount; and wherein the microcomputer means is responsive to the limit signal and to the sequential operation of the total key and the dispense key to generate output signals to dispense the total amount up to the signalled limit.

15. The coin dispenser of claim 14, further comprising:

means for signalling the identity of a preselected one of two coin holding means that are used in the coin dispenser; and wherein the microcomputer means is responsive to the identity signal to further limit the total amount dispensed according to which coin holding means has been selected for use in the coin dispenser.

16. The coin dispenser of claim 5, further comprising:

means responsive to actuate signals for advancing a roll of tape;

wherein the keyboard includes a total key and a subtotal key; and wherein the microcomputer means is responsive to sense a previous input through either of the total and subtotal keys to advance the tape a predetermined number of lines before enabling the head means to record another entry.

17. The coin dispenser of claim 16, wherein:

the keyboard input means includes an advance key; and wherein the microcomputer means is responsive to the operation of the advance key to generate an actuate signal to the means for advancing the roll of tape.

18. A calculating coin dispenser, which comprises:

means for holding coins in stacks of different denominations;

coin ejector means responsive to data signals for selecting coins in individual stacks for ejection, the coin ejector means being actuated by an enable signal;

payment means responsive to an enable signal for driving the coin ejector means to dispense the selected coins;

print head means with elements responsive to data signals for selecting alphanumeric characters to be formed across the width of a record-keeping tape;

print head enable means electrically coupled to the print head means for enabling the print head means in response to an enable signal;

serial-to-parallel means electrically coupled to the coin ejector means and to the print head means, and responsive to serially received data input signals to provide parallel data output signals which select the alphanumeric characters to be formed by the print head means, and which select the coins to be ejected by the coin ejector means;

keyboard input means for entering calculating and coin dispensing commands and operands associated therewith; and processing means responsive to the keyboard commands for performing calculations, for generating serial data output signals to the serial-to-parallel means to select coins to be dispensed and alphanumeric characters to be recorded on tape, and for generating enable signals to the coin ejection means, to the payment means and to the print head enable means to perform coin dispensing and record-keeping operations.

19. The coin dispenser of claim 18, wherein:

the keyboard input means includes a clear entry key, a plurality of calculator function keys, and a plurality of operand keys; and wherein the processing means is responsive to the operation of the clear entry key after the operation of one or more of the operand keys forming an entry and before the operation of one of the calculator function keys to clear the entry before the head means is enabled to record the entry.

20. The coin dispenser of claim 18, wherein:

the coin ejector means includes a power driver and a one-shot enabling means responsive to a signal from the processing means to enable the power driver during a payment cycle; and wherein the processing means is operable to time the payment cycle and to inhibit the enabling of the power driver for a preselected timed interval between payment cycles to provide a recovery cycle for the payment means.

21. The calculating coin dispenser of claim 18, wherein:

the payment means includes a rotary solenoid with an arm that is coupled to the coin ejector means; and further comprising damping means fixed within the coin dispenser and having a plunger that is coupled to the arm of the payment solenoid to damp vibrations as the coin ejector means are being driven by the payment solenoid.

22. The coin dispenser of claim 18, wherein:

the print head enable means includes a one-shot enable means responsive to a signal from the processing means to enable the print head means for a predetermined print cycle; and wherein the print head enable means also includes pulse width adjustment means responsive to the enable signal provided by the one-shot enabling means and responsive to the supply voltage to the print head means to generate a reset pulse to the one-shot enabling means before it has timed out when the supply voltage to the print head means exceeds a predetermined value.

23. The coin dispenser of claim 18, further comprising:

means responsives to actuate signals for advancing a roll of tape;

further comprising means for signalling an automatic advance of the tape after a total operation;

wherein the keyboard input means includes a total key for commanding a total operation; and wherein the processing means is responsive to sense the automatic advance signal and an entry of the total key to actuate the paper advance means and advance the paper a predetermined number of lines before enabling the print head means to record another entry.

24. The coin dispenser of claim 23, wherein:

the keyboard input means includes an advance key; and wherein the third means is responsive to the operation of the advance key to generate an actuate signal to the means for advancing the roll of tape.

25. A calculating coin dispenser which comprises:

means for holding coins in stacks of different denominations;

coin ejector means for selecting coins in individual stacks for ejection;

payment means for driving the coin ejector means to dispense selected coins;

head means with elements for forming alphanumeric characters across the width of a record-keeping tape;

head enable means electrically coupled to the head means for enabling selected elements in the head means;

keyboard input means for entering calculating and coin dispensing commands and operands associated therewith;

first means responsive to selected keyboard inputs for storing operands and performing calculations therewith to generate a total operand;

second means responsive to a selected keyboard command for generating output signals, which are coupled to the coin ejector means to select coins to be dispensed in the amount of a selected operand, and which are coupled to the payment means to effect payment;

third means responsive to selected keyboard commands for generating output signals which are coupled to the head means and to the head enable means to print alphanumeric characters on the tape, including simple operands and total operands generated in the first means; and wherein the keyboard input means includes a "1" key, a dollar key and a dispense key; and wherein the second means is responsive to the sequential operation of the dollar key and the dispense key to generate signals to dispense split change for a dollar, and is also responsive to the sequential operation of the "1" key, the dollar key and the dispense key to generate signals to dispense a dollar coin.

26. A calculating coin dispenser which comprises:

means for holding coins in stacks of different denominations;

coin ejector means for selecting coins in individual stacks for ejection;

payment means for driving the coin ejector means to dispense selected coins;

head means with elements for forming alphanumeric characters across the width of a record-keeping tape;

head enable means electrically coupled to the head means for enabling selected elements in the head means;

keyboard input means for entering calculating and coin dispensing commands and operands associated therewith;

first means responsive to selected keyboard inputs for storing simple operands and performing calculations therewith to generate a total operand;

second means responsive to a selected keyboard command for generating output signals, which are coupled to the coin ejector means to select coins to be dispensed in the amount of a selected operand, and which are coupled to the payment means to effect payment;

third means responsive to selected keyboard commands for generating output signals which are coupled to the head means and to the head enable means to print alphanumeric characters on the tape, including simple operands and total operands generated in the first means; and wherein the keyboard input means includes a "0" key and a dispense key; and wherein the second means is responsive to the sequential operation of the "0" key and the distance key to generate signals to dispense split change for a dollar, and is responsive to other input sequences including the "0" key to dispense amounts having a "0" digit.

* * * * *

UNITED STATES PATENT AND TRADEMARK OFFICE

CERTIFICATE OF CORRECTION

PATENT NO. : 4,359,062 PAGE 1 of 5

DATED : November 16, 1982

INVENTOR(S) : Richard P. Uecker et al

It is certified that error appears in the above—identified patent and that said Letters Patent is hereby corrected as shown below:

IN THE DRAWINGS

In Fig. 8b reference numbers should be added as shown herein.

FIG. 8b

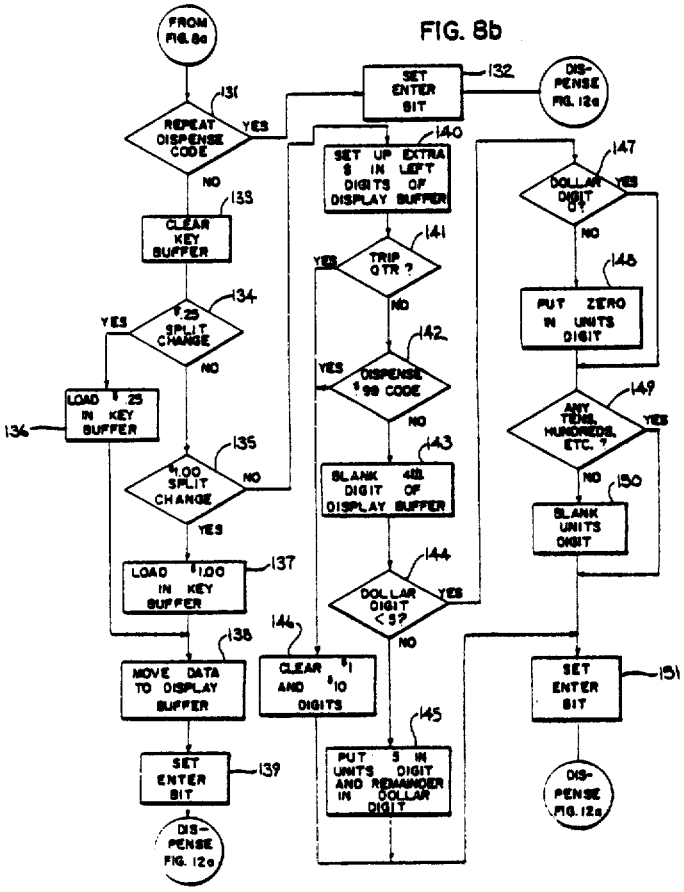

UNITED STATES PATENT AND TRADEMARK OFFICE

CERTIFICATE OF CORRECTION

PATENT NO. : 4,359,062

DATED : November 16, 1982

INVENTOR(S) : Richard P. Uecker et al

It is certified that error appears in the above—identified patent and that said Letters Patent is hereby corrected as shown below:

In Fig. 10a the reference number of the second block should be changed from "16" to --165--.

In Column 1, line 23, "are" should be --were--.

In Column 2, line 15, "othe" should be --other--.

In Column 2, line 59, "furtherutilized" should be --further utilized--.

In Column 4, line 31, "=" and "=" should be -- ≡ -- and -- ≢ -- respectively.

In Column 4, line 52, "part" should be --past--.

In Column 4, line 59, "to" should be --so--.

In Column 8, line 5, "cmparator" should be --comparator--.

In Column 8, line 49, after "first" insert --input--.

In Column 9, line 42, after "electronic" insert --cash--.

In Column 10, lines 42-43, "resient" should be --resident--.

In Column 11, line 31, "38" should be omitted.

In Column 12, line 48, "is" (second occurrence) should be --as--.

UNITED STATES PATENT AND TRADEMARK OFFICE

CERTIFICATE OF CORRECTION

PATENT NO. : 4,359,062

DATED : November 16, 1982

INVENTOR(S) : Richard P. Uecker et al

It is certified that error appears in the above—identified patent and that said Letters Patent is hereby corrected as shown below:

In column 13, line 1, "132" should be --130--.

In column 13, line 66, "134" should be --144--.

In column 20, line 3, "ae" should be --are--.

In Appendix A, cols. 31 and 32, line 0285, "H'8:'" should be --H'80'--.

In Appendix A, cols. 33 and 34, line 02E3, "A,!" should be --A,1--.

In Appendix A, cols. 35 and 36, line 0312, "H'05'" should be --h'05'--.

In Appendix A, cols. 35 and 36, line 034C, "KLR" should be --LR--.

In Appendix A, cols. 37 and 38, line 0376, "BR7" and "MOVD" should be moved under the heading "Mnemonic".

In Appendix A, cols. 47 and 48, line 058A, "BN2" should be --BNZ--.

In Appendix A, cols. 47 and 48, line 058A, after "MSEC" insert --?--.

In Appendix A, cols. 49 and 50 line 0601, "PHASE 2 HI" should appear under the heading "Comment".

UNITED STATES PATENT AND TRADEMARK OFFICE

CERTIFICATE OF CORRECTION

PATENT NO. : 4,359,062

DATED : November 16, 1982

INVENTOR(S) : Richard P. Uecker et al

It is certified that error appears in the above—identified patent and that said Letters Patent is hereby corrected as shown below:

In Appendix A, cols. 51 and 52, line 064E should read --

| Loc | Object | Label | Mnemonic | | Comment | |
|---|---|---|---|---|---|---|
| 064E | 94DO 061F | . | BNZ | JRT | NO | --. |

In Appendix A, cols. 53 and 54, line 0688, under "Mnemonic" it should read --LR A,S-- and under "Comment" it should read --GET REMOTE DATA--.

In Appendix A, cols. 53 and 54, line 06B7, "PI DISPENSE" should be arranged under "Mnemonic" heading.

In Appendix A, cols. 55 and 56, line 06E0, "H'ff'" should be --H'FF'--.

In Appendix B, a group of horizontal dividing lines that aid interpretation of the Comments should have appeared.

UNITED STATES PATENT AND TRADEMARK OFFICE

CERTIFICATE OF CORRECTION

PATENT NO. : 4,359,062 PAGE 5 of 5

DATED : November 16, 1982

INVENTOR(S) : Richard P. Uecker et al

It is certified that error appears in the above—identified patent and that said Letters Patent is hereby corrected as shown below:

In Column 66, line 15, before "operands" insert --simple--.

In Column 67, line 4, "distance" should be --dispense--.

Signed and Sealed this

*Twenty-second* Day of *March 1983*

[SEAL]

*Attest:*

GERALD J. MOSSINGHOFF

*Attesting Officer* *Commissioner of Patents and Trademarks*